US012636543B2

(12) United States Patent
Xu et al.

(10) Patent No.: US 12,636,543 B2
(45) Date of Patent: May 26, 2026

(54) FITNESS EQUIPMENT

(71) Applicant: SHENZHEN THOUSANDSHORES TECHNOLOGY CO., LTD., Shenzhen (CN)

(72) Inventors: Hui Xu, Shenzhen (CN); Jing Luo, Shenzhen (CN); Haoxuan Zeng, Shenzhen (CN); Peiyan Lai, Shenzhen (CN)

(73) Assignee: SHENZHEN THOUSANDSHORES TECHNOLOGY CO., LTD., Shenzhen (CN)

( * ) Notice: Subject to any disclaimer, the term of this patent is extended or adjusted under 35 U.S.C. 154(b) by 100 days.

(21) Appl. No.: 18/786,957

(22) Filed: Jul. 29, 2024

(65) Prior Publication Data

US 2025/0082984 A1 Mar. 13, 2025

Related U.S. Application Data

(63) Continuation-in-part of application No. 18/477,524, filed on Sep. 28, 2023, now Pat. No. 12,048,859.

(30) Foreign Application Priority Data

| | | |
|---|---|---|
| Sep. 11, 2023 | (CN) | 202311169097.4 |
| Sep. 11, 2023 | (CN) | 202311171082.1 |
| Jul. 8, 2024 | (CN) | 202421612151.8 |

(51) Int. Cl.
*A63B 21/00* (2006.01)
*A63B 21/22* (2006.01)

(52) U.S. Cl.
CPC ..... *A63B 21/4045* (2015.10); *A63B 21/153* (2013.01); *A63B 21/22* (2013.01); *A63B 21/4035* (2015.10)

(58) Field of Classification Search
CPC ... A63B 21/4045; A63B 21/153; A63B 21/22; A63B 21/4035; A63B 2022/0079;
(Continued)

(56) References Cited

U.S. PATENT DOCUMENTS 3,610,617 A 10/1971 Hepburn
3,690,654 A 9/1972 Hepburn
(Continued)

FOREIGN PATENT DOCUMENTS

CN 109173163 A 1/2019
CN 212090746 U * 12/2020
(Continued)

OTHER PUBLICATIONS

"FitTransformer: All-In-One Modular Home Gym", Web page <https://www.kickstarter.com/projects/2484918/fittransformer-one-stop-modular-home-gym-of-the-future?ref=discovery&term=sportneer>, Jul. 13, 2023.
(Continued)

*Primary Examiner* — Andrew M Kobylarz
(74) *Attorney, Agent, or Firm* — Porus IP LLC

(57) ABSTRACT

Some embodiments of the present disclosure provide fitness device, comprising an adjustable accessory and/or a detachable accessory. The adjustable accessory includes a stand column, an extension arm, a sliding assembly, a first assembly, and a second assembly. The sliding assembly is slidably disposed on the stand column. The first assembly is rotatably disposed on the sliding assembly. The second assembly is connected with the first assembly. The extension arm is rotatably connected with the second assembly. The detachable accessory is connected with the extension arm.

12 Claims, 39 Drawing Sheets

(58) Field of Classification Search
CPC ..... A63B 2220/17; A63B 2220/30; A63B 2220/51; A63B 2220/805; A63B 2230/06; A63B 2230/207; A63B 2230/30; A63B 21/0552; A63B 21/15; A63B 21/156; A63B 22/0076; A63B 22/0087; A63B 23/1209; A63B 24/0087; A63B 21/0058
See application file for complete search history.

(56) References Cited

U.S. PATENT DOCUMENTS

| | | | | |
|---|---|---|---|---|
| 3,764,132 | A | 10/1973 | Hepburn | |
| 5,133,545 | A | 7/1992 | Moschetti et al. | |
| 6,299,566 | B1 | 10/2001 | Wu | |
| 10,307,631 | B2 | 6/2019 | Jeremic et al. | |
| 10,350,446 | B2 | 7/2019 | Simonetti | |
| 11,745,040 | B1 | 9/2023 | Krull et al. | |
| 12,280,306 | B1 * | 4/2025 | Wang | A63B 23/1236 |
| 12,318,657 | B1 * | 6/2025 | Nolan | A63B 17/04 |
| 2020/0406097 | A1 | 12/2020 | Otsuki et al. | |
| 2022/0062691 | A1 | 3/2022 | Kao | |
| 2022/0111241 | A1 | 4/2022 | Moyer | |
| 2022/0161088 | A1 | 5/2022 | Wilson et al. | |
| 2023/0338771 | A1 | 10/2023 | Hansen | |
| 2025/0325878 | A1 * | 10/2025 | Ezran | A63B 21/152 |

FOREIGN PATENT DOCUMENTS

| | | | | |
|---|---|---|---|---|
| CN | 212141295 | U | 12/2020 | |
| CN | 214286640 | U | 9/2021 | |
| CN | 217448819 | U | 9/2022 | |
| CN | 217745519 | U | 11/2022 | |
| CN | 217908755 | U | 11/2022 | |
| CN | 115920322 | A | 4/2023 | |
| CN | 116115962 | A | 5/2023 | |
| CN | 116370896 | A | 7/2023 | |
| DE | 202024100673 | U1 * | 2/2024 | A63B 21/156 |
| WO | WO-2022166460 | A1 * | 8/2022 | A63B 21/005 |

OTHER PUBLICATIONS

First Office Action in Chinese Application No. 202311171082.1 mailed on Jul. 29, 2025, 14 pages.
First Office Action in Chinese Application No. 202311169097.4 mailed on Jul. 31, 2025, 13 pages.

* cited by examiner

1000

FITNESS EQUIPMENT

CROSS-REFERENCE TO RELATED APPLICATIONS

This application is a Continuation in part of U.S. patent application Ser. No. 18/477,524, filed on Sep. 28, 2023, which claims priority of Chinese Patent Application No. 202311171082.1, filed on Sep. 11, 2023, and Chinese Patent Application No. 202311169097.4, filed on Sep. 11, 2023, and this application claims priority of Chinese Patent Application No. 202421612151.8, filed on Jul. 8, 2024, the contents of each of which are entirely incorporated herein by reference.

TECHNICAL FIELD

The present disclosure relates to the technical field of fitness device, and in particular, to fitness devices.

BACKGROUND

Fitness device continues to evolve and innovate when meeting people's needs for health and fitness enhancement. In the process of fitness, fitness device is an auxiliary tool, and its performance and ease of use directly affect the fitness effect and experience of fitness.

Some fitness device can adjust the distance between the user and the weight through the extension arm, and assist the user in training with different movements via the extension arm of different lengths and/or the extension arm of different angles. When the user carries out different movements for training, the user often needs to replace the fitness device. After long time of use, the fitness device may have errors due to wear and tear. When user performs strength training, stretching training and other training that requires precise control of motion amplitude, different actions may require different weights, so the weight of the fitness device needs to be adjusted. Due to the influence of errors, problems such as looseness, abnormal noise, and shaking may occur after the user adjusts the weight of the fitness device.

Therefore, it is desirable to provide a fitness device with an expanded application scope fitness device and the improved stability of the fitness device.

SUMMARY

One or more embodiments of the present disclosure provide fitness device, comprising an adjustable accessory and/or a detachable accessory. The adjustable accessory may include a stand column, an extension arm, a sliding assembly, a first assembly, and a second assembly. The sliding assembly may be slidably disposed on the stand column. The first assembly may be rotatably disposed on the sliding assembly. The second assembly may be connected with the first assembly. The extension arm may be rotatably connected with the second assembly. The detachable accessory may be connected with the extension arm.

In some embodiments, the sliding assembly may include a slider and a slider pin. The slider may be slidably connected with the stand column. At least one slider limiting hole may be provided in the stand column. The slider pin may be inserted into the slider and is capable of being matched with the at least one slider limiting hole.

In some embodiments, a first groove may be provided in at least one side of the stand column. A guide rail may be provided in the first groove. The slider may be provided with a second groove matched with the U-shaped guide rail.

In some embodiments, at least one side of the U-shaped guide rail may be provided with a third groove. The slider may be provided with a slider protrusion matched with the third groove.

In some embodiments, the slider may be provided with a plurality of rollers. The plurality of rollers may be connected with the stand column in a rolling manner.

In some embodiments, the first assembly may include an adjustment column, an adjustment base, and a disc pin. The adjustment base may be disposed on the sliding assembly. The adjustment column may be rotatably disposed on the adjustment base. At least a portion of a side of the adjustment base may include a first cylindrical surface. An axis of the adjustment column may be collinear with an axis of the first cylindrical surface. The first cylindrical surface may be provided with a plurality of adjustment limiting holes. The adjustment column may be provided with an adjustment lock block. The adjustment lock block may be provided with a disc lock hole. The disc lock hole is capable of being aligned with one of the plurality of adjustment limiting holes. The disc pin may detachably penetrate through the disc lock hole and one of the plurality of adjustment limiting holes.

In some embodiments, the second assembly may include an adjustment member, a connecting rod, and an operating member. The adjustment member may be disposed on the adjustment column. The extension arm may be rotatably connected with the adjustment member. One end of the connecting rod may be detachably connected with the adjustment member, and the other end of the connecting rod may be in transmission connection with the operating member. The operating member may be disposed on the extension arm.

In some embodiments, the operating member may include a fourth groove, an operating block, and a connecting sleeve. The fourth groove may be disposed in the extension arm. The operating block may be slidably connected with the fourth groove. A relative sliding direction of the operating block to the fourth groove may be parallel to a length direction of the extension arm. The connecting sleeve may be disposed on the operating block. The connecting sleeve may be connected with the connecting rod.

In some embodiments, a reset structure may be disposed on the extension arm. The reset structure may be configured to cause the operating block to move from a first position to a second position.

In some embodiments, the reset structure may include a reset spring. One end of the reset spring may be connected with the extension arm, and the other end of the reset spring may be connected with the operating block. When the operating member is in the first position, the reset spring may be in a first compressed state; when the operating member is in the second position, the reset spring may be in a second compressed state or a natural state. A spring force in the second compressed state may be less than a spring force in the first compressed state.

In some embodiments, the adjustment member may include at least one disc gear. The extension arm may be rotatably connected with the at least one disc gear. A rotation center of the extension arm may be colinear with an axis of the at least one disc gear. The at least one disc gear may be disposed on a circumferential surface of the adjustment column. An axis of the at least one disc gear may be perpendicular to an axis of the adjustment column. The at least one disc gear may include a second cylindrical surface.

A plurality of adjustment tooth grooves may be disposed in the second cylindrical surface. The plurality of adjustment tooth grooves may be disposed along a circumferential direction of the second cylindrical surface. The connecting rod may be detachably engaged with one of the plurality of adjustment tooth grooves.

In some embodiments, the at least one disc gear may include two disc gears.

In some embodiments, the connecting rod may be connected with an adjustment pin. The adjustment pin may be detachably connected with one of the plurality of adjustment tooth grooves.

In some embodiments, the detachable accessory may include a handle and a connection assembly. The connection assembly may include a first connection member and a second connection member. The first connection member may be detachably connected with a rope body of the fitness device. At least a portion of the rope body may penetrate through the first connection member. The second connection member may be disposed in the handle. The first connection member may be detachably connected with the second connection member.

In some embodiments, the rope body may be engaged with the first connection member through a rope knot.

In some embodiments, the first connection member may include a clamp ring. The second connection member may include a buckle mechanism. The buckle mechanism may be engaged with the clamp ring.

In some embodiments, the first connection member may include a spherical structure, a fifth groove may be disposed in the spherical structure, and the clamp ring may be disposed in the fifth groove.

In some embodiments, the buckle mechanism may include a buckle. The buckle may be L-shaped. At least a portion of a side of the buckle facing the first connection member may be an inclined surface. The buckle may be movably disposed in the handle.

In some embodiments, the second connection member may further include a snap fastener and a pressing spring. The snap fastener may be disposed on the second connection member in a pressable manner. The snap fastener may be in transmission connection with the buckle mechanism.

In some embodiments, the snap fastener may include a cap body and a stand column body. The pressing spring may sleeve the stand column body. The pressing spring may abut against the cap body and the second connection member, respectively.

BRIEF DESCRIPTION OF THE DRAWINGS

The present disclosure is further illustrated in terms of exemplary embodiments. These exemplary embodiments are described in detail with reference to the drawings. These embodiments are non-limiting exemplary embodiments, in which like reference numerals represent similar structures, and wherein.

DETAILED DESCRIPTION

Figure 1A:
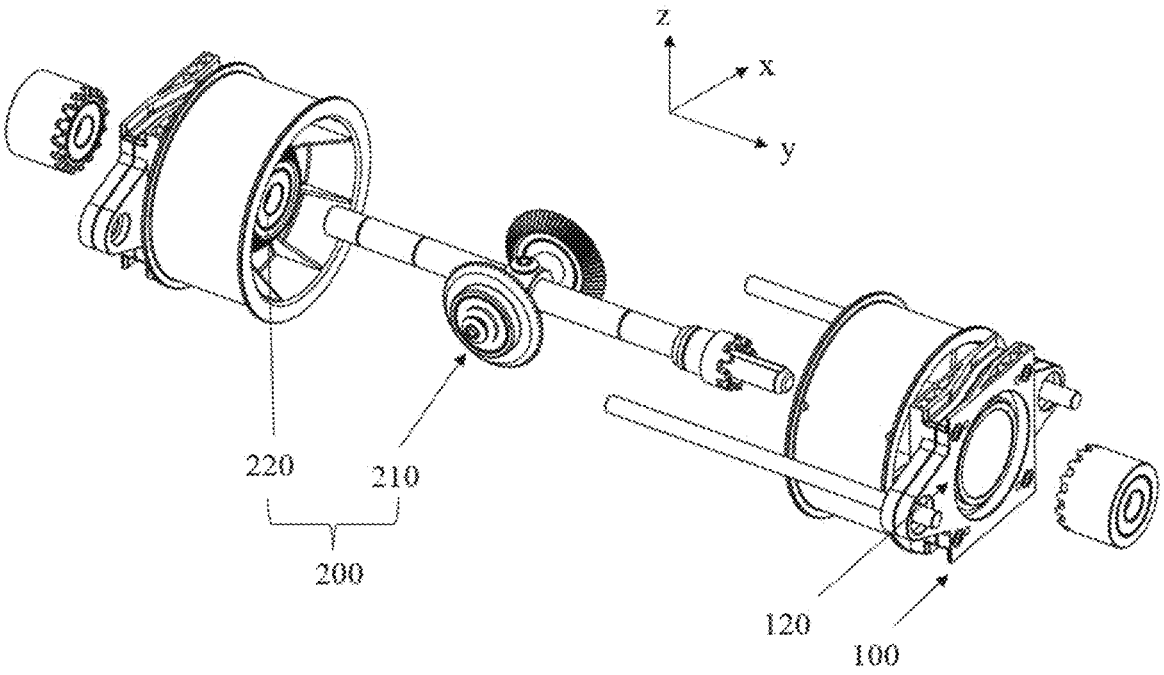
FIG. 1A is an explosion structural diagram illustrating an exemplary switching device according to some embodiments of the present disclosure.

In order to more clearly illustrate the technical solutions related to the embodiments of the present disclosure, a brief introduction of the drawings referred to the description of the embodiments is provided below. Obviously, the drawings described below are only some examples or embodiments of the present disclosure. Those having ordinary skills in the art, without further creative efforts, may apply the present disclosure to other similar scenarios according to these drawings. Unless obviously obtained from the context or the context illustrates otherwise, the same numeral in the drawings refers to the same structure or operation.

A main goal of a strength training mode is to build muscle strength and muscle mass, and weight training equipment (e.g., a barbell, a dumbbell, or a strength-training station) is usually used for the strength training mode with high-intensity, low-repetition training. A main goal of an aerobic training mode is to enhance a cardio-pulmonary function and endurance, and aerobic equipment (e.g., a treadmill, a rowing machine, or a bicycle) is usually used for the aerobic training mode with low-intensity, high-repetition training to improve the cardio-pulmonary function and endurance. The strength training mode and the aerobic training mode correspond to different intensity requirements.

Some embodiments of the present disclosure provide a fitness device. The fitness device may include a resistance module and at least one type of fitness equipment. In some embodiments, the at least one type of fitness equipment may include a plurality of types of fitness equipment. The plurality of types of fitness equipment may include various fitness equipment (e.g., a strength training station or a rowing machine) belonging to different training modes, or may include various different fitness equipment (e.g., a treadmill or a rowing machine) belonging to the same training mode. In some embodiments, the resistance module may be detachably connected with the at least one type of fitness equipment, and the resistance module may provide resistance to the at least one type of fitness device. In some embodiments, the plurality of types of fitness equipment may be connected with a same resistance module. More descriptions regarding the resistance module may be found in the present disclosure below. In some embodiments, the at least one type of fitness equipment may include a switching device configured to switch a training mode of the at least one type of fitness equipment.

Figure 1B:
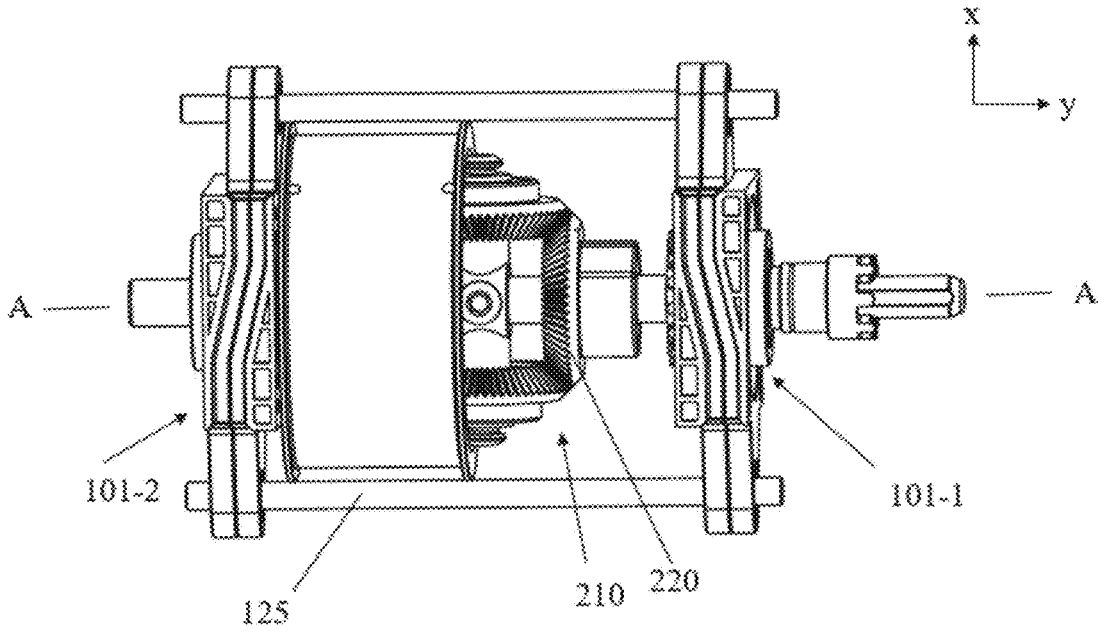
FIG. 1B is a structural diagram illustrating a top view of an exemplary switching device according to some embodiments of the present disclosure.
Figure 1C:
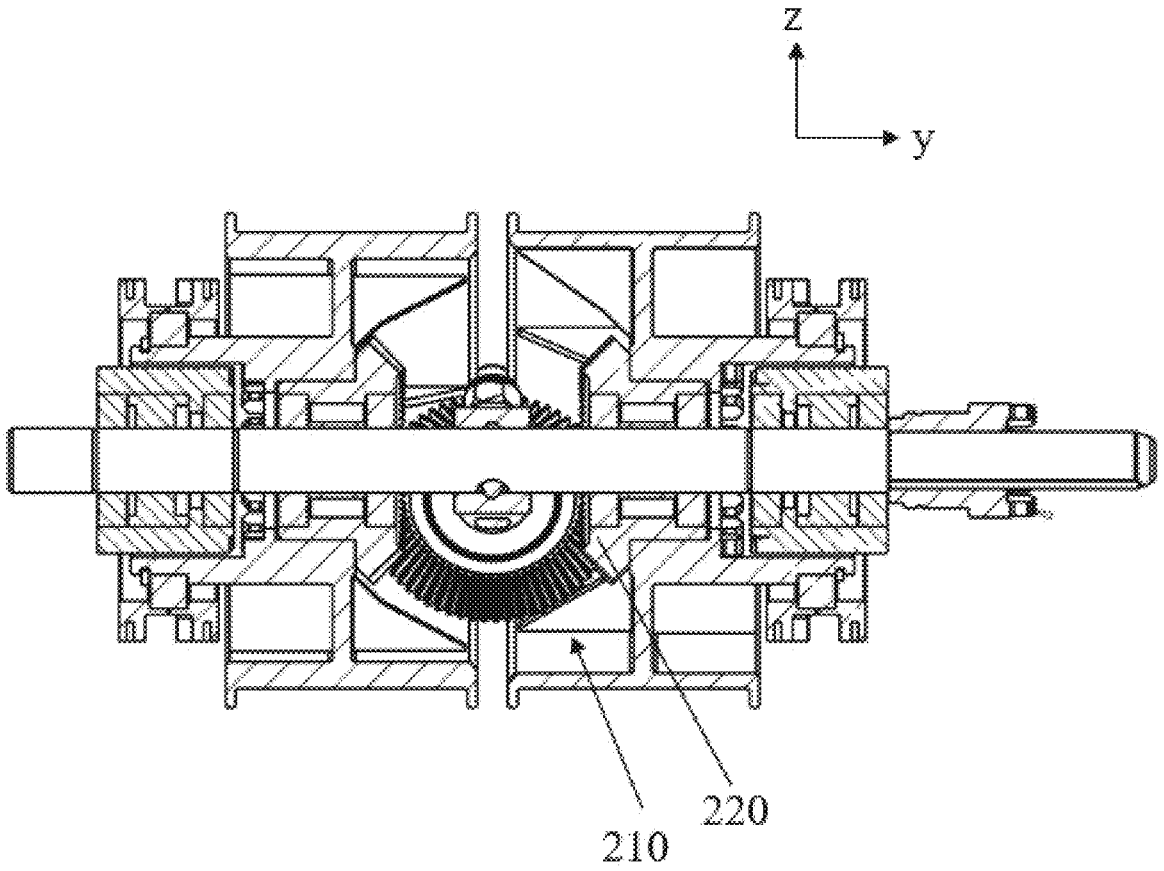
FIG. 1C is a diagram illustrating a cross-section of the switching device structure in an A-A direction of FIG. 1B according to some embodiments of the present disclosure.
Figure 2:
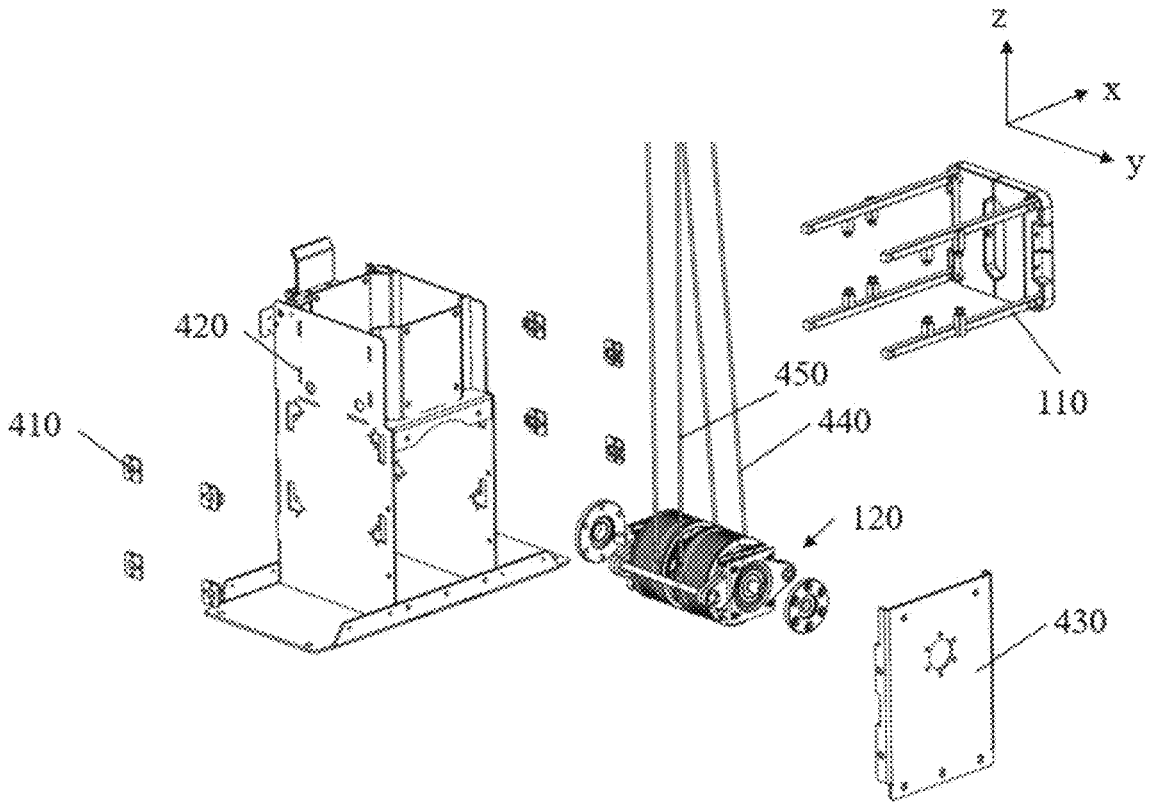
FIG. 2 is a diagram illustrating the mounting of an exemplary switching device according to some embodiments of the present disclosure.

FIG. 1A is an explosion structural diagram illustrating an exemplary switching device according to some embodiments of the present disclosure. FIG. 1B is a structural diagram illustrating a top view of an exemplary switching device according to some embodiments of the present disclosure. FIG. 1C is a diagram illustrating a cross-section of the switching device in an A-A direction of FIG. 1B according to some embodiments of the present disclosure. FIG. 2 is a diagram illustrating the mounting of an exemplary switching device according to some embodiments of the present disclosure.

The switching device for switching a training mode of at least one type of fitness equipment (hereinafter referred to as fitness equipment) may be capable of switching a state. For example, the switching device for switching a training mode of at least one type of fitness equipment may switch between a first state and a second state. The switching device may include a switching mechanism, a first connection mechanism, and a second connection mechanism. The switching mechanism may be configured to switch a training mode of the fitness equipment by switching the state of the switching device between the first state and the second state. The switching mechanism may be drivingly connected with the first connection mechanism or the second connection mechanism. In some embodiments, the switching device may be in a first state by a connection between the first connection mechanism and the switching mechanism. The switching device may be in a second state by the connection between the second connection mechanism and the switching mechanism.

Figure 4:
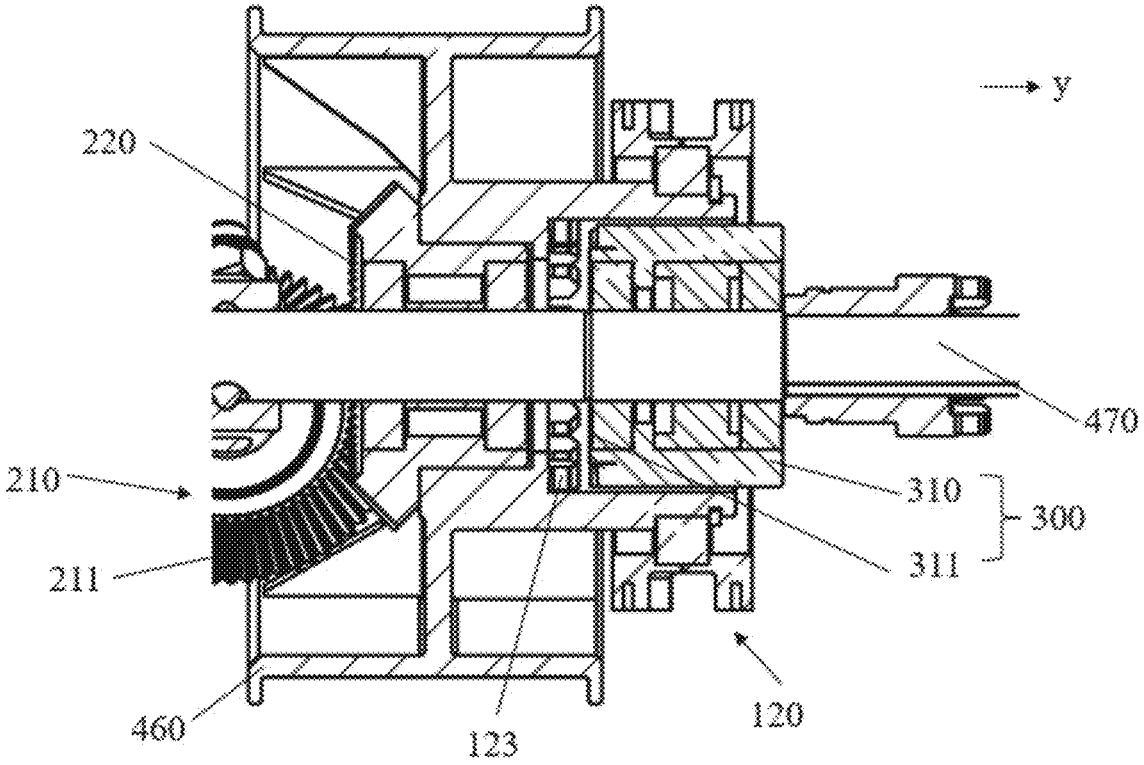
FIG. 4 is a diagram illustrating an exemplary partial structure of FIG. 1C according to some embodiments of the present disclosure.
Figure 6:
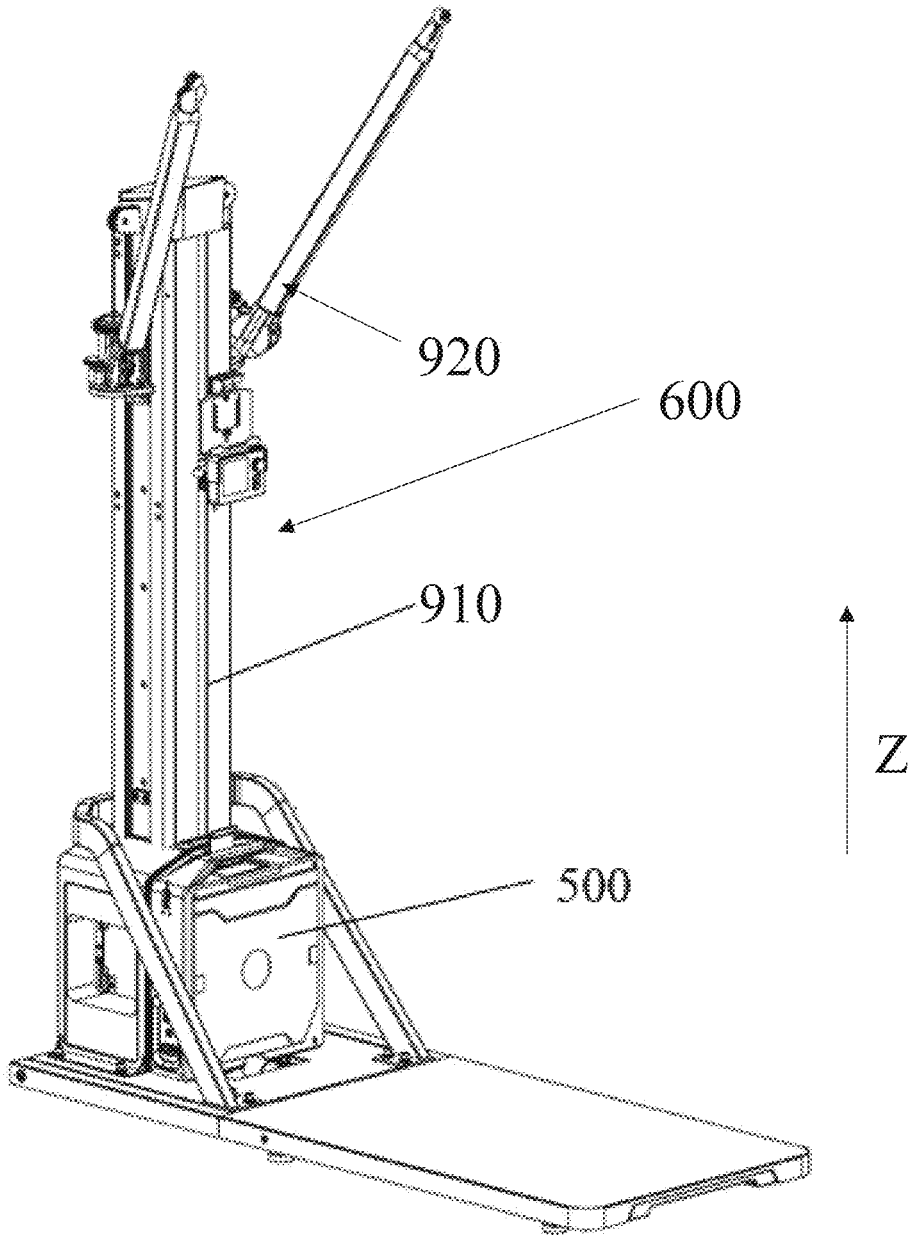
FIG. 6 is a structural diagram illustrating exemplary fitness device according to some embodiments of the present disclosure.

For example, as shown in FIG. 1A-FIG. 1C, and FIG. 4, the switching device may include a switching mechanism 100, a first connection mechanism 200, and a second connection mechanism 300 (see FIG. 4). The switching mechanism 100 may be configured to switch a training mode of the fitness equipment (e.g., the fitness equipment 600 as shown in FIG. 6) by switching the state. The switching mechanism 100 may be drivingly connected with the first connection mechanism 200 or the second connection mechanism 300. In some embodiments, a connection between the first connection mechanism 200 and the switching mechanism 100 may make the fitness equipment drivingly connected with a resistance module (e.g., a resistance module 500 as shown in FIG. 6), and the switching device may be in a first state. A connection between the second connection mechanism 300 and the switching mechanism 100 may make the fitness equipment 600 drivingly connected with the resistance module 500, and the switching device may be in a second state.

In some embodiments, the switching mechanism 100 may be drivingly connected with the first connection mechanism 200 or the second connection mechanism 300 by an operator moves the switching mechanism 100 to be connected with the first connection mechanism 200 or the second connection mechanism 300 manually. In some embodiments, the switching mechanism 100 may be drivingly connected with the first connection mechanism 200 or the second connection mechanism 300 by driving the switching mechanism 100 using an electric device to be connected with the first connection mechanism 200 or the second connection mechanism 300 automatically. The switching mechanism 100 drivingly connected with the first connection mechanism 200 or the second connection mechanism 300 refers to that the switching mechanism 100 is connected with the first connection mechanism 200 or the second connection mechanism 300 via a transmission connection. The transmission connection may include a plurality of feasible forms, such as gear meshing transmission or connecting rod transmission. More descriptions regarding the transmission connection may be found in the present disclosure below.

The fitness equipment may provide a plurality of training modes for training. Different training modes may be related to training resistances provided by the fitness equipment. For example, the plurality of training modes may include a strength training mode and an aerobic training mode. The strength training mode may correspond to a first range of training resistance. The aerobic training mode may correspond to a second range of training resistance. In some embodiments, the maximum resistance of the first range of training resistance may be less than the minimum resistance of the second range of training resistance.

The resistance module may provide training resistance for training, and the resistance module may include a device such as a motor or a power source. In some embodiments, the first state of the switching device may correspond to a strength training mode of the fitness equipment, the resistance module may provide a large resistance, a user may need to resist a relatively large resistance during motion, and a training intensity may be high. The second state of the switching device may correspond to an aerobic training mode of the fitness equipment, the resistance module may provide a small resistance, the user may need to resist a relatively small resistance during motion, and the training intensity may be low. As described herein, the large resistance indicates that the resistance is greater than a first threshold. The small resistance indicates that the resistance is smaller than a second threshold. For the same fitness equipment, the first threshold is greater than or equal to the second threshold. In some embodiments, for different fitness equipment, the first threshold may be different or the same. In some embodiments, for different fitness equipment, the second threshold may be different or the same. In some embodiments, for the same fitness equipment, the first threshold and/or the second threshold may be set according to a user need.

Each of the first connection mechanism 200 and/or the second connection mechanism 300 may include a transmission structure, such as a turbine worm assembly, a gear set, etc. In some embodiments, the first connection mechanism 200 and the second connection mechanism 300 may include different transmission structures. For example, the first connection mechanism 200 may include a turbine worm assembly and the second connection mechanism 300 may include a gear set. In some embodiments, the first connection mechanism 200 and the second connection mechanism 300 may include the same transmission structure. For example, each of the first connection mechanism 200 and the second connection mechanism 300 may include a turbine worm assembly. In some embodiments, the first connection mechanism 200 and the second connection mechanism 300 may include the same transmission structure with different output parameters. For example, the first connection mechanism 200 and the second connecting structure 300 may include the same transmission structure with different output torques and/or speeds. As another example, the first connection mechanism 200 and the second connection mechanism 300 may include turbine worms with different transmission ratios and output torques. As still another example, the first connection mechanism 200 and the second connection mechanism 300 may include gear sets with different transmission ratios and output torques, etc. Different training modes of a fitness equipment may be realized by different structural settings of the first connection mechanism 200 and the second connection mechanism 300. More descriptions regarding the training mode may be found in the present disclosure below.

The switching mechanism 100 may include at least one toggle assembly. Each of the at least one toggle assembly may include a support and a toggle member slidably disposed in the support. The toggle member may be drivingly connected with the first connection mechanism 200 or the second connection mechanism 300 by sliding on the support 110. More descriptions regarding a specific manner in which the toggle member is disposed may be found in the present disclosure below.

In some embodiments, the switching mechanism 100 may include two sets of toggle assemblies symmetrically disposed relative to the X-axis direction.

Figure 3A:
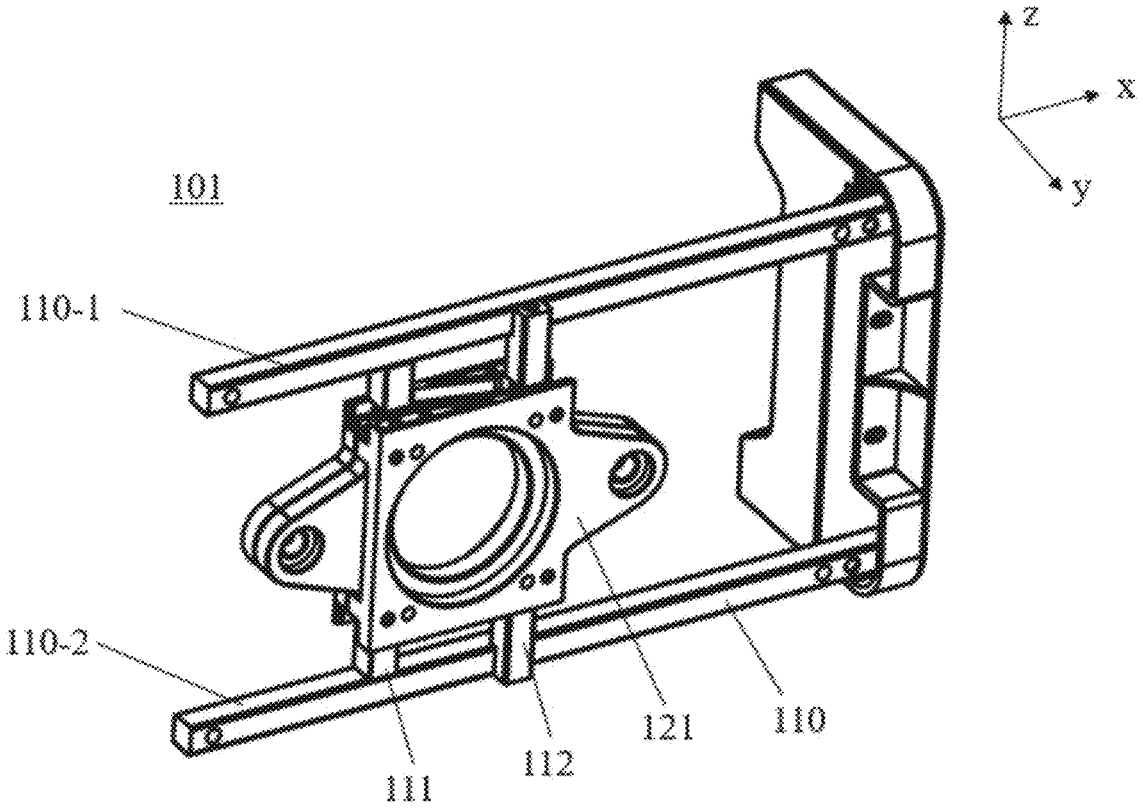
FIG. 3A is a structural diagram illustrating an exemplary toggle assembly according to some embodiments of the present disclosure.
Figure 3B:
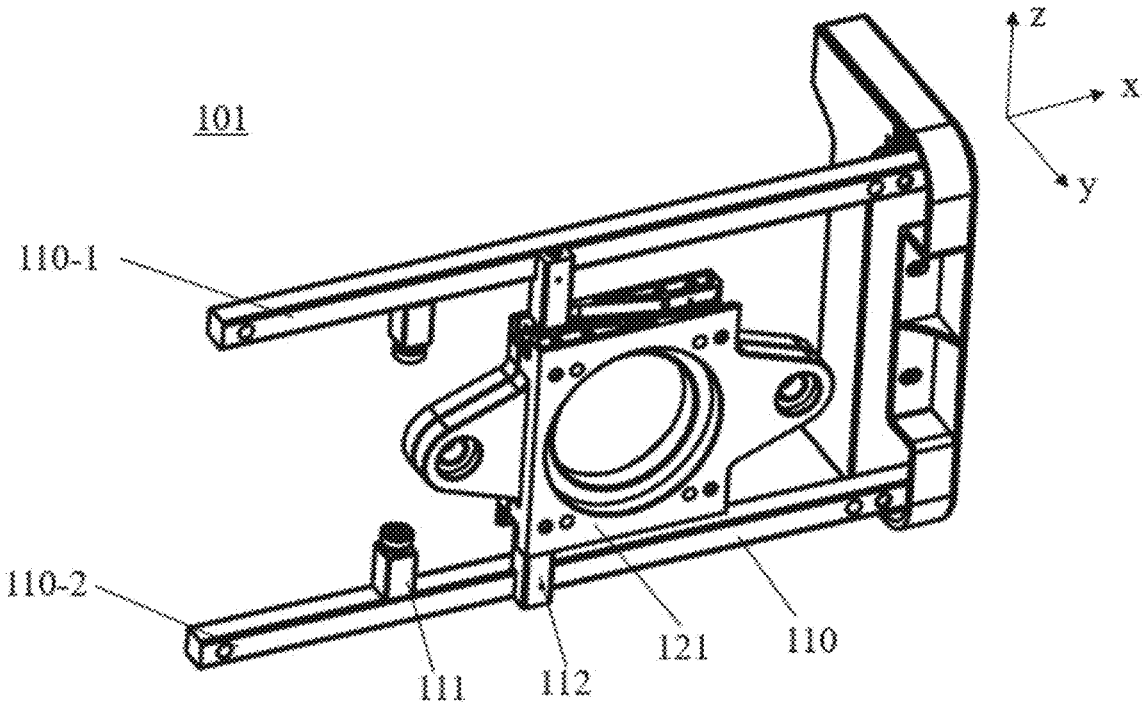
FIG. 3B is structural diagram illustrating an exemplary toggle assembly according to some embodiments of the present disclosure.
Figure 3C:
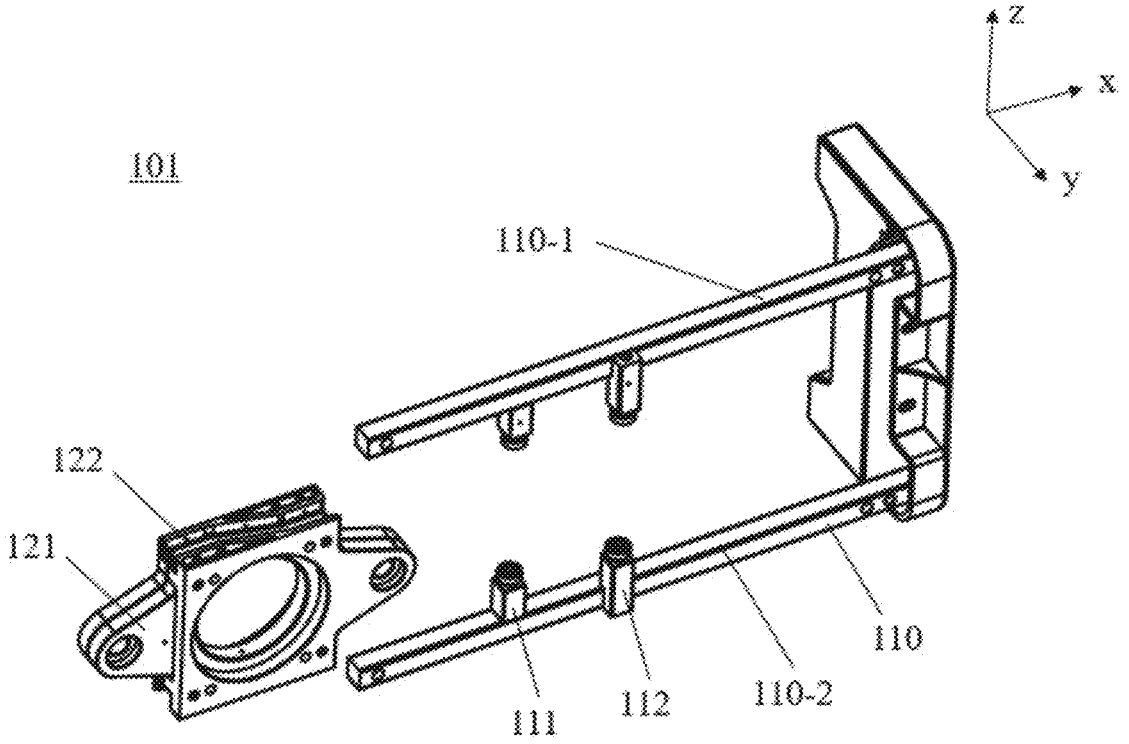
FIG. 3C is an explosion structural diagram illustrating an exemplary toggle assembly according to some embodiments of the present disclosure.

For example, FIGS. 3A-3C are structural diagrams illustrating different states of the switching mechanism according to some embodiments of the present disclosure. Combining FIG. 1A and FIGS. 3A-3C, the switching mechanism 100 may include at least one toggle assembly. Each of the at least one toggle assembly may include a support 110 and a toggle member 120 slidably disposed in the support. The toggle member 120 may be drivingly connected with the first connection mechanism 200 or the second connection mechanism 300 by sliding on the support 110.

Further, the switching mechanism 100 may include a first toggle assembly 101-1 and a second toggle assembly 101-2. The switching mechanism may include a set of first connection mechanisms and a set of second connection mechanisms drivingly connected with the first toggle assembly 101-1, and another set of first connection mechanism and another set of second connection mechanism drivingly connected with the second toggle assembly 101-2.

The support 110 may include one or more positioning shafts. The positioning shaft may be fixedly disposed on the support 110. The positioning shaft may include a rod structure. The rod structure may be in a shape of a cylinder, a rectangular cuboid, etc. In some embodiments, as shown in FIGS. 3A-FIG. 3C, the positioning shaft may include a first positioning shaft 111 and a second positioning shaft 112. The first positioning shaft 111 may be spaced apart from the second positioning shaft 112 in an x-axis direction, and the first positioning shaft 111 and the second positioning shaft 112 may be spaced apart in a y-axis direction. As described herein, being disposed in the x-axis direction indicates that the first positioning shaft 111 and the second positioning shaft 112 are disposed perpendicular to an x-axis, and being disposed in the y-axis direction indicates that the first positioning shaft 111 and the second positioning shaft 112 are disposed perpendicular to a y-axis. In other words, the first positioning shaft 111 and the second positioning shaft 112 may be perpendicular to a plane formed by the x-axis and the y-axis. Spacing distances between the first positioning shaft 111 and the second positioning shaft 112 in the plane formed by the x-axis and the y-axis may be set as needed.

In some embodiments, the first positioning shaft 111 may include a pair of first positioning sub-shafts coaxially disposed in a z-axis direction, and the second positioning shaft 112 may include a pair of second positioning sub-shafts coaxially disposed in the z-axis direction. As described herein, being coaxially disposed in the z-axis direction indicates that the first positioning shaft 111 and the second positioning shaft 112 are disposed parallel to a z-axis.

In some embodiments, as shown in FIGS. 3A-FIG. 3C, the support 110 may include a first crossbar 110-1 and a second crossbar 110-2 parallel to the x-axis, and the first crossbar 110-1 may be spaced apart from the second crossbar 110-2 in the z-axis direction. The two first positioning sub-shafts of the first positioning shaft 111 may be disposed on a lower surface of the first crossbar 110-1 and an upper surface of the second crossbar 110-2, respectively, and the two first positioning sub-shafts may be coaxial in the z-axis direction. The two second positioning sub-shafts of the second positioning shaft 112 may be disposed on side surfaces (e.g., sides facing the outside of the paper in FIG. 3*a*-FIG. 3*c*) of the first crossbar 110-1 and the second crossbar 110-2, respectively, and the two second positioning sub-shafts may be coaxial in the z-axis direction.

In some embodiments, the toggle member 120 may be slidably connected with the first positioning shaft 111 and the second positioning shaft 112. In some embodiments, the toggle member 120 may move in the x-axis direction and the y-axis direction simultaneously when the toggle member 120 slides along at least one of the first positioning shaft 111 and the second positioning shaft 112.

In some embodiments, the toggle member 120 may include a moving sleeve 121 and a connecting member. The toggle member 120 may move relative to at least one positioning shaft (the first positioning shaft 111 and the second positioning shaft 112) through the moving sleeve 121, and the toggle member 120 may be connected with the first connection mechanism 200 or the second connection mechanism 300 through the connecting member. In some embodiments, the toggle member 120 may only include the moving sleeve 121 and not include the connecting member. The moving sleeve 121 may have a connection function of the connecting member, i.e., the toggle member 120 may be connected with the first connection mechanism 200 or the second connection mechanism 300 through the moving sleeve 121 when the toggle member 120 moves relative to the at least one positioning shaft through the moving sleeve 121.

In some embodiments, the moving sleeve 121 may be provided with a Z-groove 122. The first positioning shaft 111 and the second positioning shaft 112 may be able to slide in the Z groove 122. The Z-groove 122 may have a guiding effect with respect to the first positioning shaft 111 and the second positioning shaft 112. For example, the first positioning shaft 111 and the second positioning shaft 112 may be respectively provided with protrusions that match the Z-groove 122 and are embedded in the Z-groove 122, so that when the moving sleeve 121 moves, the protrusions may move in the Z-groove 122 relative to the Z-groove 122.

In some embodiments, the Z-groove 122 may be in any other feasible shape as long as two ends of the groove are spaced apart in the y-axis direction. For example, the Z-groove 122 may be diagonal. As another example, the Z-groove 122 may include a flat straight line segment portion and a diagonal line segment portion that are parallel to the x-axis direction.

In some embodiments, the Z-groove 122 may include a first straight line segment, a diagonal segment, and a second straight line segment. The first straight line segment and the second straight line segment may be respectively parallel to the x-axis direction, and the first straight line segment and the second straight line segment may be spaced apart in the y-axis direction (i.e., positions of the first straight line segment and the second straight line segment may be in the y-axis direction). The diagonal segment connects the first straight line segment and the second straight line segment. When the toggle member 120 is moved in the x-direction, the Z-groove 122 may slide with respect to the at least one of the first positioning shaft 111 and the second positioning shaft 112. When sliding from the first straight line segment to the second linear segment of the Z-groove 122 (or when sliding from the second linear segment to the first linear segment), the toggle member 120 may move in the y-axis direction under the action of the at least one positioning shaft (e.g., the first positioning shaft 111 and the second positioning shaft 112) in a relatively fixed position cooperating with the Z-groove 122 simultaneously.

In some embodiments, as shown in FIG. 3A, when the toggle member 120 is moved until both the first positioning shaft 111 and the second positioning shaft 112 are located in the Z-groove 122, the connecting member may be drivingly connected with the first connection mechanism 200, and the switching mechanism may be in the first state.

In some embodiments, as shown in FIG. 3B, when the toggle member 120 is moved until when only the second positioning shaft 112 is located in the Z-groove 122, the connecting member may be drivingly connected with the second connection mechanism 300, and the switching mechanism may be in the second state.

In some embodiments, the connecting member being drivingly connected with the first connection mechanism 200 or the second connection mechanism 300 may be a connection in the y-axis direction, i.e., a power transmission may be achieved in the y-axis direction. For example, as shown in FIGS. 1A-FIG. 1C, the connecting member and the first connection mechanism 200 or the second connection mechanism 300 may achieve a tooth meshing connection in the y-axis direction, thereby carrying out the power transmission. More descriptions regarding the connection member being drivingly connected with the first connection mechanism 200 or the second connection mechanism 300 may be found in the present disclosure elsewhere in the present disclosure. The power transmission in the y-axis direction may be realized by applying only a force in the x-axis direction to the toggle member 120 when the toggle member 120 is moved. Therefore, a direction (e.g., x-axis direction) in which the toggle member 120 is moved for state switching may be different from a direction (e.g., y-axis direction) of the transmission connection. The direction (e.g., x-axis direction) in which the toggle member 120 switches states is different from the direction (e.g., y-axis direction) in which the power transmission is connected, so that the two directions may not affect each other, and the connection may be more stable and the power transmission effect may be better.

In some embodiments, the switching mechanism 100 may include a plurality of toggle assemblies, and the toggle members of the plurality of toggle assemblies 101 may be moved synchronously. For example, the toggle member 120 of the first toggle assembly 101-1 and the toggle member 120 of the second toggle assembly 101-2, as shown in FIG. 1B, may be connected through a connecting rod 125 to ensure that the two toggle members 120 move synchronously to increase the stability of the entire device.

In some embodiments of the present disclosure, the toggle member may skillfully realize the simultaneous movement in both the x-axis and the y-axis directions, and the switching mechanism may switch between two states accordingly by converting the user's operation of the x-axis direction of the toggle member into the movement of the toggle member in the y-axis direction, and the transmission may be stable.

In some embodiments, the support 110 may include a guiding structure, such as a guiding groove. The toggle member 120 may be provided with a guiding member (e.g., an embedded protrusion) that matches the guiding structure, and the embedded protrusion of the toggle member 120 may be moved along the guiding groove.

In some embodiments, the switching mechanism may include a positioning structure. The positioning structure may include a positioning post. The positioning post may extend in a movement direction of the toggle member 120 when the positioning post moves to a set position (e.g., when the toggle member 120 is drivingly connected with the first connection mechanism 200 or the second connection mechanism 300) to block the movement of the toggle member 120, thereby limiting the toggle member 120, so that the toggle member 120 may be drivingly connected with the first connection mechanism 200 or the second connection mechanism 300 stably.

In some embodiments, the positioning post may be connected with a micro motor. The positioning post may be controlled to stretch out and draw back by the micro motor. In some embodiments, the toggle member 120 may include two separate portions. One portion of the toggle member 120 may be moved to be drivingly connected with the first connection mechanism 200, and another portion of the toggle member 120 may be moved to be drivingly connected with the second connection mechanism 300. The switching mechanism 100 may be drivingly connected with the first connection mechanism 200 or the second connection mechanism 300 by respectively controlling the two portions to move.

In some embodiments, the switching mechanism 100 may have any other feasible structure as long as the switching mechanism 100 may be drivingly connected with the first connection mechanism 200 or the second connection mechanism 300.

Figure 5:
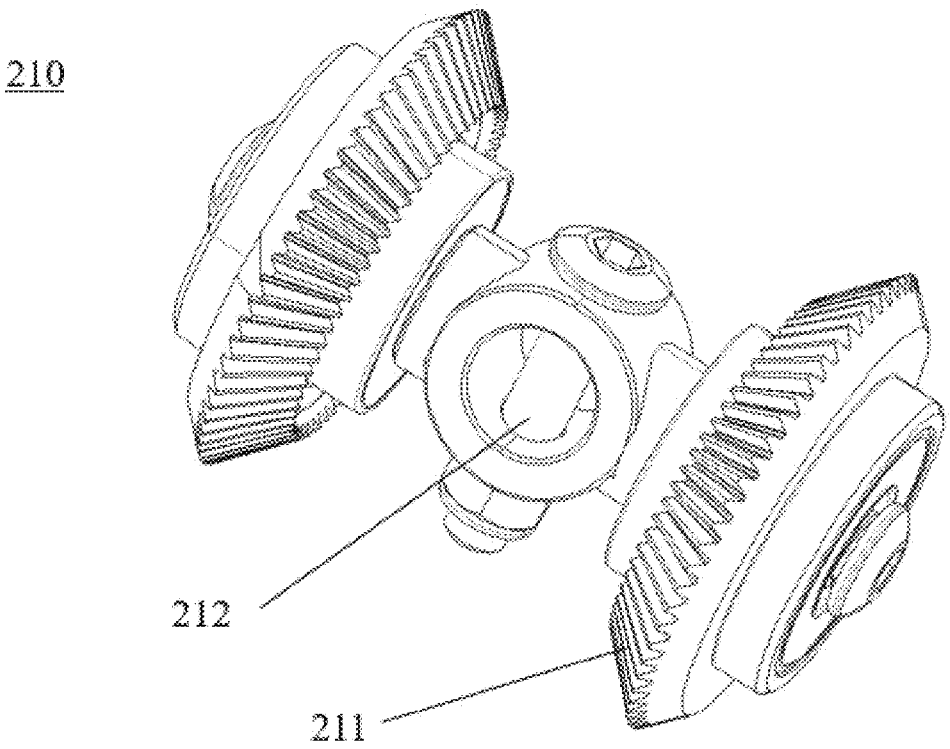
FIG. 5 is a structural diagram illustrating an exemplary central gear assembly of a first connection mechanism according to some embodiments of the present disclosure.

FIG. 4 is a diagram illustrating an exemplary partial structure of FIG. 1C according to some embodiments of the present disclosure. FIG. 5 is a structural diagram illustrating an exemplary central gear assembly of the first connection mechanism according to some embodiments of the present disclosure.

In some embodiments, as shown in FIGS. 1A-FIG. 5, the first connection mechanism 200 may include a central gear assembly 210 and a bevel gear 220. The central gear assembly 210 may include a fixed gear 211. The switching device may be in the first state by the toggle member 120 sliding towards a first position for driving, through the connecting member, the bevel gear 220 to mesh with the fixed gear 211.

In some embodiments, as shown in FIG. 5, the central gear assembly 210 may further include a central positioning pin 212. The fitness equipment may include a pull wheel assembly 460 and a transmission shaft 470. The central gear assembly 210 may be fixed to the transmission shaft 470 through the central positioning pin 212, and a rotating shaft of the fixed gear 211 may be perpendicular to an axis (y-axis direction) of the transmission shaft 470. The transmission shaft 470 may be configured to connect the resistance module 500 to provide resistance for the fitness equipment.

In some embodiments, as shown in FIG. 4, the bevel gear 220 may be disposed on a side of the toggle member 120 close to the pull wheel assembly 460, and the bevel gear 220 may be connected with the pull wheel assembly 460. When the toggle member 120 is moved in a negative direction of the y-axis, the connecting member of the toggle member 120 may drive the bevel gear 220 to move in the negative direction of the y-axis. In some embodiments, the connecting member of the toggle member 120 may be any feasible structure, or the toggle member 120 may not have the connecting member as long as the toggle member 120 may drive the bevel gear 220 to move in the negative direction of the y-axis.

In some embodiments, as shown in FIG. 3A and FIG. 4, the first position refers to that the toggle member 120 is located in a maximum position in the negative direction of the y-axis. At this time, the first positioning shaft 111 and the second positioning shaft 112 may be both located in the Z-groove 122, the bevel gear 220 may mesh with the fixed gear 211, and the switching device may be in the first state.

For example, as shown in FIG. 2, the fitness equipment may be a strength training station. The fitness equipment may include a pull rope 440 and an elastic rope 350, and a user may train by pulling the pull rope 440. When the user pulls the pull rope 440 and the elastic rope 450, the pull wheel assembly 460 may be driven to rotate, the pull wheel assembly 460 may rotate to drive the central gear assembly 210 to rotate, and the resistance module 500 may provide resistance (i.e., a force in an opposite direction of a force exerted by the user) for the central gear assembly 210 through the transmission shaft 470. When the user releases the force exerted on the pull rope 440, at this time, the resistance module 500 may also provide resistance to the transmission shaft 470 and the pull wheel assembly 460, and the pulled pull rope 440 may be rewound around the pull wheel assembly 460, and the elastic rope 450 may follow the pull wheel assembly 460 back into position at the same time. The bevel gear 220 meshes with the central gear assembly 210, so that torque may be transmitted in both forward and reverse directions, the pulling out and recovery of the pull rope may be subject to the resistance provided by the resistance module 500, and the fitness equipment may be in a high-resistance and high-intensity strength training mode (i.e., a first mode).

In some embodiments, as shown in FIG. 4, the second connection mechanism 300 may include a unidirectional wheelset 310, and the unidirectional wheelset 310 may include a unidirectional gear 311. In some embodiments, the switching device may be in the second state by the toggle member 120 sliding toward a second position for driving, through the connecting member to mesh with the unidirectional gear 311. The pull wheel assembly 460 may be connected with the unidirectional wheelset 310. In some embodiments, the unidirectional gear 311 may unidirectionally mesh with the transmission shaft 470. When the transmission shaft 470 rotates positively, the unidirectional wheelset 310 may rotate with the transmission shaft 470.

When the transmission shaft 470 rotates in reverse, the unidirectional gear 311 may no longer mesh with the unidirectional gear 311, and the unidirectional gear 311 may rotate freely without transmitting torque. In some embodiments, the unidirectional wheelset 310 may be a gear set with unidirectional teeth on an end face.

In some embodiments, as shown in FIG. 3B and FIG. 4, the second position refers to that the toggle member 120 is located at a maximum position in a positive direction of the y-axis. At this time, only the second positioning shaft 112 may be located in the Z-groove 122, and the unidirectional gear 311 may mesh with the connecting member. In some embodiments, the connecting member may include inner teeth 123. When the toggle member 120 moves in the positive direction of the y-axis, the inner teeth 123 may be driven to move in the positive direction of the y-axis until the inner teeth 123 meshes with the unidirectional gear 311. At this time, the central gear assembly 210 and the bevel gear 220 may be in a state of separation. When the user pulls the pull rope 440 and the elastic rope 450, the pull wheel assembly 460 may be driven to rotate, the pull wheel assembly 460 may rotate to drive the unidirectional wheelset 310 to rotate, the unidirectional wheelset 310 may transmit the torque, and the user may be subjected to the resistance provided by the resistance module 500 when pulling out the pull rope 440. When the user releases the force exerted on the pull rope 440, at this time, a rebound force of the elastic rope 350 may drive the pull wheel assembly 460 to reverse, and the pull rope 440 pulled out may be rewound around the pull wheel assembly 460. Because the unidirectional wheel assembly 310 reverses without transmitting the torque, the resistance module 500 may not provide the resistance. In this case, the pull rope 440 may bear the resistance when pulled out and bear no resistance when recovered, and the fitness equipment 600 may be in a low-resistance and low-intensity aerobic training mode (i.e., a second mode).

In some embodiments of the present disclosure, two connection modes of connecting the pull wheel assembly to the central gear assembly and connecting the pull wheel assembly to the unidirectional wheelset may be switched, respectively, through the toggle assembly, so that the fitness equipment may be switched between the strength training mode and the aerobic training mode through the switching device, and the user may easily access the training modes through the single equipment.

FIG. 6 is a structural diagram illustrating an exemplary fitness equipment according to some embodiments of the present disclosure.

In some embodiments, if a switching device is in a first state, the fitness equipment 600 may be in a first mode. if the switching device is in a second state, the fitness equipment 600 may be in a second mode. Exemplarily, as shown in FIG. 6, the fitness equipment 600 may be a strength training station, and the first mode may correspond to a strength training mode and the second mode may correspond to an aerobic training mode. More descriptions regarding the states of the switching device and the modes of the fitness equipment 600 may be found in the present disclosure above, which is not repeated herein.

In some embodiments, as shown in FIG. 6, the fitness equipment 600 may further include a resistance module 500 and a pull wheel assembly (e.g., the pull wheel assembly 460 as shown in FIG. 4). When the switching device is in the first state, the resistance module 500 may be drivingly connected with the pull wheel assembly 460 through the first connection mechanism 200. When the switching device is in a second state, the resistance module 500 may be drivingly connected with the pull wheel assembly 460 through the second connection mechanism 300. In some embodiments, the resistance module 500 may include an output shaft, and the output shaft of the resistance module 500 may be connected with the transmission shaft 470 (see FIG. 4) to transmit resistance to the fitness equipment 600. More descriptions regarding the resistance module 500 being drivingly connected with the pull wheel assembly 460 may be found in the present disclosure above, which is not repeated herein.

In some embodiments, referring to FIG. 2, the fitness equipment 600 may further include a first housing 420, a second housing 430, the pull rope 440, and the elastic rope 450. The first housing 420 and the second housing 430 may be configured to mount a component of the fitness equipment 600. The support 110 of the toggle assembly 101 may be mounted in the first housing 420 through a mounting member 410. The toggle assembly 101 may be connected with an operating member. The operating member may be removably disposed outside the first housing 420 for ease of operation of a user.

In some embodiments, referring to FIG. 6, the fitness equipment 600 may further include a stand column 910.

The stand column 910 refers to a support structure disposed along a vertical direction (e.g., a Z-direction in FIG. 6), and may be configured to provide support and a movement space for at least a portion of the pull rope 440 and at least a portion of the elastic rope 450.

In some embodiments, an extension arm 920 may be provided on the stand column 910. The extension arm 920 may be configured to provide support for the at least a portion of the pull rope 440 and the at least a portion of the elastic rope 450, and may be configured to change a movement direction of the pull rope 440 and the elastic rope 450. The stand column 910 and the extension arm 920 may surround to form an exercise space, such that when the user pulls the pull rope 440 and/or the elastic rope 450, the structure such as the stand column 910 and the resistance module 500 can be avoided.

In some embodiments, the first housing 420 may be disposed at a bottom of the stand column 910. In some embodiments, at least a portion of the bottom of the stand column 910 may be disposed inside the first housing 420. In some embodiments, the stand column 910 and the first housing 420 may be connected in various ways, such as at least one of a clamping connection, a welding connection, a threaded connection, etc.

In some embodiments, the first connection mechanism 200 and the pull wheel assembly 460 may be disposed in the first housing 420. In some embodiments, the first connection mechanism 200 and the pull wheel assembly 460 may be located below the stand column 910.

In some embodiments, the mounting member 410 may penetrate through the first housing 420 to be connected with the stand column 910.

More descriptions regarding the pull rope 440 and the elastic rope 450 may be found in the present disclosure above. More descriptions regarding the stand column 910 and the extension arm 920 may be found in the present disclosure below.

In some embodiments, a fitness device may further include a physiological monitoring device, a motion monitoring device, and a controller. The controller may be configured to control mode switching of the training modes of the fitness equipment by controlling state switching of the switching device.

The physiological monitoring device refers to a device configured to monitor physiological monitoring data (e.g., heart rate, blood pressure, blood oxygen) of the user. The physiological monitoring device may be disposed at a position where the user is in contact with the fitness equipment 600. The motion monitoring device refers to a device configured to obtain motion data (e.g., a tensile force, a speed, or a count of times) of the user. For example, the motion monitoring device may include a displacement sensor, a speed sensor, and a tension sensor mounted on the pull rope or the elastic rope for monitoring the motion and tensile force of the pull rope. The sensors may determine a complete rope-pulling action by measuring changes of the speed, displacement, or tensile force of the rope-pulling motion, thereby counting the count of times the rope is pulled.

In some embodiments, the switching device may further include a drive motor. The drive motor may be connected with the switching mechanism 100, for example, the drive motor may be connected with the toggle member 120, so as to control the state switching of the switching device.

Some embodiments of the present disclosure further provide a method for switching a training mode, which may be applied to the above fitness device. The switching method may include extracting a motion feature of the user based on the motion data obtained by the motion monitoring device; determining a motion state of the user based on the physiological monitoring data obtained by the physiological monitoring device and the motion feature; and determining whether to switch the training mode of the fitness equipment 600 of the fitness device based on the motion state.

In some embodiments, the motion data may include a sequence of tensile force/speed during training. The motion feature may include a sequence including a frequency of a target behavior per unit of time, the time consumption of the target behavior, and the stability degree of the target behavior. The target behavior refers to a preset target exercise behavior, and the target behavior may be related to a type of fitness equipment 600. For example, if for the fitness equipment 600, training of different postures or actions may be completed by pulling the rope, the target behavior may be pulling the rope without distinguishing the specific action of pulling the rope. The controller may extract a count of cycles of the tensile force/speed change per unit time based on the tensile force/speed sequence during the training, and determine the count of cycles as the frequency of the target behavior per unit of time. For example, the frequency of the target behavior per unit time may be a count of times the rope is pulled in 1 minute. The time consumption of the target behavior refers to the time it takes the user to complete the last complete target behavior. The consumption time of the target behavior may be obtained by querying history. The stability degree of the target behavior may be used to characterize the stability degree of the strength or speed of the user during training. The stability degree of the target behavior may be obtained through statistical analysis. For example, the stability degree of the tensile force of the target behavior refers to a standard deviation of a plurality of tensile force values when the target behavior is completed.

In some embodiments, the motion state of the user may be expressed as a motion degree. In some embodiments, the more tired the user is, the smaller the value of the motion degree may be. In some embodiments, the controller may determine the motion degree. The controller may calculate a first similarity degree by comparing the physiological monitoring data with reference physiological data, and calculate a second similarity degree by comparing the motion feature with a reference motion feature. The current motion degree of the user is equal to (a×first similarity degree+b×second similarity degree), where a and b are preset weights.

In some embodiments, the reference physiological data may be obtained by obtaining the physiological monitoring data of the user during a time period T1~T2 in which a plurality of consecutive target behaviors are completed and taking an average value of each indicator of the physiological monitoring data of the user between T1 and T2 as a value of each indicator of the reference physiological data. In some embodiments, the reference motion feature may be obtained by: obtaining the motion data of the user during the time period T1~T2 in which the plurality of consecutive target behaviors are completed, extracting the motion feature, and taking an average value of each indicator of the motion feature of the user between T1 and T2 as a value of each indicator of the reference motion feature. For example, if the motion feature is the time consumption of the target behavior, and after a preset time from the start of the training, a time consumed to complete the plurality of consecutive target behaviors may be obtained and an average value of time consumption of each target behavior may be calculated, and the average value of time consumption may be used as the reference motion feature.

In some embodiments, the controller may determine whether to switch the training mode of the fitness equipment 600 based on the motion degree. For example, in the strength training mode, when the motion degree of the user is smaller than a first threshold, the strength training mode may be switched to the aerobic training mode. In the aerobic training mode, when the motion degree of the user is greater than a second threshold, the aerobic training mode may be switched to the strength training mode. The first threshold may be smaller than the second threshold. When the value of the current motion degree of the user in the strength training mode is lower, it may indicate that the user may be in a state of fatigue, and at this time, the resistance may need to be reduced and appropriate relaxation may need to be carried out. Therefore, the strength training mode may be switched to the aerobic training mode. At the same time, when the current motion degree of the user is relatively easy for the user in the aerobic training mode, the motion degree may be appropriately enhanced, and the aerobic training mode may be switched to the strength training mode. The first threshold and the second threshold may be values manually set based on experience.

In some embodiments, the user may set a switching time between the two modes voluntarily. The switching time may be directly determined based on a training goal input by the user according to a preset relationship. The training goal input by the user may be set in advance in the system and selected by the user, such as muscle gain or weight loss; or the training goal may be a specific goal value input by the user, such as a motion duration or a muscle gain weight. The preset relationship may be a correspondence between the training goal and the motion mode and motion time set in advance in the system. In some embodiments, the user may preset a switching frequency of the strength training mode and the aerobic training mode. In some embodiments, the user may input via software communicatively connected with the fitness equipment 600. In some embodiments, the user may achieve mode switching via a button, an interactive screen, or a voice acquisition system of the fitness equipment 600.

In some embodiments, the controller may adjust the resistance module of the fitness equipment 600 in response to the motion state not meeting a preset condition. The adjusting the resistance of the resistance module may be to increase the resistance or to decrease the resistance. In some embodiments, the adjustment of the resistance of the resistance module may be related to mode switching. For example, the resistance may be increased in the aerobic training mode, and the resistance may be further increased in the strength training mode when the aerobic training mode is switched to the strength training mode.

In some embodiments, in the strength training mode, after the strength training mode is conducted for a preset time period, and if the preset condition is that the first threshold<the motion degree of the user<a third threshold, and the controller controls the resistance module to decrease the resistance, it may indicates that the mode switching condition has not been reached, but the user is still relatively tired, and the resistance may need to be decreased; or if the preset condition is that the motion degree of the user>the third threshold, and the controller controls the resistance module to increase the resistance, it may indicate that the mode switching condition has not been reached, and the user is in a relatively relaxed state, and thus the resistance may need to be increased.

In some embodiments, in the aerobic training mode, after the aerobic training mode is conducted for the preset time period, and if the preset condition is that a fourth threshold<an ease degree of motion of the user<the second threshold, and the controller controls the resistance module to increase the resistance, it may indicates that the mode switching condition has not been reached and the user is in a relatively easy state, and thus the resistance may need to be increased; or if the preset condition is that 0<the ease degree of motion of the user<the fourth threshold, and the controller controls the resistance module to decrease the resistance, it may indicate that the user is a little bit tired, and thus the resistance may need to be decreased. A relationship may be that the first threshold<the second threshold<the third threshold<the fourth threshold. The third threshold and the fourth threshold may be values manually set based on experience. The adjustment of the resistance of the resistance module may be obtained by a preset correspondence between the motion degree of the user and an amount of resistance adjustment. The correspondence may be set manually based on experience.

In some embodiments of the present disclosure, the mode may be switched and the resistance of the resistance module may be changed through the training intensity of the user, which may make the current motion intensity of the fitness equipment 600 suitable for the current state of the user to satisfy an exercise need of a customer and prevent the user from being in a excessive fatigue state, thereby reducing the risk of injury to the user and improving the exercise experience of the user.

Figure 7:
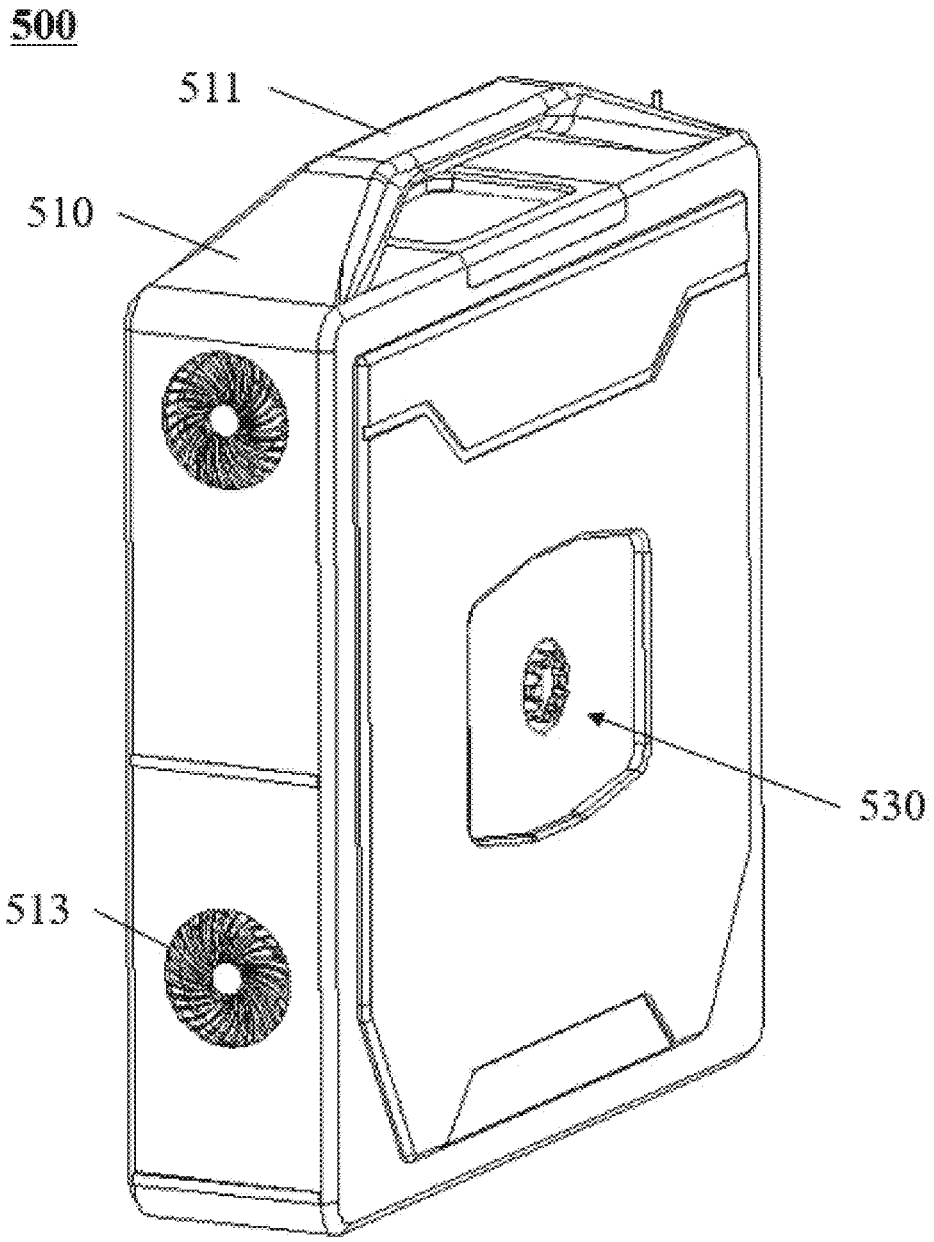
FIG. 7 is a structural diagram illustrating an exemplary resistance module according to some embodiments of the present disclosure.
Figure 8:
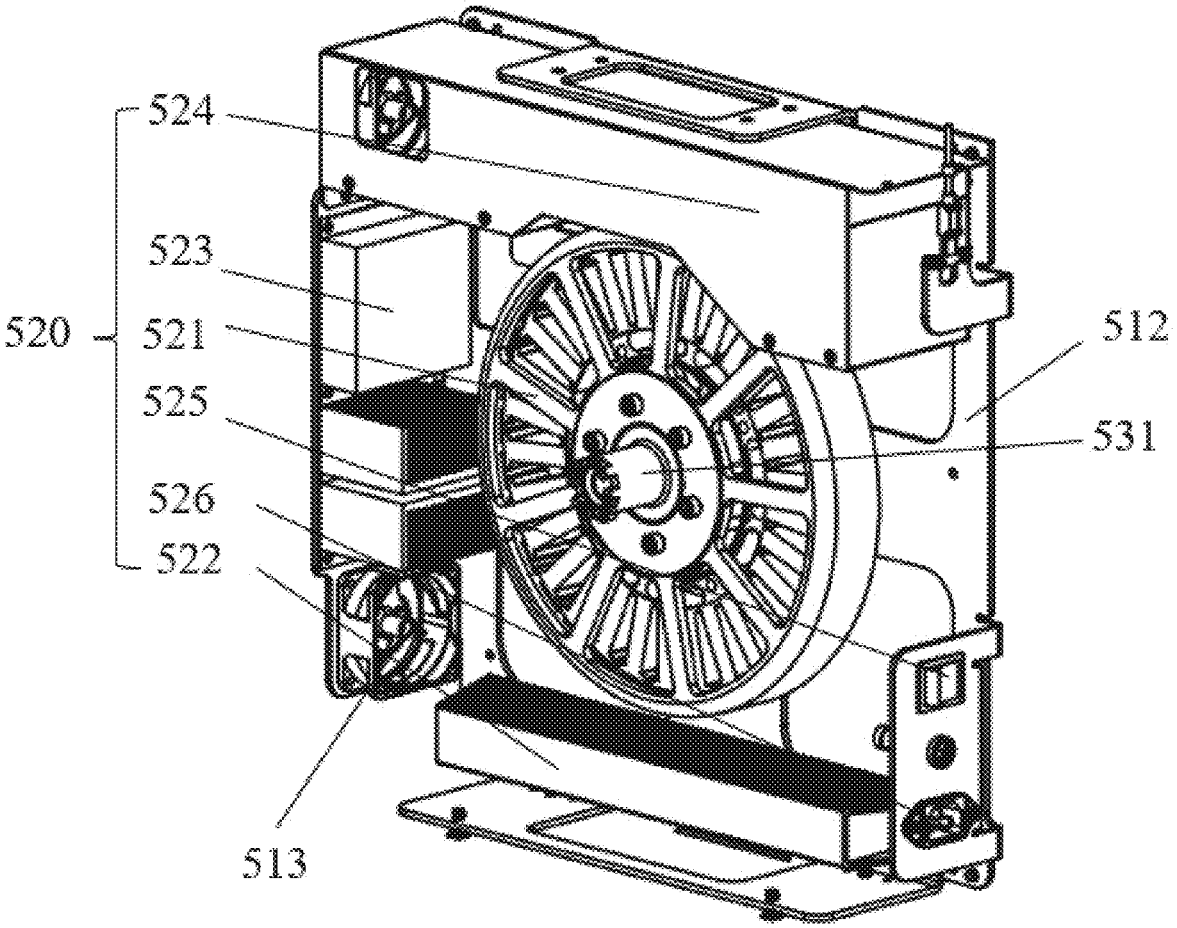
FIG. 8 is a diagram illustrating an exemplary internal structure of a resistance module according to some embodiments of the present disclosure.
Figure 9:
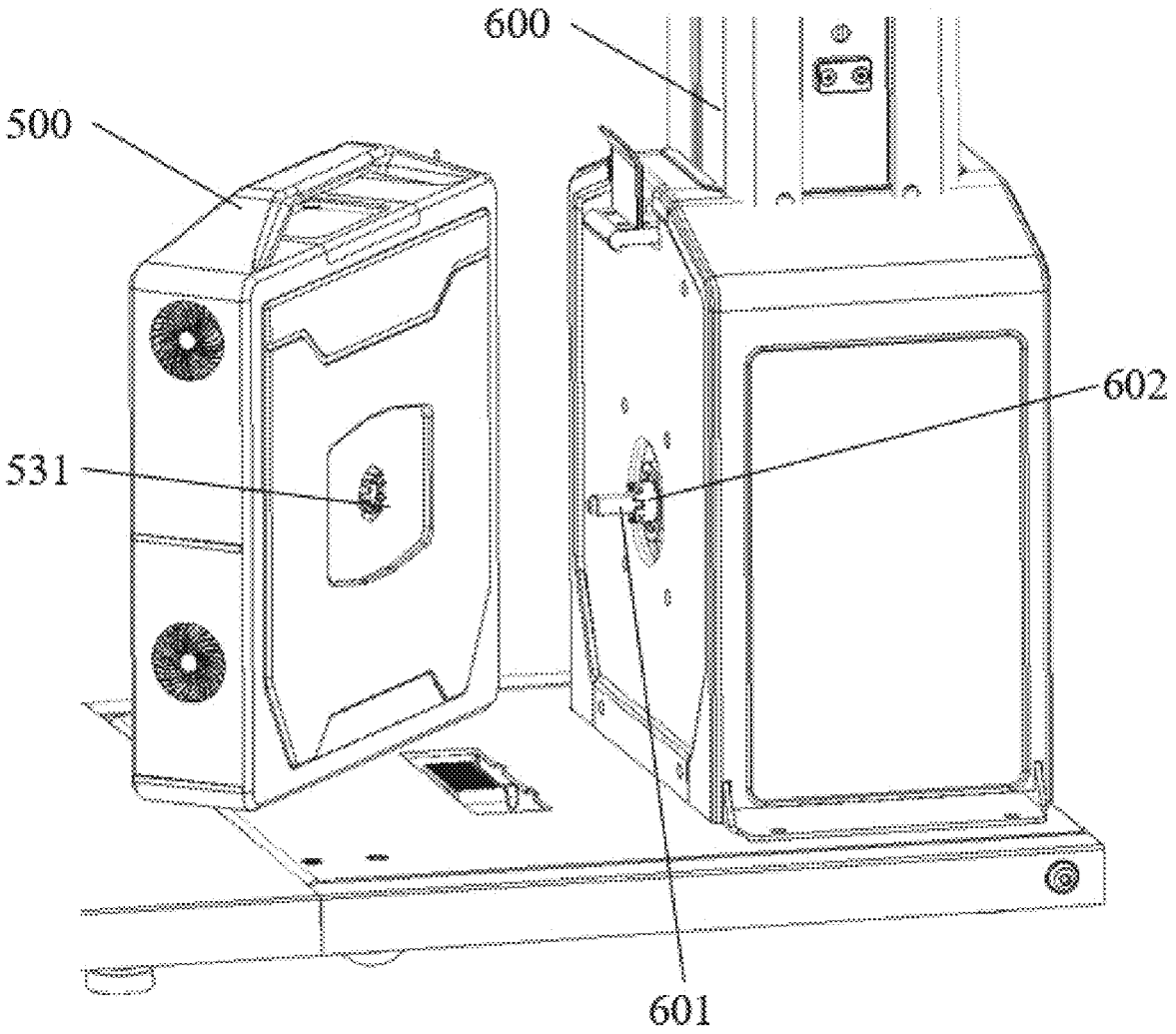
FIG. 9 is a diagram illustrating an exemplary partial structure of a resistance module and fitness device according to some embodiments of the present disclosure.

FIG. 7 is a structural diagram illustrating an exemplary resistance module according to some embodiments of the present disclosure. FIG. 8 is a diagram illustrating an exemplary internal structure of a resistance module according to some embodiments of the present disclosure. FIG. 9 is a diagram illustrating an exemplary partial structure of a resistance module and a fitness equipment according to some embodiments of the present disclosure.

In some embodiments, as shown in FIGS. 7-FIG. 9, the resistance module 500 may include a housing 510, a power device 520, and a transmission mechanism 530. In some embodiments, the transmission mechanism 530 may include a connecting shaft 531. The connecting shaft 531 may be configured to be drivingly connected with different fitness equipment. The power device 520 may provide resistance to the fitness equipment through the connecting shaft 531. In some embodiments, the fitness equipment may include a strength training station, a rowing machine, a ski machine, etc.

The housing 510 refers to a housing of the resistance module 500, and the housing 510 may provide support for other components of the resistance module 500 and protect an internal component of the resistance module 500. The material of the housing 510 may be metal, plastic, or other material that is strong enough to support the internal component of the resistance module 500.

In some embodiments, a handle 511 may be disposed of outside the housing 510, and a fixed plate 512 may be disposed of inside the housing 510. The handle 511 may be configured to facilitate a user to lift the resistance module 500 to mount the resistance module 500 on the different fitness equipment. The fixed plate 512 may be configured to mount the one or more internal components of the resistance module 600. In some embodiments, the power device 520 and the transmission mechanism 530 may be mounted on the fixed plate 512. A cooling fan 513 may be disposed on the fixed plate 512. The cooling fan 513 may be configured to dissipate heat from the resistance module 500.

The power device 520 refers to a device that may provide mechanical or electrical energy for the resistance module 500. In some embodiments, the power device 520 may include a motor assembly 521, a resistor 522, and a controller 523. The motor assembly 521 may be configured to provide resistance to the fitness equipment 600.

In some embodiments, the motor assembly 521 may include a motor stator, a magnet, a motor rotor, an encoder, etc. The resistor 522 may be configured to regulate an output of the motor assembly 521, and a magnitude of the output may correspond to a magnitude of the resistance provided by the resistance module 500 for the fitness equipment 600. In some embodiments, the resistor 522 may include a metal resistor, a cement resistor, or the like, or any combination thereof. The controller 523 may control a parameter (e.g., the output or a speed) of the motor assembly 521 to control the resistance provided for the fitness equipment 600. The controller 523 may be configured to process data from at least one component of resistance module 500 or an external data source. In some embodiments, the controller 523 may include a central processing unit (CPU), an application specific integrated circuit (ASIC), or the like, or any combination thereof.

In some embodiments, the power device 520 may further include a power source. A type of power source may include a plug-in power source or a battery. The battery may include a rechargeable battery 524. The plug-in power source may include a power switch 525 and a power port 526. The power port 526 may be connected with an external power source via a power cord. The power switch 525 may be configured to turn on and turn off the motor assembly 521.

The transmission mechanism 530 refers to a mechanism that transfers power of the power device 520 to the fitness equipment 600. In some embodiments, the transmission mechanism 530 may include a positioning shaft 601. In some embodiments, the connecting shaft 531 may be concentric with a rotating shaft of a gantry of the fitness equipment 600 through the positioning shaft 601. An end of the positioning shaft 601 may be provided with shaft teeth, and an end of the connecting shaft 531 may be provided with shaft teeth that match the shaft teeth of the positioning shaft 601, so that the positioning shaft 601 may mesh with the connecting shaft 531 via teeth.

In some embodiments, as shown in FIG. 9, the connecting shaft 531 may include a shaft sleeve for inserting the positioning shaft 601. The end of the connecting shaft 531 may be provided with the shaft teeth, and an outer side of the positioning shaft 601 may be provided with a shaft teeth sleeve 602 that matches the connecting shaft 531, so that the positioning shaft 601 may mesh with the connecting shaft 531 via the shaft tooth sleeve 602 meshing with the shaft teeth of the connecting shaft 531 after the positioning shaft 601 is inserted into the connecting shaft 531. In some embodiments, the positioning shaft 601 may be a component fixedly disposed on the gantry of the fitness equipment 600.

In some embodiments of the present disclosure, the transmission mechanism may be disposed so that the resistance module may be activated after being connected with the fitness equipment through the connecting shaft. The rotating shaft of the gantry of the fitness equipment may move synchronously with the connecting shaft, so as to provide resistance for fitness training of the user.

For the resistance module provided by some embodiments of the present disclosure, a function such as power provision and resistance adjustment may be integrated into a resistance module. The resistance module may be connected with the different fitness equipment through the connecting shaft and the connecting shaft may be further concentric with the rotating shaft of the gantry of the fitness equipment through the positioning shaft, so as to better provide resistance for the different fitness equipment. For example, the resistance module may be connected with different gantries such as a rowing machine, a ski machine, and an integrated strength training station, etc., which may provide power to the user by replacing a traditional system such as a traditional wind damping, water damping, magnetic damping, or weight counterweight. The user may adjust the training intensity and resistance as needed, thereby making training more flexible and personalized. The resistance module may be connected with various different fitness equipment, which may also save the user costs. The various fitness equipment may be obtained when only one resistance module is connected with the gantries of the various fitness equipment, which can greatly reduce the user costs.

At the same time, the handle of the resistance module is convenient to lift and push, and the power source of the resistance module may be the rechargeable battery, which is convenient to replace with different equipment. The cooling fan, the resistor, and the controller of the resistance module may provide good support for the performance of the resistance module. The shaft tooth meshing and positioning shaft positioning of the resistance module ensure a good transmission connection between the resistance module and the fitness equipment, so that the resistance module may be applied to the various different fitness equipment.

In some embodiments, the resistance module 500 may further include a taper structure. The taper structure may be disposed outside the connecting shaft 531. In some embodiments, the taper structure may match with a mating structure disposed on the fitness equipment 600 to make the connecting shaft 531 concentric with the rotating shaft of the gantry of the fitness equipment 600. The taper structure may be configured to further assist in aligning the connecting shaft 531 with the rotating shaft. In the process of alignment of the resistance module 500 with the fitness equipment 600, the taper structure and the mating structure may cooperate to guide the connecting shaft 531 of the resistance module 500 and the rotating shaft of the fitness equipment 600 to be concentric, which may improve the ease of alignment.

In some embodiments, an easy-to-observe place (e.g., top or side) of the taper structure may be provided with a through groove. The user may observe the meshing situation through the through groove. The material of the taper structure may be transparent plastic for easy observation of the user. In some embodiments, the taper structure may be also provided with a scale for indicating a meshing distance of the taper structure to indicate whether a meshing depth is satisfied. The meshing distance refers to a relative distance between two portions of the taper structure meshing with each other. If the scale reaches a preset position, it may be considered that the meshing depth is satisfied. The scale may be disposed at a position of the through groove, so that the user may observe the meshing and observe the meshing distance at the same time, thereby further improving the ease of observation of the user.

Figure 10A:
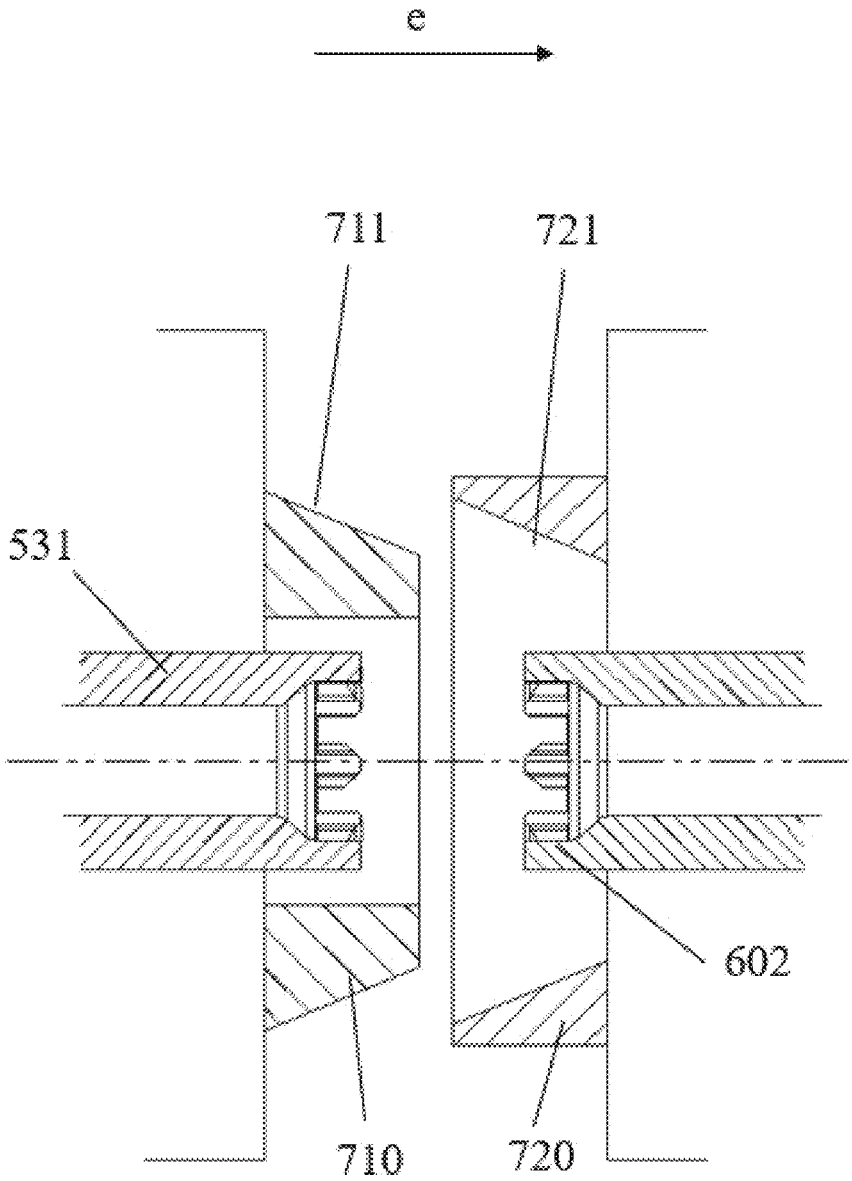
FIG. 10A is a structural diagram illustrating an exemplary taper structure according to some embodiments of the present disclosure.
Figure 10B:
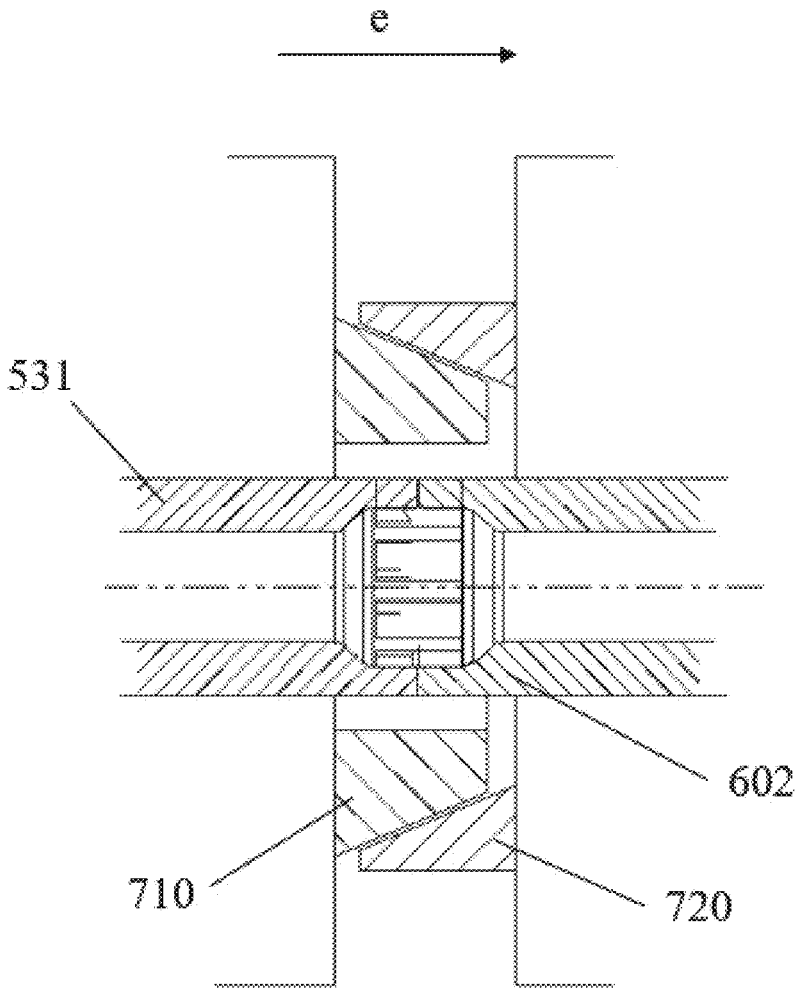
FIG. 10B is a structural diagram illustrating an exemplary meshing of a taper structure according to some embodiments of the present disclosure.

The taper structure is further described below in conjunction with the accompanying drawings. FIG. 10A is a structural diagram illustrating an exemplary taper structure according to some embodiments of the present disclosure. FIG. 10B is a structural diagram illustrating an exemplary meshing of a taper structure according to some embodiments of the present disclosure.

As shown in FIG. 10A and FIG. 10B, the taper structure may include an outer taper member 710 and an inner taper member 720. The outer taper member 710 may be disposed around an outer side of the connecting shaft 531, and the inner taper member 720 may be disposed around an outer side of the shaft tooth sleeve 602. An outer side 711 of the outer taper member 710 may be an inclined side relative to a surface where the outer taper member 710 is mounted, and an inner side 721 of the inner taper member 720 may be an inclined side relative to a surface where the inner taper member 720 is mounted. An inclined angle of the outer side 711 of the outer taper member 710 may match with an inclined angle of the inner side 721 of the inner taper member 720, i.e., along the direction e in FIG. 10*a* and FIG. 10*b*, a diameter of the outer side 711 of the outer taper member 710 may gradually decrease and a diameter of the inner side 721 of the inner taper member 720 may gradually increase, so that the outer side 711 of the outer taper member 710 and the inner side 721 of the inner taper member 720 may be fitted to each other. When the resistance module 500 is close to the fitness equipment 600, the outer taper member 710 may be relatively far away from the inner taper member 720 (as shown in FIG. 10*a*), so it may be easy to operate. In the process of the resistance module 500 approaching the fitness equipment 600, the connecting shaft 531 of the resistance module 500 and the shaft tooth sleeve 602 of the fitness equipment 600 may gradually move towards a center of the connecting shaft due to the guidance of the taper structure, so that concentricity may be easily achieved. When the shaft teeth of the resistance module 500 mesh with the shaft tooth sleeve 602, the outer taper member 710 and the inner taper member 720 may also be fitted (as shown in FIG. 10*b*), so that the meshing positioning and concentricity may be completed.

In some embodiments, the length of the outer taper member 710 and the length of the inner taper member 720 may be greater than the positioning length of the positioning shaft 601. The positioning length refers to an extension length of a portion of the positioning shaft 601 that extends outside of the shaft tooth sleeve 602. The taper structure may assist in the positioning of the positioning shaft 601 before the positioning of the positioning shaft 601, which may improve the convenience of penetration of the positioning shaft 601.

Figure 11:
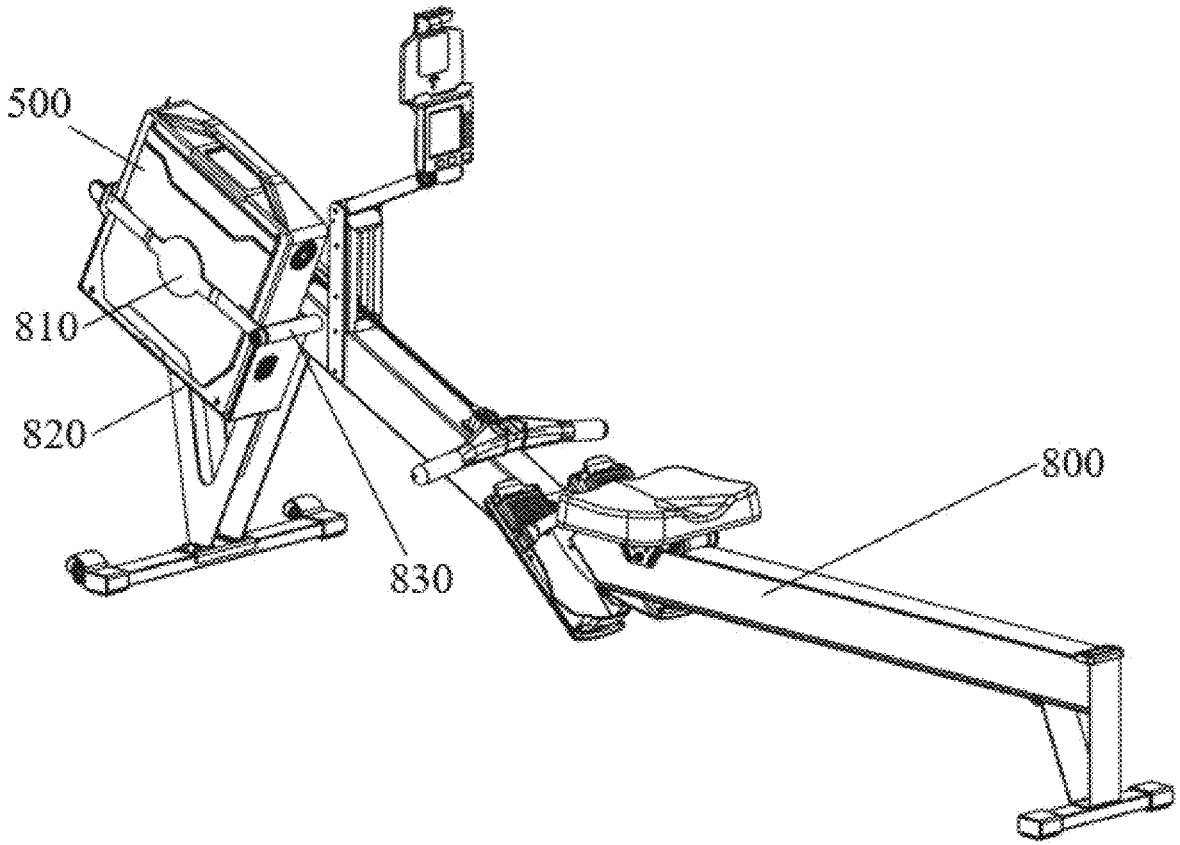
FIG. 11 is a structural diagram illustrating an exemplary resistance module and a fitness device according to some embodiments of the present disclosure.
Figure 12:
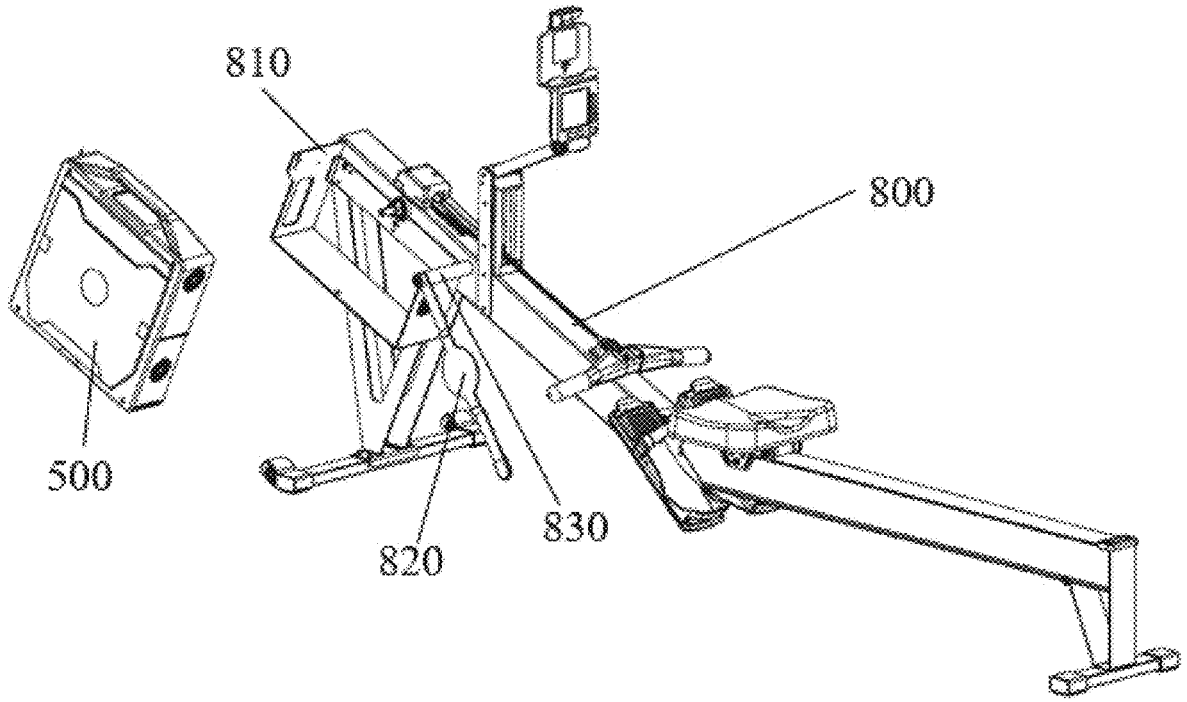
FIG. 12 is a structural diagram illustrating an exemplary mounting structure according to some embodiments of the present disclosure.

FIG. 11 is a structural diagram illustrating an exemplary resistance module and a fitness equipment according to some embodiments of the present disclosure. FIG. 12 is a structural diagram illustrating an exemplary mounting structure according to some embodiments of the present disclosure.

In some embodiments, the fitness equipment may include the mounting structure configured to mount the resistance module 500. The mounting structure may be disposed on the fitness equipment, and the resistance module 500 may be fixed relative to the fitness equipment through the mounting structure. Understandably, the mounting structure may be determined according to a structural feature of the fitness equipment.

In some embodiments, as shown in FIG. 11 and FIG. 12, the fitness equipment may be a rowing machine 800, the mounting structure may be disposed on the rowing machine 800, and the mounting structure may include a fixed frame 810, a fixed plate 820, and a hinge 830. The fixed frame 810 may be provided with a three-sided support plate matching the resistance module 500, and the fixed frame 810 may be configured to support the resistance module 500 from at least three directions. The fixed plate 820 may be configured to limit the position of the resistance module 500, and the fixed plate 820 may be rotated along the hinge 830. In some embodiments, a process of fixing the resistance module 500 is as follows. The resistance module 500 may be placed into the fixed frame 810, the fixed plate 820 may be rotated along the hinge 830 until the fixed plate 820 is rotated to a position where the fixed plate 820 fits the resistance module 500, the fixed plate 820 may be connected with the fixed frame 810, and the mounting may be completed. The connection manner may include a snap fit connection, a pin connection, a threaded connection, etc.

Figure 13:
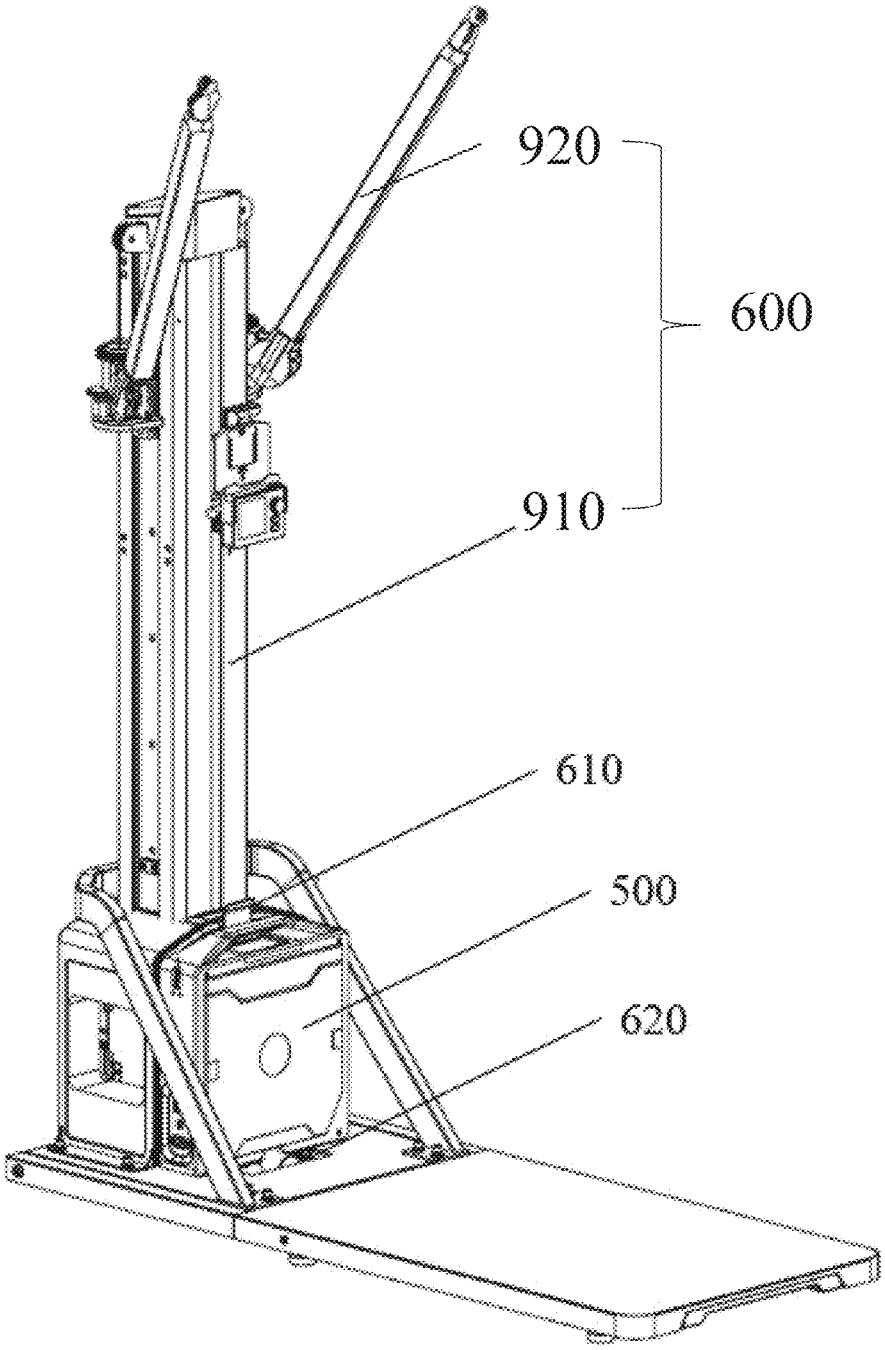
FIG. 13 is a structural diagram illustrating an exemplary resistance module and another fitness device according to some embodiments of the present disclosure.
Figure 14:
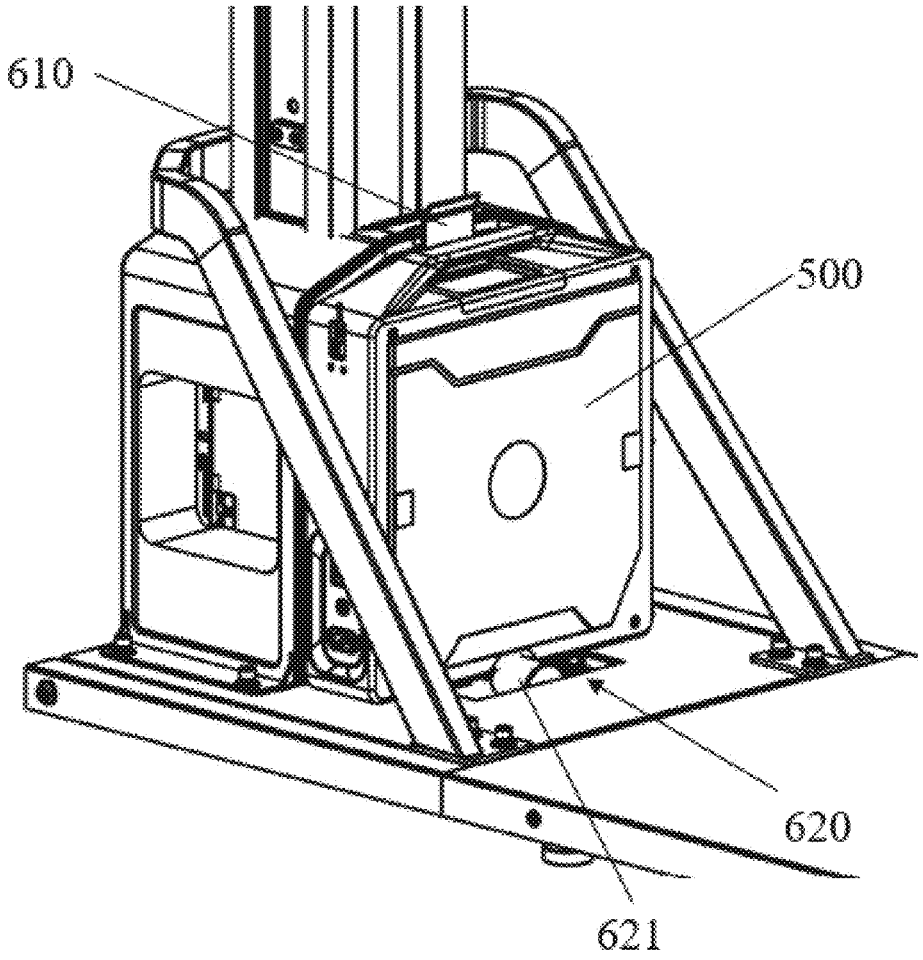
FIG. 14 is a structural diagram illustrating an exemplary mounting structure according to some embodiments of the present disclosure.
Figure 15A:
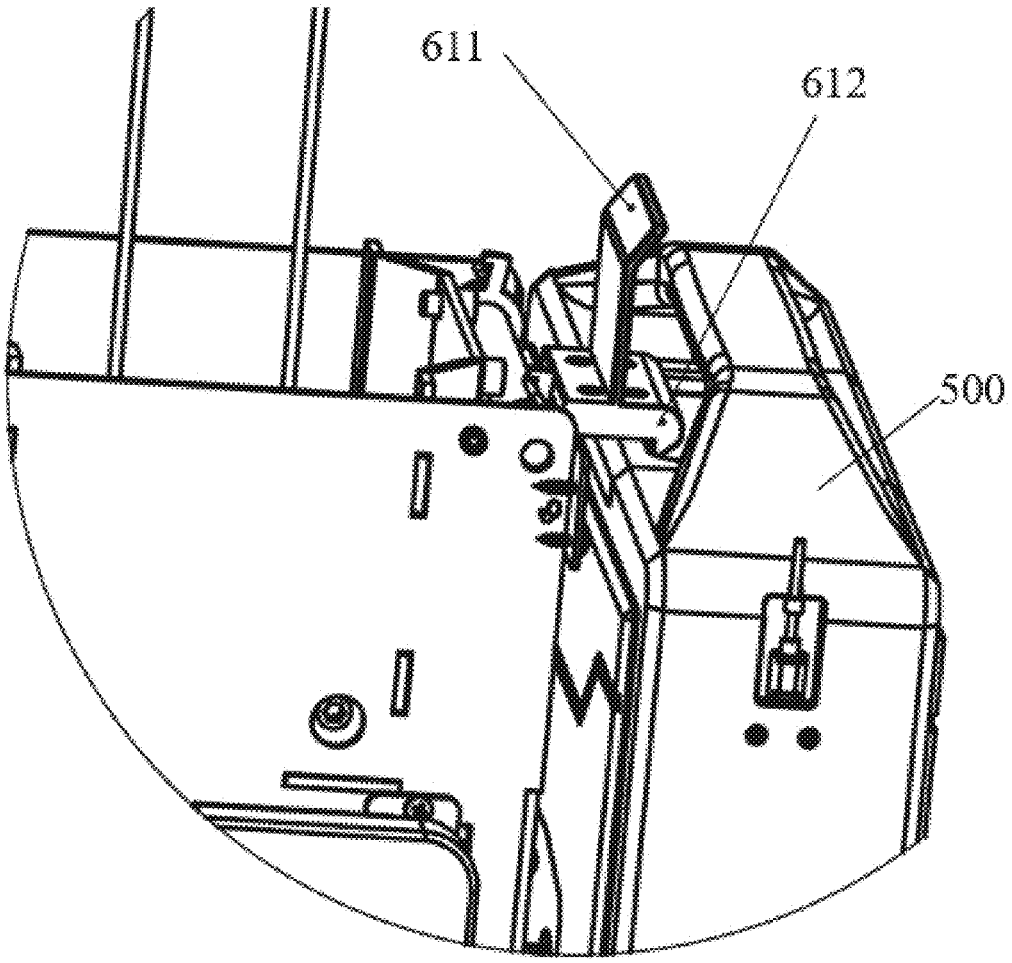
FIG. 15A is a structural diagram illustrating an exemplary first positioning assembly according to some embodiments of the present disclosure.
Figure 15B:
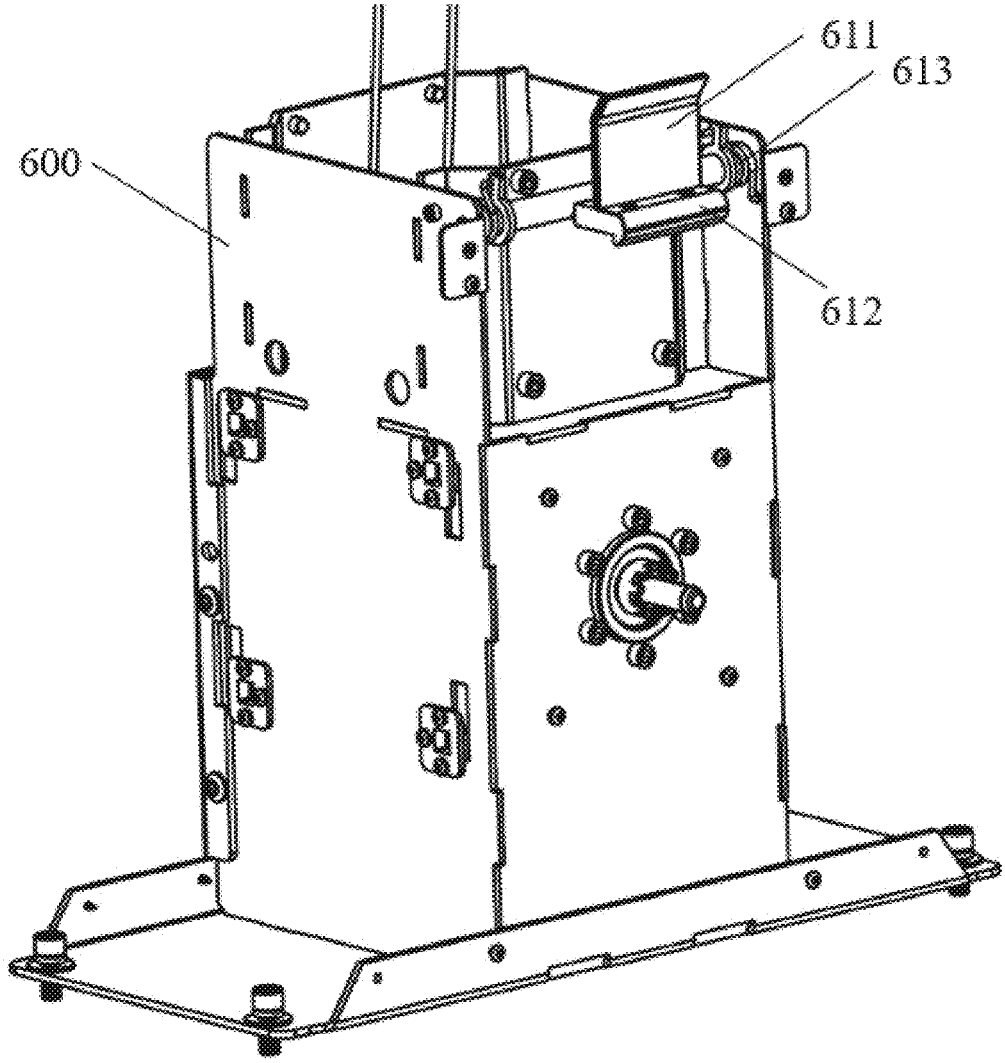
FIG. 15B is a structural diagram illustrating another exemplary first positioning assembly according to some embodiments of the present disclosure.
Figure 15C:
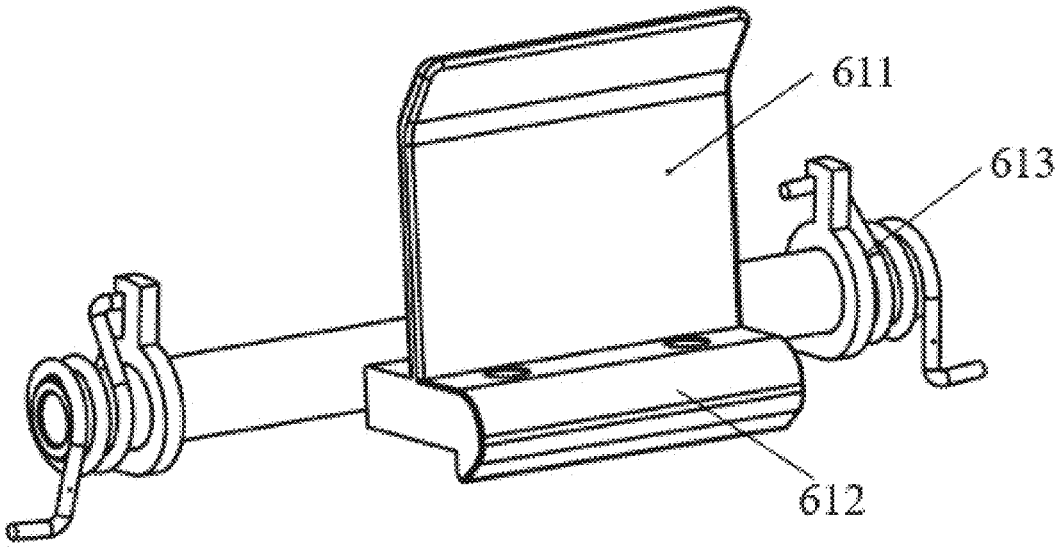
FIG. 15C is a structural diagram illustrating another exemplary first positioning assembly according to some embodiments of the present disclosure.

FIG. 13 is a structural diagram illustrating an exemplary resistance module and another fitness equipment according to some embodiments of the present disclosure. FIG. 14 is a structural diagram illustrating an exemplary mounting structure according to some embodiments of the present disclosure. FIG. 15A is a structural diagram illustrating an exemplary first positioning assembly according to some embodiments of the present disclosure. FIG. 15B is a structural diagram illustrating another exemplary first positioning assembly according to some embodiments of the present disclosure. FIG. 15C is a structural diagram illustrating another exemplary first positioning assembly according to some embodiments of the present disclosure.

In some embodiments, as shown in FIG. 13 and FIG. 14, the mounting structure may include a first positioning assembly 610 and a second positioning assembly 620. As shown in FIGS. 15A-FIG. 15C, the first positioning assembly 610 may include an L-shaped platen 611. An end of a transverse plate of the L-shaped platen 611 may be provided with a snap hook structure 612 for hooking the resistance module 500 to prevent the resistance module 500 from moving outwardly. The transverse plate of the L-shaped platen 611 may abut the resistance module 500, so that the resistance module 500 may not move upward. A longitudinal plate of the L-shaped platen 611 may be used for easy user lifting. In some embodiments, the L-shaped platen 611 may be provided with a torsion spring 613. A downward force may be applied to the transverse plate of the L-shaped platen 611 by an elastic force of the torsion spring 613, which may further press down the resistance module 500. In some embodiments, when the user pulls the L-shaped platen 611 upward, the snap hook structure 612 may be lifted upwardly at an angle to separate from the resistance module 500.

In some embodiments, the first positioning assembly 610 may be disposed on the stand column 910. The stand column 910 may serve as a mounting base to position and support the first positioning assembly 610.

Figure 17:
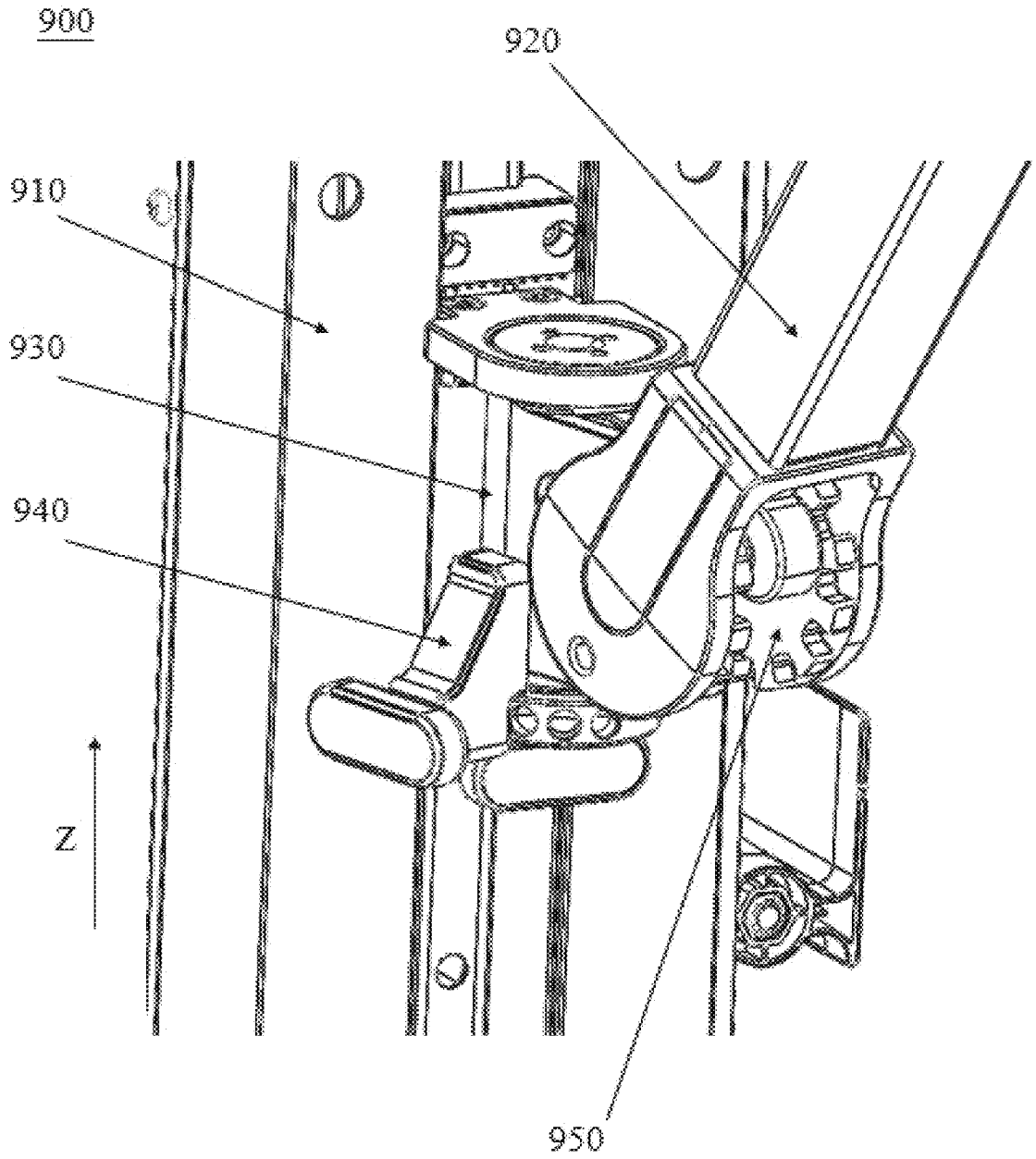
FIG. 17 is a schematic diagram illustrating a partial structure of an exemplary adjustable accessory according to some embodiments of present disclosure.

More descriptions regarding the stand column 910 may be found in the related descriptions of FIG. 17.

Figure 16A:
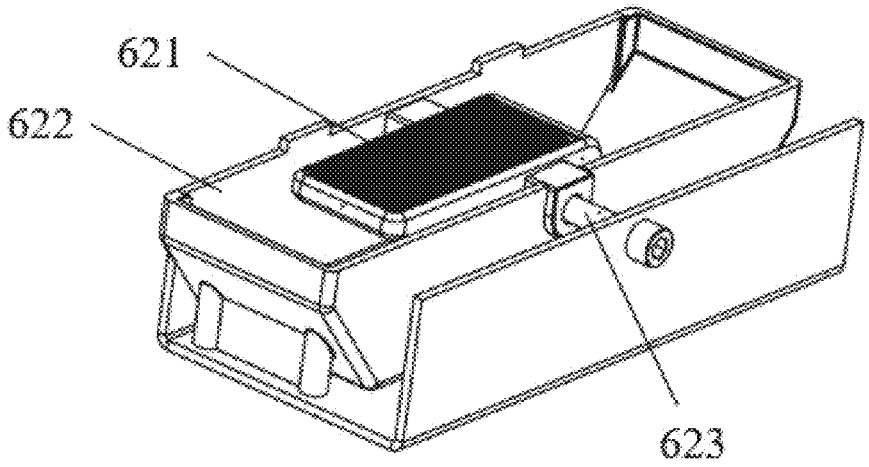
FIG. 16A is a structural diagram illustrating an exemplary second positioning assembly according to some embodiments of the present disclosure.
Figure 16B:
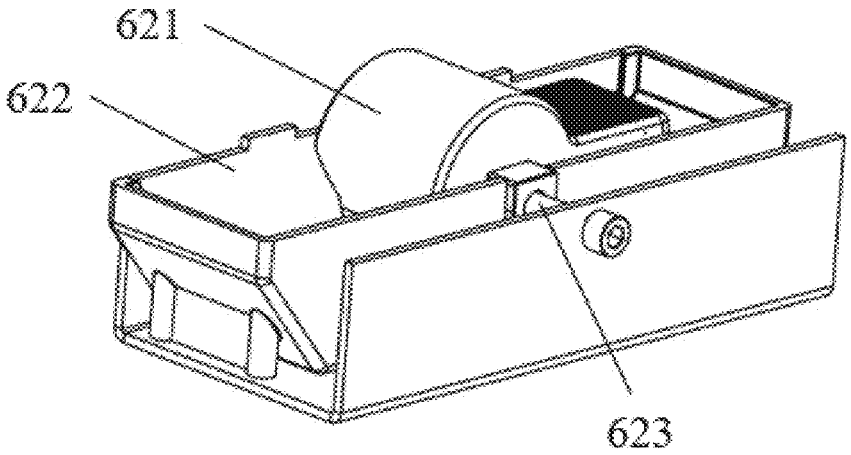
FIG. 16B is a structural diagram illustrating another exemplary second positioning assembly according to some embodiments of the present disclosure.
Figure 16C:
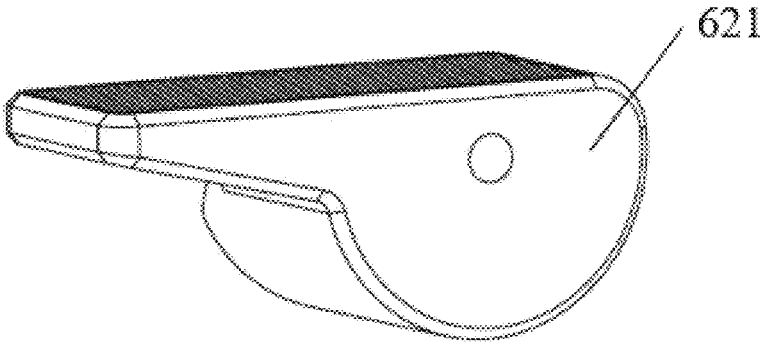
FIG. 16C is a structural diagram illustrating an exemplary convex plate according to some embodiments of the present disclosure.

FIG. 16A is a structural diagram illustrating an exemplary second positioning assembly according to some embodiments of the present disclosure. FIG. 16B is a structural diagram illustrating another exemplary second positioning assembly according to some embodiments of the present disclosure. FIG. 16C is a structural diagram illustrating an exemplary convex plate according to some embodiments of the present disclosure.

As shown in FIG. 16A to FIG. 16C, the second positioning assembly 620 may include a convex plate 621 and a mounting groove 622. One side of the convex plate 621 may be a flat surface, and another side of the convex plate 621 may have a protrusion (as shown in FIG. 16C). The convex plate 621 may be rotatably disposed in the mounting groove 622. For example, the convex plate 621 may be provided with a pin shaft 623, and both ends of the pin shaft 623 may be fixed in the mounting groove 622, so that the convex plate 621 may be rotated based on the pin shaft 623.

In some embodiments, the convex plate 621 shown in FIG. 16A may be rotated until the flat surface of the convex plate 621 is coplanar with a surface including a notch of the mounting groove 622, and may remain stable in the state when not subjected to a force pushing the convex plate 621 to rotate. At this time, the fitness equipment 600 may be not mounted with the resistance module 500 or the resistance module 500 may be not limited. In some embodiments, under the effect of gravity distribution of the convex plate 621 (i.e., the side having the protrusion may have a greater weight), the convex plate 621 may maintain a state in which the flat surface of the convex plate 621 is coplanar with the surface including the notch of the mounting groove 622.

In some embodiments, as shown in FIG. 16B, the convex plate 621 may be rotated by a force until the convex plate 621 protrudes beyond the surface including the notch of the mounting groove 622, and may remain stable in the state without being subjected to the force pushing the convex plate 621 to rotate. At this time, the resistance module 500 may be stuck by the protrusion of the convex plate 621 to achieve a stable mounting (see FIG. 14). In some embodiments, since the resistance module 500 is stuck by the protrusion of the convex plate 621, the convex plate 621 may maintain a state protruding beyond the surface including the notch of the mounting groove 622.

In some embodiments, the second positioning assembly 620 may further include a small motor (not shown). The small motor may be connected with the convex plate 621 so as to drive the convex plate 621 to rotate, so that the user may not need to manually operate. The user may operate the second positioning assembly 620 by controlling the small motor, which is more convenient.

In some embodiments of the present disclosure, the mounting structure may be disposed on the fitness equipment that matches the resistance module, so that the resistance module may be relatively fixed to the fitness equipment, thereby ensuring that the resistance module is in good contact with the fitness equipment during operation, and the resistance is transmitted to the fitness equipment better.

In some embodiments, the resistance module 500 may further include one or more position sensors. The one or more position sensors may be configured to monitor whether the resistance module 500 reaches a preset mounting position. For example, the one or more position sensors may include a first position sensor and a second position sensor.

The first position sensor may be disposed on the resistance module 500 for monitoring a position of the transmission mechanism 530. The second position sensor may be disposed on the fitness equipment for monitoring a position of the mounting structure. In some embodiments, the one or more position sensors may include a third position sensor for recognizing a type of fitness equipment connected with the resistance module 500. Types of the one or more position sensors may include, such as a capacitive sensor, a displacement sensor, a grating sensor, a position encoder, etc. In some embodiments, the one or more position sensors may be communicatively connected with the controller 523, and the controller 523 may perform further processing based on a monitoring result of the one or more position sensors.

In some embodiments, the first position sensor and the third position sensor may be Hall sensors. A Hall sensor may be disposed at different positions of different fitness equipment. The Hall sensor may detect the position. The controller 523 may recognize the type of fitness equipment to which the resistance module 500 is connected through the detected position. For example, the controller 523 may recognize whether the fitness equipment connected with the resistance module 500 is a strength training station or a rowing machine based on the detected position.

In some embodiments, the resistance module 500 may further include an interactive screen. The interactive screen may facilitate communication between a user and components of the fitness equipment. For example, the user may interact with (e.g., control) the resistance module 500 or the fitness equipment by touching a screen, clicking a button, typing text, dragging an icon, etc. In some embodiments, the interactive screen may be disposed on at least one of the resistance module 500 or the fitness equipment. In other embodiments, the interactive screen may be a smart device (e.g., smartphone or smartwatch), and the smart device may be communicatively connected with either the resistance module 500 or the fitness equipment 600.

In some embodiments, the resistance module 500 may further include a distance sensor. The distance sensor may be configured to monitor a distance between an end face of the connecting shaft 531 and an end face of a rotating shaft of a gantry of the fitness equipment.

In some embodiments, the controller 523 may provide a reminder on the interactive screen indicating that the connecting shaft 531 is not mounted in place in response to the recognized type of the fitness equipment 600 to which the resistance module 500 is connected, and the distance between the end face of the connecting shaft 531 and the end face of the rotating shaft of the gantry of the fitness equipment denoted by distance sensor data does not satisfy a preset condition. In some embodiments, the controller 523 may, in response to the reminder indicating that the connecting shaft 531 is not mounted in place, display a corresponding mounting video or a scale position on the taper structure, etc., on the interactive screen to help the user to mount. In some embodiments, the controller 523 may repeatedly monitor the distance sensor data based on a preset time interval until the distance between the end face of the connecting shaft 531 and the end face of the rotating shaft of the gantry of the fitness equipment meets the preset condition. The preset condition may be that the distance between the end face of the connecting shaft 531 and the end face of the rotating shaft of the gantry of the fitness equipment 600 is smaller than a distance threshold. The distance threshold may be preset empirically, and the distance threshold may be 0, 1 centimeter, 2 centimeters, etc.

In some embodiments, the controller 523 may, in response to determining that detection data of the first position sensor and detection data of the second position sensor satisfy a preset condition, determine and prompt that the resistance module 500 has reached the preset mounting position; and send, based on the determination that the resistance module 500 has reached the preset mounting position, an activation command to activate the power device 520 of the resistance module 500. In some embodiments, the controller 523 may, in response to determining that the detection data of the first position sensor and the detection data of the second position sensor detection data do not satisfy the preset condition, determine and prompt specific content (e.g., a component and a position that are not mounted in place) that does not satisfy the preset condition; and provide mounting guidance based on the specific content that does not satisfy the preset condition. For example, the controller 523 may display a mounting video of the corresponding component on the interactive screen based on the specific content that does not satisfy the preset condition. The preset condition may be preset based on experience or historical data. For example, if current detection data of the first position sensor and current detection data of the second position sensor is consistent with detection data of the first position sensor and detection data of the second position sensor corresponding to the historical data when the resistance module 500 has been mounted in place, the preset condition may be considered to be satisfied.

In some embodiments, the controller 523 may, in response to determining that the fitness equipment is changed or replaced by another fitness equipment (e.g., the resistance module 500 is separated from a certain fitness equipment and close to or connected with another fitness equipment), provide mounting guidance of the resistance module 500 of the replaced fitness equipment or fitness training guidance, etc., on the interactive screen.

In some embodiments of the present disclosure, the position sensor, the distance sensor, and the interactive screen may be disposed, which may help the user to determine the type of the connected fitness equipment, and guide the user to mount the fitness equipment in a timely manner, thereby providing the user with convenience of mounting. At the same time, the controller 523, by determining the position sensor data and the distance sensor data, may fully ensure that the resistance module is reliably mounted and reliably positioned before activating the resistance module, which can ensure the safety of the user using the resistance module.

In some embodiments, the position sensor may include a fourth position sensor for monitoring the status data of the fitness equipment. In some embodiments, when the fitness equipment is a strength training station, the status data may include a position of a rotating shaft arm of the strength training station and an exercise program corresponding to the fitness equipment, a speed at which a pull rope is pulled out, a length that the pull rope is pulled out, etc. In some embodiments, when the fitness equipment is a rowing machine, the status data may include an exercise program of the rowing machine, a speed at which a pull rope is pulled out, a length that the pull rope is pulled out, etc. The exercise program refers to exercise data related to exercise. The exercise data may include a fitness parameter, an exercise duration, an effective exercise duration, etc. More descriptions regarding the exercise data may be found below.

In some embodiments, the controller 523 may provide a reminder for changing the exercise program in response to determining that the status data exceeds a preset value, and cause the resistance module 500 to change the resistance. In some embodiments, power device parameters (e.g., a speed or an output power) of the resistance module 500 corresponding to different training modes may be different, and the power device parameters corresponding to the different training modes may be preset values. In some embodiments, the controller 523 may obtain the power device parameters in advance based on a switching sequence of the training modes in the history records.

In some embodiments, the controller 523 may activate the resistance module 500 based on a power device parameter in response to determining that the motor assembly stops rotating when the fitness equipment is switched or after the fitness equipment 600 is switched. In some embodiments, the preset condition may need to be met before the resistance module 500 is activated. More descriptions regarding the preset condition that needs to be met before activation of the resistance module 500 may be found above.

In some embodiments, the controller 523 may collect, in response to determining that the resistance module 500 is connected with one of at least one set of fitness equipment exercise data of the user based on the fitness equipment, determine a recommended fitness parameter, and display the recommended fitness parameter on the interactive screen. The at least one set of fitness equipment refers to one or more different fitness equipment that may be connected with the resistance module 500. The exercise data may include a fitness parameter, an exercise duration, etc. The fitness parameter may include a parameter such as a tensile force, a torque force, or resistance of the fitness equipment.

In some embodiments, the resistance module 500 may be connected with different fitness equipment, the controller 523 may obtain exercise data corresponding to the fitness equipment connected with the resistance module 500. In some embodiments, the exercise data may include an exercise duration and an effective exercise duration. The exercise duration refers to a time spent by the user doing exercise using the fitness equipment. The effective exercise duration refers to a time spent by the user doing exercise with a relatively good result. In some embodiments, the effective exercise duration may be a duration when the resistance is output by the resistance module 500, which may exclude a case where the resistance module 500 runs but not outputs resistance.

In some embodiments, after the resistance module 500 is connected with the fitness equipment, the controller 523 may determine the effective exercise duration based on exercise intensity data corresponding to the fitness equipment. In some embodiments, the effective exercise duration may be obtained based on the exercise duration through weighting. If an exercise intensity is a standard exercise intensity, a weight may be 1. If the exercise intensity is smaller than the standard exercise intensity, the weight may be smaller than 1. If the exercise intensity is greater than the standard exercise intensity, the weight may be greater than 1. The exercise intensity data is used to indicate the exercise intensity, which reflects the amount of force exerted by the user, and the physical tension degree of the user, etc., during the exercise. The exercise intensity data may include an activation time of the fitness equipment recorded by the fitness equipment, an activation time of the resistance module 500, data such as resistance output by the resistance module 500 at different time points, power consumption, etc. In some embodiments, the standard exercise intensity may be associated with a user feature. For example, the standard exercise intensity may be lowered for a beginner and raised for a regular exerciser. In some embodiments, the standard exercise intensity may be set by a user for using the fitness equipment. In some embodiments, the standard exercise intensity may be related to a count of times the resistance module 500 has been switched in a previous preset time period and a historical effective exercise duration of the user. For example, if the user has switched the resistance module 100 three times in the past one hour, and the effective exercise duration is close to 20 minutes after each switch, it may indicate that the user is serious about the exercise, and the standard exercise intensity may be lowered when the user does exercise subsequently, so that a longer effective exercise duration may be recorded for the user.

In some embodiments of the present disclosure, by recording the exercise data of different fitness equipment connected by the resistance module, the exercise data of the user exercising in different fitness equipment may be obtained, so as to better personalize the exercise of the user and meet exercise needs of the user.

In some embodiments, the controller 523 may display the recommended fitness parameter to the user on the interactive screen based on the exercise data. The exercise data may include exercise data obtained through historical statistics (also referred to as historical exercise data) and currently recorded exercise data (also referred to as current exercise data). The recommended fitness parameter may include a parameter such as a tensile force, a torque force, resistance of fitness equipment, etc., recommended to the user. In some embodiments, the recommended fitness parameter of the resistance module 500 may be gradual increased in intensity. The intensity of the recommended fitness parameter of the resistance module 500 may stop increasing until the effective exercise duration varies by a magnitude that is smaller than a preset time threshold or decreases (indicating that the current exercise intensity may be too high relative to the user).

In some embodiments, the recommended fitness parameter may be related to the effective exercise duration of the user and a standard exercise duration. In some embodiments, the standard exercise duration may be related to the user feature (e.g., a user feature that is recorded when the user logs in). For example, if the effective exercise duration of the user is smaller than the standard exercise duration, the exercise intensity of the recommended fitness parameter may be reduced, and a reduced percentage may be equal to a ratio of the effective exercise duration to the standard exercise duration). If the effective exercise duration of the user is greater than the standard exercise duration, the exercise intensity may be increased in the recommended fitness parameter, and an increased percentage may be equal to a ratio of the effective exercise duration to the standard exercise duration. In some embodiments, the recommended fitness parameter may be no longer adjusted when a difference between two adjacent effective exercise durations of the user is smaller than a threshold.

In some embodiments of the present disclosure, the recommended fitness parameter of the user may be continuously optimized, which may improve a matching degree between the recommended fitness parameter and the user, so as to improve the exercise effect of the user, and at the same time to avoid exercise injuries to the user due to an excessive exercise intensity.

In some embodiments, the controller 523 may, in response to determining that the resistance module 500 is connected with the fitness equipment, predict an optimal fitness parameter of the user through a fitness parameter prediction model and send the optimal fitness parameter to the interactive screen for display. The optimal fitness parameter refers to a fitness parameter that has a highest matching degree with the user.

In some embodiments, the fitness parameter prediction model may be a machine learning model. For example, the fitness parameter prediction model may include a convolutional neural network (CNN) model, a neural network (NN) model, other customized model structure, or the like, or any combination thereof.

An input of the fitness parameter prediction model may include the user feature, the type of the current fitness equipment, and a candidate fitness parameter. The controller may recognize the type of the fitness equipment and input the type of the fitness equipment into the fitness parameter prediction model. An output of the fitness parameter prediction model may include a recommendation degree of the candidate fitness parameter. The user feature may be obtained when the user logs in online through a terminal, for example, the user feature may be inputted by the user voluntarily. The candidate fitness parameter may be one of a plurality of sets of fitness parameters determined by matching through a predetermined fitness parameter database based on the user feature and the current fitness equipment. For example, the controller 523 may construct a retrieval vector (e.g., {User feature 1, fitness equipment A}) based on the user feature and the current fitness equipment, retrieve in a fitness parameter vector database, and select a fitness parameter corresponding to a standard vector that has a closest distance (e.g., cosine distance) with the retrieval vector as the candidate fitness parameter. The fitness parameter vector database may be a vector database established by collecting historical data to construct vectors.

In some embodiments, the controller 523 may generate, based on a count of times the fitness equipment during a recent time period, a type of fitness equipment that is replaced each time, and the effective exercise duration corresponding to each replacement, sequence data, and match the candidate fitness parameter based on the sequence data. For example, if the user does exercise using only a fixed type of fitness equipment every day, as the exercise proceeds, the user may need a greater exercise intensity, and at this time, the intensity of the candidate fitness parameter subsequently may be appropriately increased. As another example, if the effective exercise duration of the user is relatively long before the fitness equipment is switched, and when the user switches the fitness equipment, the candidate fitness parameter subsequently may be appropriately reduced to avoid excessive fatigue of the user. The recommendation degree of the candidate fitness parameter refers to a degree to which the candidate fitness parameter matches the user, and the recommendation degree of the candidate fitness parameter may be expressed in a way, for example, the recommendation degree may be expressed as 0-100%.

In some embodiments, the fitness parameter prediction model may be obtained by training a plurality of training samples with labels. For example, the plurality of training samples with the labels may be input into an initial fitness parameter prediction model, a loss function may be constructed based on the labels and output results of the initial fitness parameter prediction model, and parameters of the initial fitness parameter prediction model may be iteratively updated through gradient descent or other manner based on the loss function. The model training may be completed when a preset condition is met, and a trained fitness parameter prediction model may be obtained. The preset condition may be that the loss function converges, a count of iterations reaches a threshold, etc.

In some embodiments, the training sample may at least include a sample user feature, a sample current fitness equipment, and a sample candidate fitness parameter. The label may be a recommendation degree corresponding to the sample candidate fitness parameter. In some embodiments, the controller 523 may obtain the label in various ways. For example, the controller 523 may obtain feedback from the user on the interactive screen after the exercise is completed (e.g., an active pop-up evaluation page) and determine the label based on the feedback. As another example, based on a large amount of historical data, if the difference between two adjacent effective exercise durations of the user is smaller than the threshold, it may indicate that the current fitness parameter is appropriate (also referred to as an appropriate fitness parameter). When the label is obtained through the feedback of the user on the interactive screen, it may be considered that the label of the current fitness parameter corresponding to the good comment is 1, and the label of the current fitness parameter corresponding to the bad or neutral comment is 0. When the label is obtained based on historical data, it may be considered that the label of an appropriate fitness parameter is 1 and the label of an inappropriate fitness parameter is 0.

In some embodiments, the controller 523 may use a candidate fitness parameter with a highest recommendation degree as the optimal fitness parameter displayed to the user based on the recommendation degree of the candidate fitness parameter output by the fitness parameter prediction model. In some embodiments, the controller 523 may also recommend a plurality of candidate fitness parameters in a sequential order, and note a candidate fitness parameter with a relatively low recommendation degree at the bottom of the ordering may be noted as a reminder such as "intensity may be too low," or "there may be a risk of strain" to further satisfy the choice of the user.

In some embodiments of the present disclosure, the optimal fitness parameter may be determined, and the optimal parameter may be combined with the user feature, thereby further obtaining the exercise program that matches the user and improving the exercise effect of the user.

When the extension arm of an existing fitness device is adjusted, due to processing errors, wear and tear at the connection, etc., the extension arm may not be adjusted properly, and the adjusted extension arm may be loose. During use, the extension arm may make abnormal noise and shake, resulting in safety hazards and increased wear at the connection of the extension arm.

To this end, some embodiments of the present disclosure provide a fitness device. The fitness device may include one or more adjustable accessories. An adjustable accessory may adjust a position of the extension arm by setting a sliding assembly, a first assembly, and a second assembly. For example, a height position and/or an angle position of the extension arm may be adjusted. The flexibility of the extension arm may be improved, and the user may adjust the extension arm according to different exercise movements.

In some embodiments, the fitness equipment 600 may include one or more detachable accessories.

In some embodiments, at least a portion of the detachable accessory may be connected with at least a portion of one of the one or more detachable accessories. In some embodiments, the detachable accessory may be connected with the extension arm of the adjustable accessory through a rope body. In some embodiments, the fitness equipment 600 may include a plurality of extension arms. For example, the fitness equipment 600 may include two, three or more extension arms. In some embodiments, each of the plurality of extension arms may be connected with one or more a detachable accessories. In some embodiments, the count of the one or more detachable accessories may be the same as the count of the extension arms. The count of the one or more adjustable accessories may be the same as the count of the extension arms. Each extension arm may be connected with one detachable assessor.

More descriptions regarding the adjustable accessory may be found in the related descriptions of FIGS. 17-27. More descriptions regarding the detachable accessory may be found in the related descriptions of FIGS. 28-30.

Figure 18:
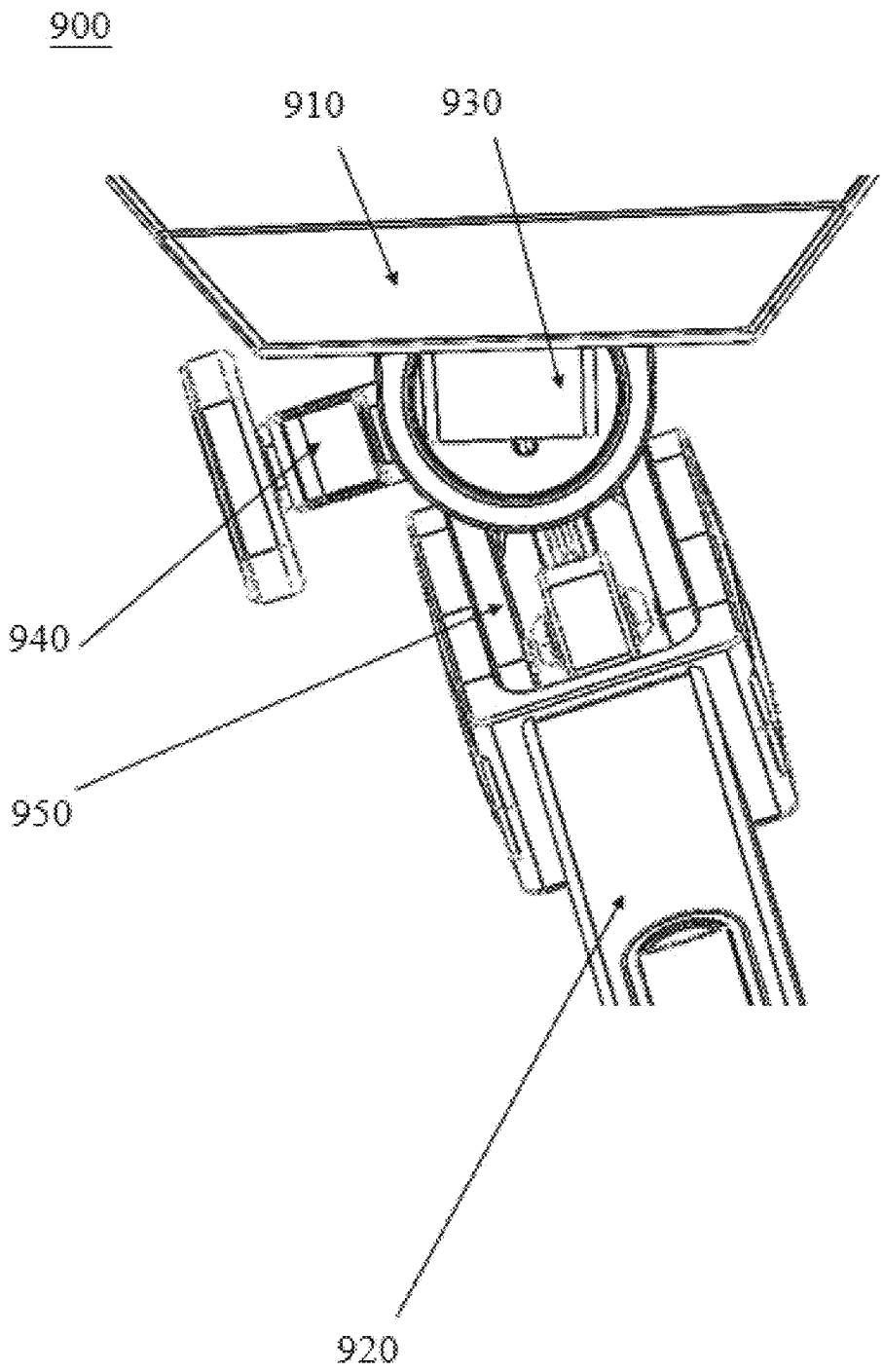
FIG. 18 is a top view of the partial structure of the adjustable accessory shown in FIG. 17.
Figure 19:
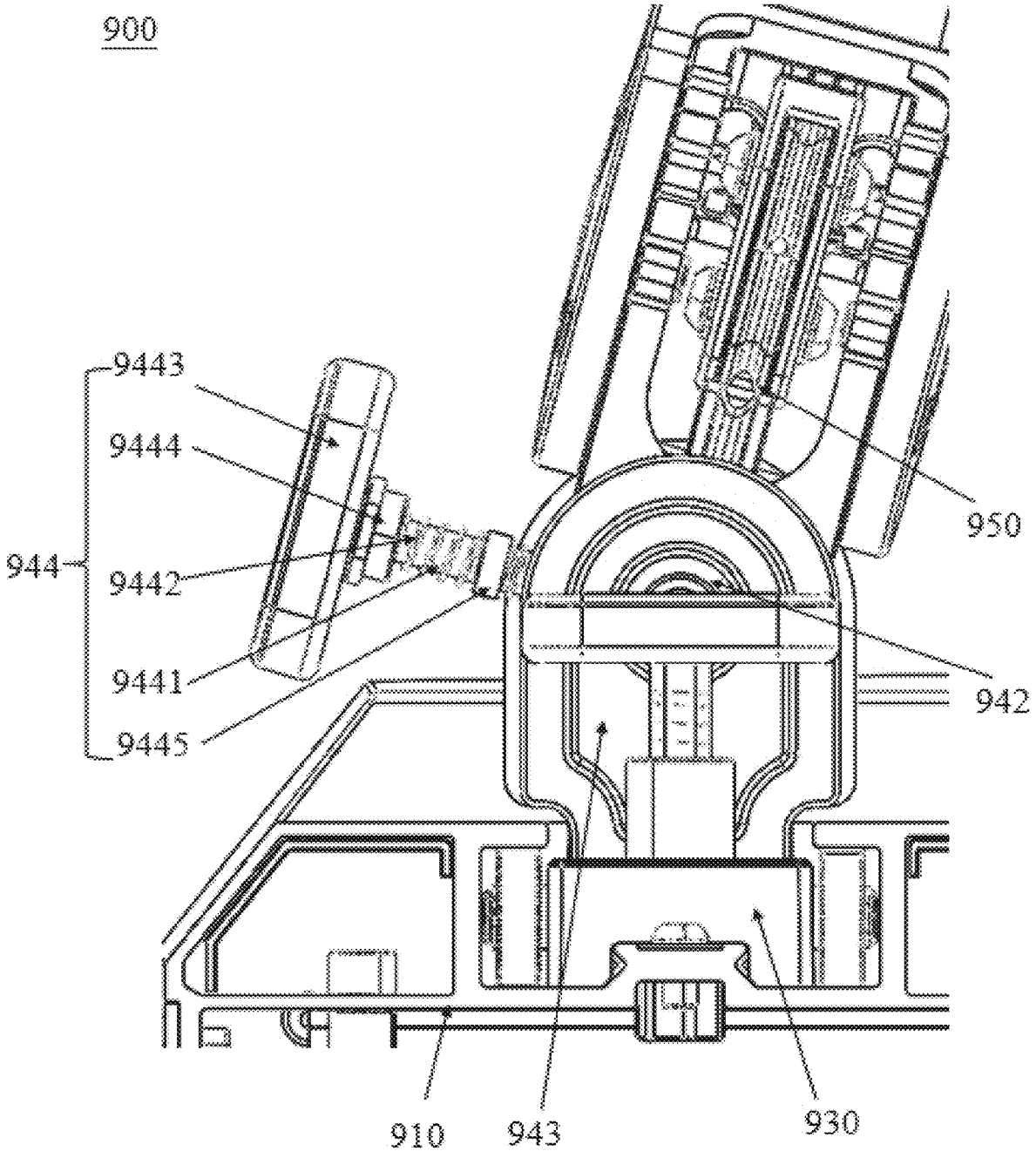
FIG. 19 is a bottom view of the partial structure of the adjustable accessory shown in FIG. 17.

FIG. 17 is a schematic diagram illustrating a partial structure of an exemplary adjustable accessory according to some embodiments of present disclosure. FIG. 18 is a top view of FIG. 17. FIG. 19 is a bottom view of FIG. 17.

In some embodiments, referring to FIGS. 17-19, the adjustable accessory 900 for the fitness equipment 600 may include a stand column 910, an extension arm 920, a sliding assembly 930, a first assembly 940, and a second assembly 950.

The stand column 910 may serve as a mounting base for mounting the sliding assembly 930. In some embodiments, the stand column 910 may be made of a profile. The profile refers to a material with a certain shape in a cross section, e.g., a steel profile, etc. By using the profile, the strength of the stand column 910 may be increased. In some embodiments, the length direction of the stand column 910 may be set along a long axis of the stand column 910, e.g., a vertical direction (e.g., a Z-direction in FIG. 17).

The extension arm 920 may be used to provide support for at least a portion of a weight of the fitness equipment 600. For example, the fitness equipment 600 may include at least one weight block and a rope body for pulling the at least one weight block. The rope body may be disposed on the extension arm 920, and a user may drive the at least one weight block to move by pulling the rope body, thereby achieving the exercise effect. The extension arm 920 may be configured to change a direction of at least a portion of the rope body, such that the user may avoid the at least one weight block from colliding with the user during movement. In some embodiments, the rope body may be disposed inside the extension arm 920. In some embodiments, a fixed pulley connected with the rope body in a rolling manner may be disposed inside the extension arm 920 to reduce the wear of the rope body.

In some embodiments, the stand column 910 may serve as a mounting base for mounting the resistance module 500. In some embodiments, the resistance module 500 may be configured to apply resistance to the rope body, which has a similar effect to the at least one weight block. That is, when the user pulls the rope body, the user may need to overcome the resistance applied to the rope body by the resistance module 500.

More descriptions regarding the resistance module 500 may be found in the present disclosure, e.g., FIGS. 7-9. More descriptions regarding the rope body may be found in the present disclosure below.

In some embodiments, the extension arm 920 may be made of a metal material, such as steel, etc. In some embodiments, the extension arm 920 may be made of the profile, such as the steel profile, etc., thereby improving the strength of the extension arm 920 and ensuring safety during use.

In some embodiments, the extension arm 920 may be located on a side of the stand column 910 to form an exercise space for exercise between the extension arm 920 and the stand column 910.

In some embodiments, the stand column 910 may be configured to guide the at least one weight block to move and/or limit a movement direction of the at least one weight block to improve safety. In some embodiments, the stand column 910 may be provided with at least one weight groove. The at least one weight block may be slidably connected with the at least one weight groove.

The sliding assembly 930 may be configured to move relative to other structures, such as moving relative to the stand column 910.

In some embodiments, the sliding assembly 930 may be slidably disposed on the stand column 910. In some embodiments, the sliding assembly 930 may move relative to the stand column 910 along the length direction of the stand column 910 (e.g., the Z-direction in FIG. 17).

In some embodiments, the sliding assembly 930 may be connected with the at least one side of the stand column 910. In some embodiments, a sliding connection and/or a rolling connection may be formed between the sliding assembly 930 and the stand column 910.

In some embodiments, the stand column 910 may limit a rotational freedom of the sliding assembly 930 in various ways. For example, the stand column 910 may be slidably engaged with the sliding assembly 930. By limiting the rotational freedom of the sliding assembly 930, the stability of the sliding assembly 930 may be improved. When the sliding assembly 930 slides relative to the stand column 910, problems such as looseness and shaking may be avoided.

In some embodiments, the sliding assembly 930 and the stand column 910 may be fixed relative to each other. For example, when the sliding assembly 930 moves to a first position relative to the stand column 910, the sliding assembly 930 may be fixed relative to the stand column 910. The first position may include at least one position on the stand column 910 along the length direction of the stand column 910.

The first assembly 940 may serve as a mounting base for mounting at least a portion of components of the second assembly 950. In some embodiments, the first assembly 940 may be rotatably disposed on the sliding assembly 930. When the sliding assembly 930 slides on the stand column 910, the sliding assembly 930 may drive the first assembly 940 to move together; when the first assembly 940 rotates, the first assembly 940 may drive the second assembly 950 to rotate synchronously.

In some embodiments, the rotation center of the first assembly 940 may be parallel to the length direction of the stand column 910 (e.g., the Z-direction in FIG. 17).

In some embodiments, the first assembly 940 may be rotatably connected with the sliding assembly 930 in various ways. For example, the first assembly 940 may include a rotating shaft, and the rotating shaft may be rotatably connected with the sliding assembly 930. In some embodiments, a bearing may be provided between the first assembly 940 and the sliding assembly 930. A friction between the first assembly 940 and the sliding assembly 930 may be reduced using the bearing, thereby reducing the wear of the first assembly 940 and the sliding assembly 930.

In some embodiments, the first assembly 940 and the sliding assembly 930 may be relatively fixed. For example, when the first assembly 940 rotates to a second position relative to the sliding assembly 930, the first assembly 940 may be fixed relative to the sliding assembly 930. The second position may include at least one position in a circular or elliptical trace of the first assembly 940.

The second assembly 950 may serve as a mounting base for mounting the extension arm 920.

In some embodiments, the second assembly 950 may be connected with the first assembly 940. When the sliding assembly 930 slides on the stand column 910, the sliding assembly 930 may drive the first assembly 940, the second assembly 950, and the extension arm 920 to move together; when the first assembly 940 rotates, the first assembly 940 may drive the second assembly 950 and the extension arm 920 to rotate synchronously, thereby adjusting the position of the extension arm 920, such as adjusting the position of the extension arm 920 in a horizontal plane. The horizontal plane refers to a plane perpendicular to the vertical direction (e.g., the Z-direction in FIG. 17).

In some embodiments, the extension arm 920 may be rotatably connected with the second assembly 950. The extension arm 920 may rotate relative to the second assembly 950 to adjust the position of the extension arm 920. In some embodiments, the rotation center of the extension arm 920 relative to the second assembly 950 may be perpendicular to the vertical direction (e.g., the Z-direction in FIG. 17), such that the angle between a length direction (i.e., an extension direction) of the extension arm 920 and the vertical direction may be adjusted.

In some embodiments, the extension arm 920 and the second assembly 950 may be relatively fixed. For example, when the extension arm 920 rotates to a third position relative to the second assembly 950, the extension arm 920 may be fixed relative to the second assembly 950. The third position may include at least one position in a circular or elliptical trace of the extension arm 920.

The adjustable accessory provided in some embodiments of the present disclosure can be configured to adjust multiple degrees of freedom of the extension arm, thereby improving the flexibility of the extension arm, changing the position of the extension arm according to user needs, and expanding the application scope off the fitness equipment 600.

Figure 20:
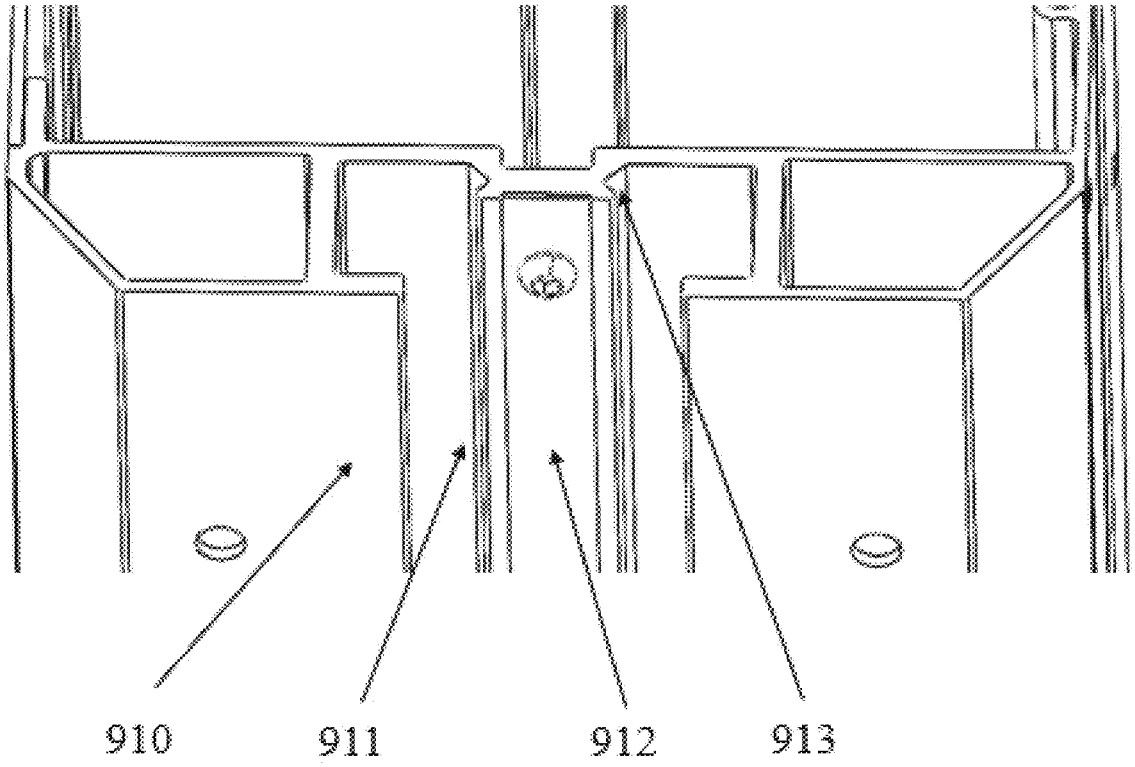
FIG. 20 is a schematic diagram illustrating a partial structure of an exemplary column according to some embodiments of the present disclosure.
Figure 21:
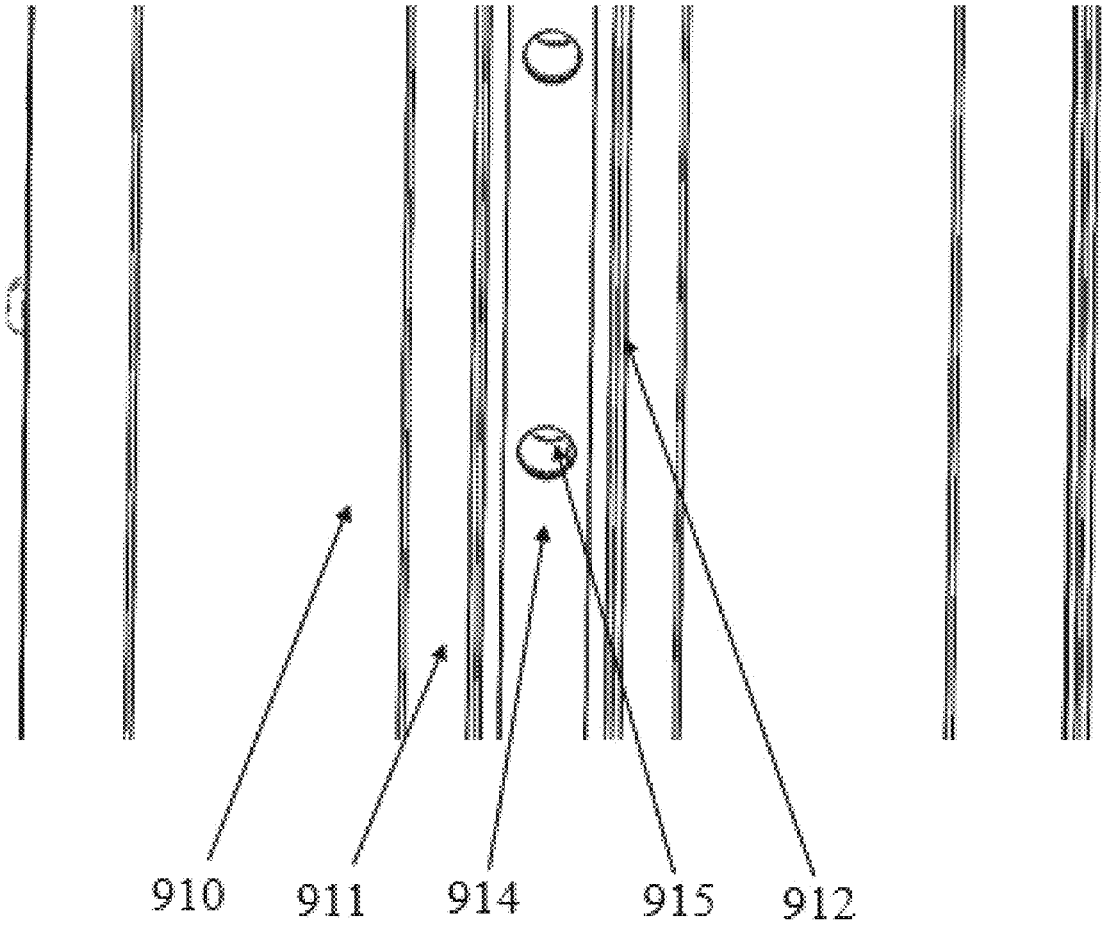
FIG. 21 is a schematic diagram illustrating a partial structure of another exemplary column according to some embodiments of the present disclosure.
Figure 22:
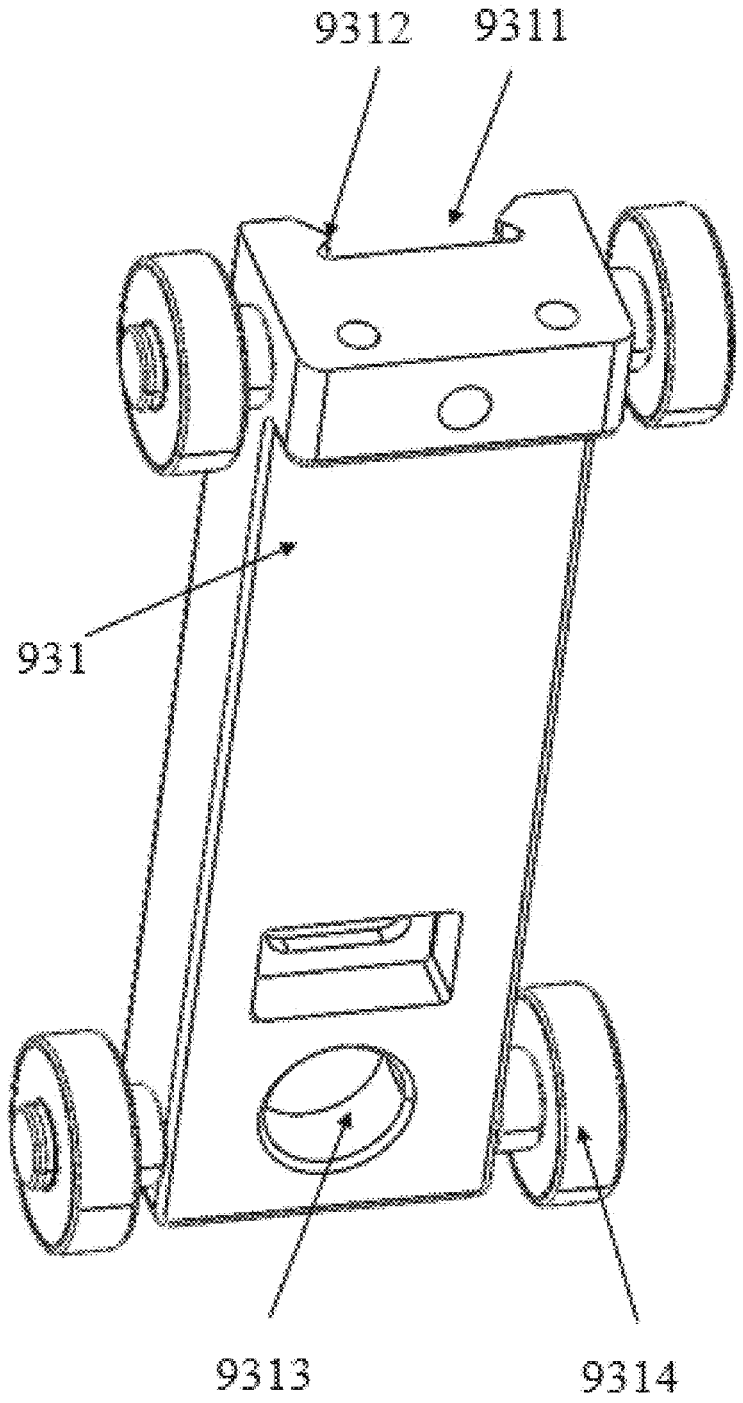
FIG. 22 is a schematic structural diagram illustrating an exemplary slider according to some embodiments of the present disclosure.
Figure 23:
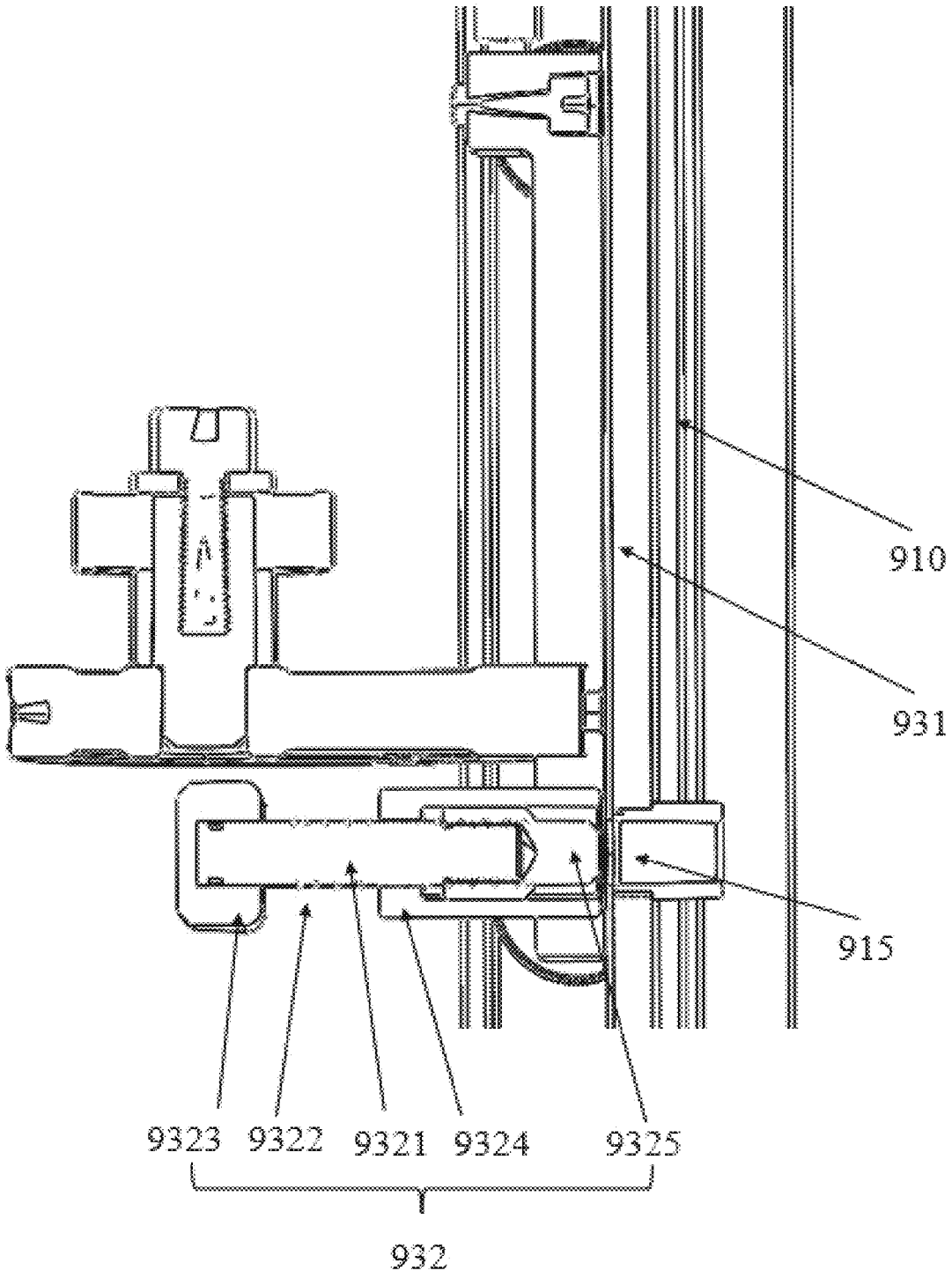
FIG. 23 is a schematic diagram illustrating a connection between a sliding assembly and a stand column according to some embodiments of the present disclosure.

FIG. 20 is a schematic diagram illustrating a partial structure of an exemplary column according to some embodiments of the present disclosure. FIG. 21 is a schematic diagram illustrating a partial structure of another exemplary column according to some embodiments of the present disclosure. FIG. 22 is a schematic structural diagram illustrating an exemplary slider according to some embodiments of the present disclosure. FIG. 23 is a schematic diagram illustrating a connection between a sliding assembly and a stand column according to some embodiments of the present disclosure.

In some embodiments, referring to FIG. 23, the sliding assembly 930 may include a slider 931 and a slider pin 932.

The slider 931 refers to a structure capable of sliding relative to other structures. In some embodiments, the slider 931 may be slidably connected with the stand column 910.

In some embodiments, referring to FIG. 21, at least one slider limiting hole 915 may be provided in the stand column 910.

The slider pin 932 refers to a structure capable of being connected to a hole. For example, the slider pin 932 may be connected to the at least one slider limiting hole 915. In some embodiments, the slider pin 932 may penetrate through the slider 931 and may cooperate with the at least one slider limiting hole 915 such that the slider 931 and the stand column 910 may be relatively fixed, thereby controlling the sliding assembly 930 and the stand column 910 to be in different first relative positions. When the slider pin 932 is separated from the at least one slider limiting hole 915, the slider 931 may slide relative to the stand column 910.

In some embodiments, the at least one slider limiting hole 915 may be disposed in the stand column 910 along the length direction of the stand column 910 (e.g., the Z direction in FIG. 17).

In some embodiments, at least a portion of the slider pin 932 may penetrate through the slider 931 and cooperate with the at least one slider limiting hole 915. In some embodiments, a portion of the slider pin 932 may be connected with the slider 931 in various ways, such as at least one of a clamp connection, a threaded connection, a welding connection, etc.

In some embodiments, referring to FIG. 20, a stand column slide groove 911 (also referred to as a first groove) may be provided on a side of the stand column 910.

The first groove 911 may include a groove structure that is concave relative to a side of the stand column 910. In some embodiments, the first groove 911 may be disposed along a length direction (e.g., the Z-direction in FIG. 17) of the stand column 910. In some embodiments, the slider 931 may slidably disposed in the first groove 911. The first groove 911 may be configured to limit and guide on the slider 931, which is conducive to improving the stability and movement accuracy of the slider 931. In some embodiments, at least a portion of a cross-sectional shape of the first groove 911 may be adapted to at least a portion of a cross-sectional shape of the slider 931, such that the slider 931 may be mounted in cooperation with the first groove 911, which is conducive to further improving the stability of the slider 931 and the first groove 911.

In some embodiments, referring to FIG. 20, a guide rail 912 may be disposed in the first groove 911.

The guide rail 912 refers to a structure protruding from an inner side of the first groove 911. In some embodiments, a cross section of the guide rail 912 may be in a U-shape. In some embodiments, the guide rail 912 may be disposed along the length direction (e.g., the Z-direction in FIG. 17) of the stand column 910.

In some embodiments, referring to FIG. 22, a second groove 9311 (also referred to as a U-shaped slide groove) adapted to the guide rail 912 may be provided in the slider 931. The slider 931 may slide along the guide rail 912. The cooperation between the guide rail 912 and the second groove 9311 may further limit the slider 931 in the movement direction and the rotational freedom of the slider 931, thereby improving the stability of the slider 931 during the movement.

In some embodiments, the at least one slider limiting hole 915 may be disposed in the guide rail 912. In some embodiments, referring to FIG. 21, a steel plate 914 may be provided on the guide rail 912. The steel plate 914 may be provided on the guide rail 912 along the length direction (e.g., the Z-direction in FIG. 17) of the stand column 910. In some embodiments, the steel plate 914 may be slidably connected with the slider 931. By providing the steel plate 914, a friction force during the movement of the slider 931 may be reduced. In some embodiments, the steel plate 914 may be provided on the guide rail 912 in various ways, such as at least one of a clamping connection, a bonding connection, a welding connection, etc.

In some embodiments, referring to FIG. 20, a side of the guide rail 912 may be provided with a third groove 913 (also referred to as a guide rail groove). In some embodiments, each of two opposite sides of the U-shaped guide rail 912 may be provided with the third groove 913.

The third groove 913 refers to a structure that is concave relative to an outer surface of the guide rail 912. In some embodiments, the third groove 913 may be provided along the length direction (e.g., the Z-direction in FIG. 17) of the stand column 910.

In some embodiments, referring to FIG. 22, the slider 931 is provided with a slider protrusion 9312 adapted to the third groove 913. In some embodiments, the slider protrusion 9312 may be engaged with the third groove 913, thereby clamping the slider 931 on the guide rail 912 to prevent the slider 931 from being separated from the guide rail 912.

In some embodiments, a rounded transition may be provided at a corner between the slider protrusion 9312 and the third groove 913, thereby reducing the wear between the slider protrusion 9312 and the third groove 913.

In some embodiments, the cross-sectional shape of the third groove 913 may include a shape, such as a rounded triangle, an arc, etc. In some embodiments, the cross-sectional shape of the slider protrusion 9312 may be adapted to the cross-sectional shape of the third groove 913. In this way, a gap between the slider protrusion 9312 and the third groove 913 may be reduced, thereby preventing the slider 931 from loosening relative to the U-shaped guide rail 912.

In some embodiments, referring to FIG. 22, a plurality of rollers 9314 may be disposed on the slider 931.

In some embodiments, the plurality of rollers 9314 may be rotatably connected with the slider 931. In some embodiments, the plurality of rollers 9314 may be connected with the stand column 910 in a rolling manner. In some embodiments, the second groove 9311 disposed in the slider 931 may contact with the guide rail 912, and a gap may be formed between other outer surfaces of the slider 931 and the stand column 910. The plurality of rollers 9314 may be connected with one of sides of the first groove 911. In this way, a contact area between the slider 931 and the stand column 910 may be reduced, thereby reducing the friction force during the movement of the slider 931. The plurality of rollers 9314 may support the slider 931, thereby improving the stability of the slider 931. Since the plurality of rollers 9314 are connected with one of the sides of the first groove 911, the friction force during the movement of the plurality of rollers 9314 may also be reduced.

In some embodiments, referring to FIG. 23, the slider pin 932 may include a first pin 9321, a first spring 9322, a first handle 9323, a first limiting block 9324, and a first connection block 9325. Referring to FIG. 22, the slider 931 may be provided with a slider lock hole 9313.

The slider lock hole 9313 refers to a through hole for passing the slider pin 932.

The first limiting block 9324 may be disposed in the slider lock hole 9313 in various ways, such as at least one of a clamping connection, a threaded connection, a welding connection, etc. In some embodiments, the first limiting block 9324 may be a cylindrical structure.

The first pin 9321 refers to a pin that is mounted in cooperation with the at least one slider limiting hole 915. In some embodiments, the first pin 9321 may penetrate through the slider lock hole 9313 and the first limiting block 9324 to be engaged with the at least one slider limiting hole 915.

In some embodiments, an end of the first pin 9321 close to the at least one slider limiting hole 915 may be connected with the first connection block 9325. The first pin 9321 may drive the first connection block 9325 to move synchronously. The first connection block 9325 may be engaged with the at least one slider limiting hole 915.

In some embodiments, the first spring 9322 may sleeve on the first pin 9321. An end of the first spring 9322 may be connected with the first limiting block 9324, and the other end of the first spring 9322 may be connected with the first connection block 9325. In some embodiments, the first spring 9322 may be in a compressed state and compressed between the first limiting block 9324 and the first connection block 9325. In this way, in the absence of external force, the first spring 9322 may apply pressure to the first connection block 9325 to limit the first connection block 9325 in the at least one slider limit hole 915, such that the slider 931 may be in a locked state, thereby avoiding potential safety hazards by preventing the first pin 9321 from being separated from the at least one slider limit hole 915. By applying a pulling force to the first pin 9321 to overcome a spring force of the first spring 9322, the first connection block 9325 may be pulled out of the at least one slider limit hole 915, such that the slider 931 may be in a movable state.

The first connection block 9325 may form a structure protruding relative to an outer surface of the first pin 9321 to serve as a mounting base for the first spring 9322. In some embodiments, the first connection block 9325 and the first pin 9321 may be connected in various ways, such as at least one of the clamping connection, the welding connection, the threaded connection, integral molding, etc.

In some embodiments, the first pin 9321 may be in threaded connection with the first limiting block 9324. By rotating the first pin 9321, the first pin 9321 may be screwed in or out relative to the first limiting block 9324, to control the connection or separation of the first connection block 9325 and the at least one slider limit hole 915, thereby avoiding the potential safety hazards by preventing the first connection block 9325 from accidentally loosening from the at least one slider limit hole 915.

In some embodiments, the first handle 9323 may connected with an end of the first pin 9321 away from the at least one slider limiting hole 915. The first handle 9323 may be configured to conveniently apply a force to the first pin 9321. In some embodiments, the first handle 9323 and the first pin 9321 may be connected in various ways, such as at least one of the clamping connection, the welding connection, the threaded connection, the integral molding, etc.

The sliding assembly provided in some embodiments of the present specification can drive the extension arm to move in the vertical direction as a whole, thereby adjusting the height of the extension arm to adapt to the users of different heights and/or can assist different fitness movements, thereby expanding the application scope of the fitness equipment 600. The sliding assembly can be locked or released by the slider pin, and the sliding assembly can be locked or adjusted quickly and conveniently, which has the advantage of being easy to use. By using the at least one slider limit holes, the position of the extension arm when during the movement can be limited, thereby improving the control accuracy of the extension arm during the movement in the vertical direction.

Figure 24:
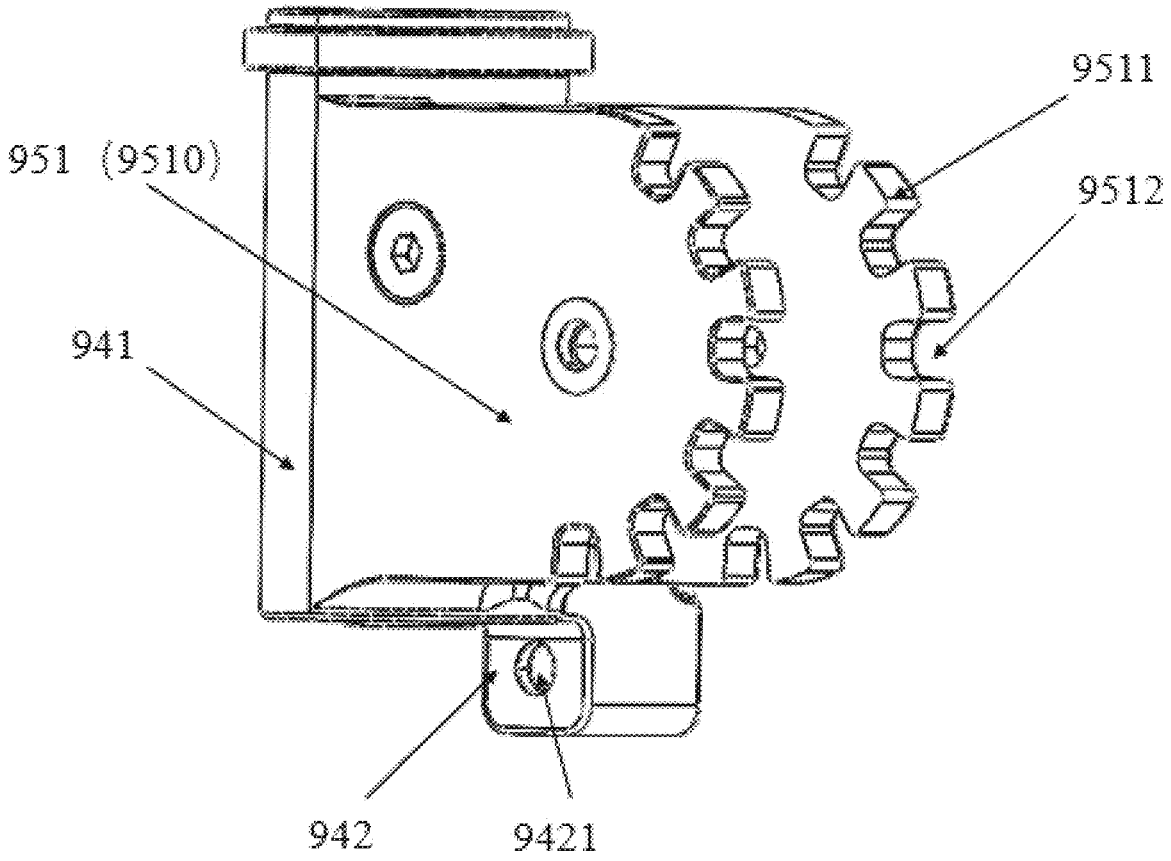
FIG. 24 is a schematic structural diagram illustrating a first assembly according to some embodiments of the present disclosure.
Figure 25:
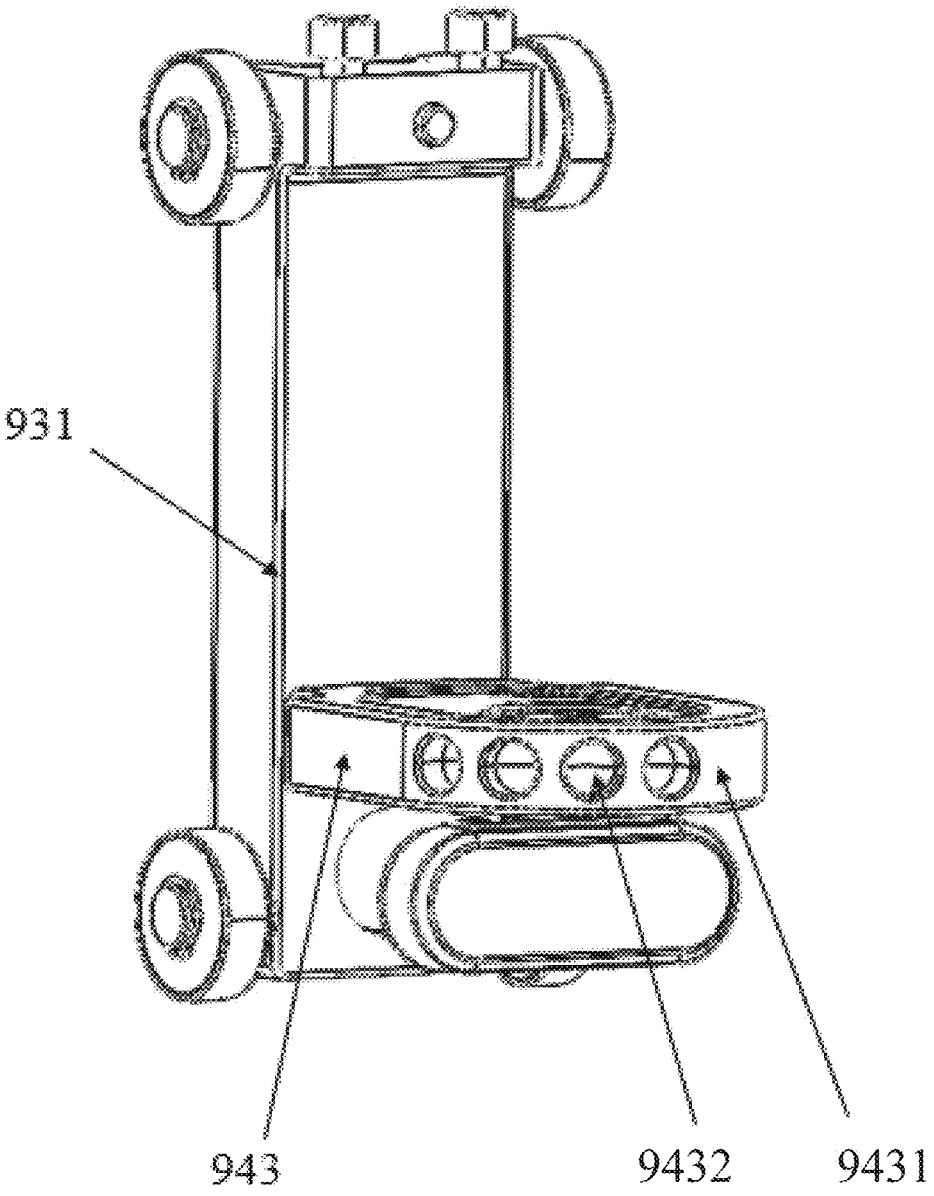
FIG. 25 is a schematic diagram illustrating a connection between an adjustment base and a slider according to some embodiments of the present disclosure.

FIG. 24 is a schematic structural diagram illustrating a first assembly according to some embodiments of the present disclosure. FIG. 25 is a schematic diagram illustrating a connection between an adjustment base and a slider according to some embodiments of the present disclosure.

In some embodiments, referring to FIGS. 17, 19, 24 and 25, the first assembly 940 may include an adjustment column 941, an adjustment base 943, and a disc pin 944. The adjustment base 943 may be disposed on the sliding assembly 930.

The adjustment base 943 may serve as a mounting base for mounting the adjustment column 941.

In some embodiments, when the sliding assembly 930 moves along a vertical direction (e.g., the Z-direction in FIG. 17), the sliding assembly 930 may drive the adjustment base 943 to move synchronously.

In some embodiments, the adjustment base 943 may be disposed on the slider 931. In some embodiments, the adjustment base 943 may be connected with the slider 931 in various ways, such as at least one of a clamping connection, a threaded connection, a welding connection, an integral molding, etc.

In some embodiments, the upper surface of the adjustment base 943 may be perpendicular to the vertical direction (e.g., the Z-direction in FIG. 17).

The adjustment column 941 refers to a stand columnar structure disposed on the adjustment base 943. In some embodiments, the adjustment column 941 may be rotatably disposed on the adjustment base 943. In some embodiments, the adjustment column 941 may serve as a mounting base for mounting a partial structure of the second assembly 950. When the adjustment column 941 rotates, the adjustment column 941 may drive the second assembly 950 to rotate synchronously. In some embodiments, the adjustment column 941 may be a revolving body structure. In some embodiments, the adjustment column 941 may include a rotating shaft rotatably connected with the adjustment base 943. In some embodiments, a bearing may be disposed between the rotating shaft and the adjustment base 943 to reduce the wear between the rotating shaft and the adjustment base 943.

In some embodiments, referring to FIG. 25, at least a portion of a side of the adjustment base 943 may include a first cylindrical surface 9431.

In some embodiments, the axis of the adjustment column 941 may be collinear with the axis of the first cylindrical surface 9431. A plurality of adjustment limiting holes 9432 may be provided in the first cylindrical surface 9431. In some embodiments, the plurality of adjustment limit holes 9432 may be distributed along a circumferential direction of the first cylindrical surface 9431. In some embodiments, axes of the plurality of adjustment limiting holes 9432 may be collinear with a radial direction of the first cylindrical surface 9431.

In some embodiments, referring to FIG. 24, an adjustment lock block 942 may be disposed on the adjustment column 941. The adjustment locking block 942 may be provided with a disc lock hole 9421. The disc lock hole 9421 may be aligned with one of the plurality of adjustment limiting holes 9432.

The adjustment lock block 942 may serve as a mounting base for mounting the disc pin 944 (e.g., FIG. 19). In some embodiments, the adjustment lock block 942 may be disposed at one end of the adjustment column 941 close to the adjustment base 943, and may protrude outward relative to an outer surface of the adjustment column 941. When the adjustment column 941 rotates, the adjustment column 941 may drive the adjustment lock block 942 to move synchronously, such that the disc lock hole 9421 may be aligned with different adjustment limiting holes 9432.

In some embodiments, the adjustment lock block 942 and the adjustment column 941 may be connected in various ways, such as at least one of a clamping connection, a welding connection, a threaded connection, integral molding, etc.

The disc pin 944 refers to a structure that can be connected to a hole. For example, the disc pin 944 may be connected to the disc lock hole 9421 and one of the plurality of adjustment limiting holes 9432. In some embodiments, the disc pin 944 may detachably penetrate through the disc lock hole 9421 and one of the plurality of adjustment limiting holes 9432. When the disc pin 944 passes through the disc lock hole 9421 and one of the plurality of adjustment limiting holes 9432, the adjustment column 941 may be kept fixed relative to the adjustment base 943, and the adjustment column 941 may no longer rotate. When the disc pin 944 is separated from one of the plurality of adjustment limiting holes 9432, the adjustment column 941 and the adjustment base 943 may rotate relative to each other. By making the disc pin 944 cooperate with different adjustment limit holes 9432, the first assembly 940 and the sliding assembly 930 may be in different second relative positions.

By using the disc pin, the first assembly and the sliding assembly can be quickly connected or separated, thereby facilitating quick adjustment of the fitness equipment 600.

In some embodiments, referring to FIG. 19, the disc pin 944 may include a second pin 9441, a second spring 9442, a second handle 9443, a second limiting block 9444, and a second connection block 9445.

One end of the second pin 9441 may be connected with the second handle 9443. The second limiting block 9444 and the second connection block 9445 may respectively sleeve on the second pin 9441. The second limiting block 9444 may be connected with the adjustment lock block 942.

The second spring 9442 may sleeve the second pin 9441. One end of the second spring 9442 may be connected with the second limiting block 9444, and the other end of the second spring 9442 may be connected with the second connection block 9445. In some embodiments, the second spring 9442 may be disposed between the second limiting block 9444 and the second connection block 9445 in a compressed state. In some embodiments, the second connection block 9445 may be detachably connected with one of the plurality of adjustment limiting holes 9432.

In some embodiments, the disc pin 944 may be similar to the slider pin 932. More descriptions regarding the disc pin 944 may be found in the related descriptions regarding the slider pin 932 in FIG. 23.

In some embodiments, the first assembly 940 may be made of a metal material to ensure the strength of the first assembly. For example, the first assembly 940 may be made of stainless steel.

The first assembly provided in some embodiments of the present disclosure can drive the extension arm to rotate in the horizontal plane as a whole, thereby adjusting the angle of the extension arm in the horizontal plane, and can be used to assist different fitness movements, thereby expanding the scope of application of the fitness equipment 600. The first assembly can be locked or released by the disc pin quickly and conveniently, which has the advantage of being easy to use. By using the plurality of adjustment limiting holes, the rotation angle of the extension arm can be limited, thereby improving the control accuracy of the extension arm during rotation in the horizontal plane.

Figure 26:
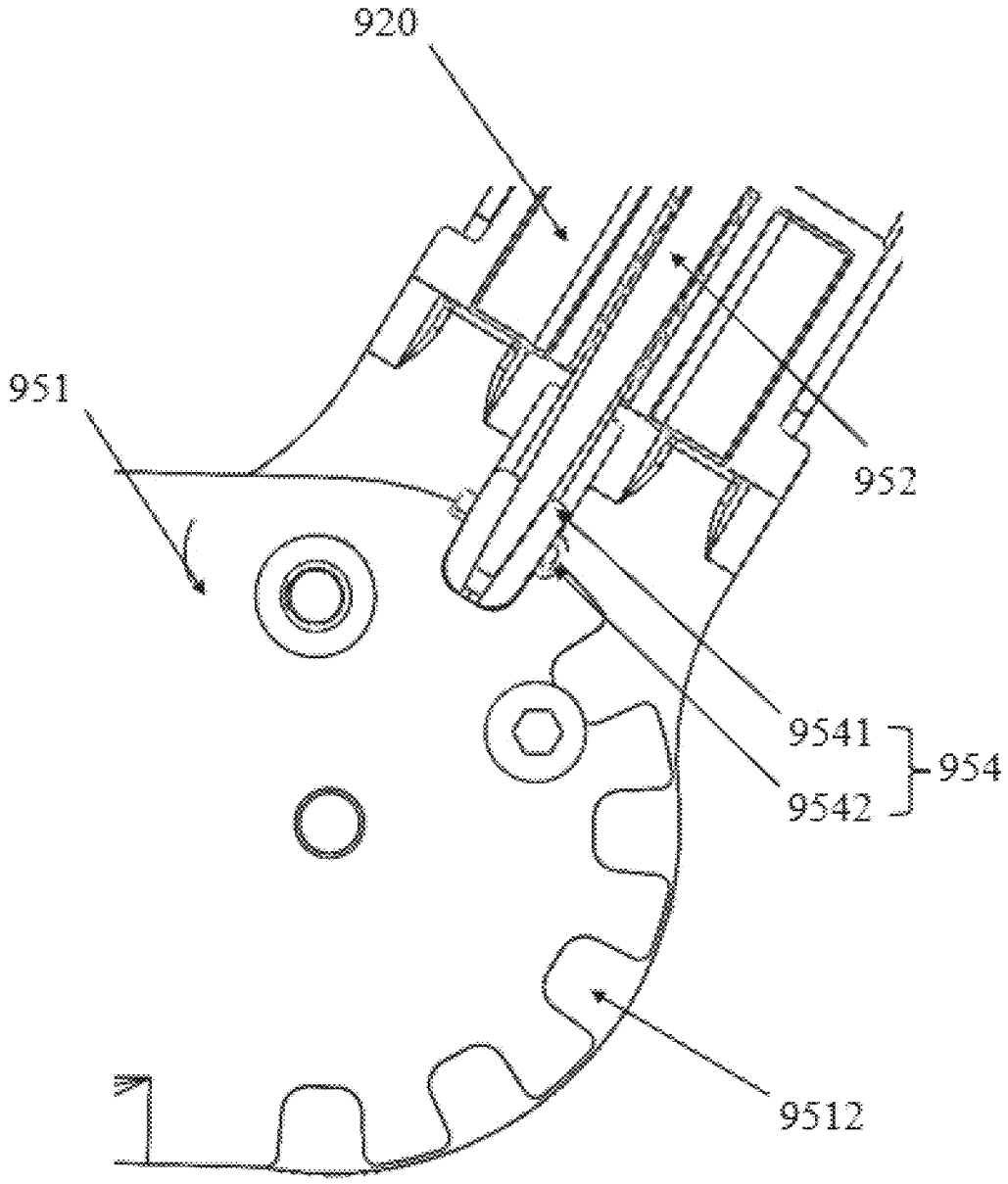
FIG. 26 is a schematic diagram illustrating a partial structural of an exemplary second assembly according to some embodiments of the present disclosure.
Figure 27:
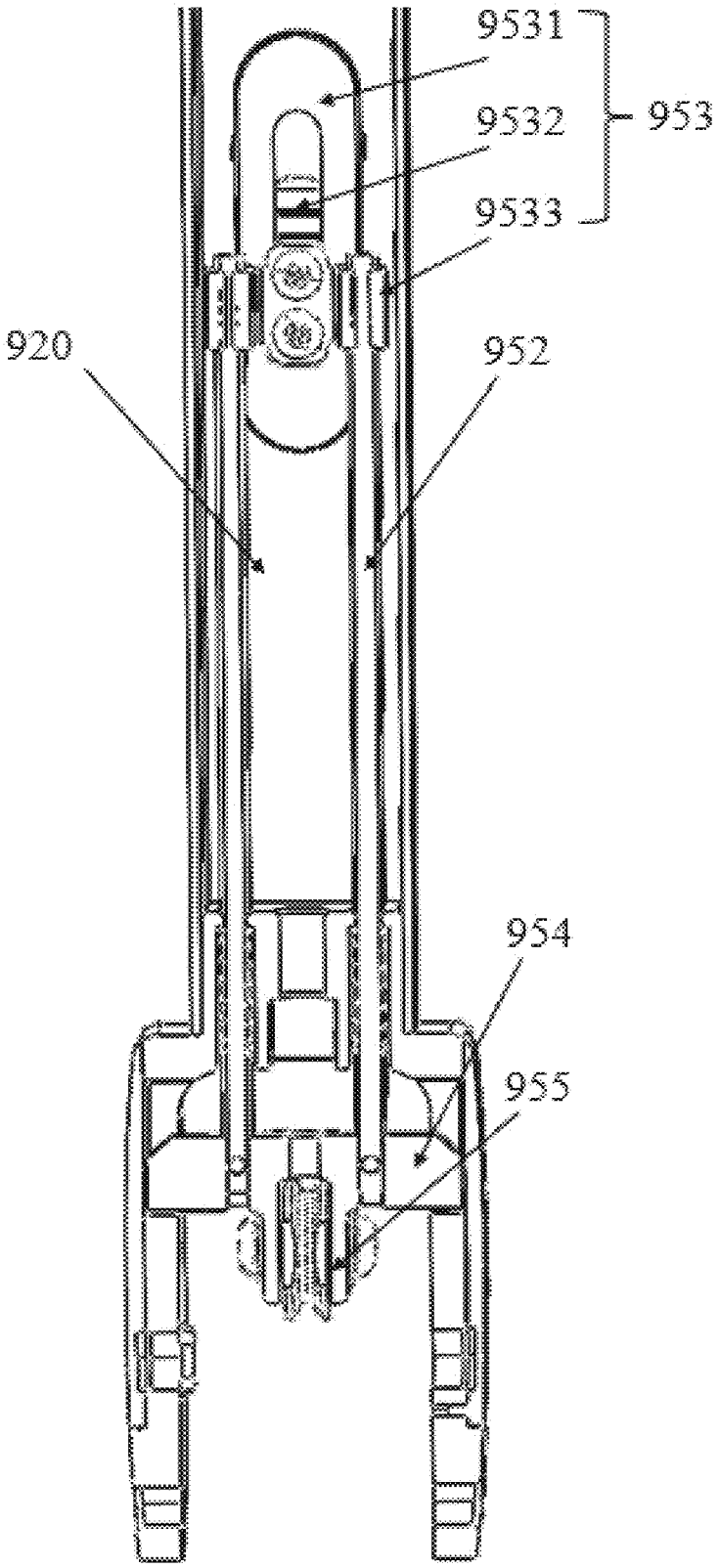
FIG. 27 is a schematic diagram illustrating a connection between a second assembly and an extension arm according to some embodiments of the present disclosure.

FIG. 26 is a schematic diagram illustrating a partial structural of an exemplary second assembly according to some embodiments of the present disclosure. FIG. 27 is a schematic diagram illustrating a connection between a second assembly and an extension arm according to some embodiments of the present disclosure.

In some embodiments, referring to FIG. 17, FIG. 26, and FIG. 27, the second assembly 950 may include an adjustment member 951, a connecting rod 952, and an operating member 953. The adjustment member 951 may be disposed on the adjustment column 941. The extension arm 920 may be rotatably connected with the adjustment member 951. One end of the connecting rod 952 may be detachably connected with the adjustment member 951, and the other end of the connecting rod 952 may be in a transmission connection with the operating member 953.

The adjustment member 951 refers to a structure that can be used to adjust a position of the extension arm 920. For example, the adjustment member 951 may adjust an angle between the extension arm 920 and a vertical direction.

In some embodiments, the adjustment member 951 may be connected with the adjustment column 941 in various ways, such as at least one of a clamping connection, a threaded connection, a welding connection, an integral molding, etc. When the adjustment column 941 rotates, the adjustment column 941 may drive the adjustment member 951 to rotate synchronously, and the adjustment member 951 may drive the extension arm 920 to rotate synchronously.

In some embodiments, referring to FIG. 24 and FIG. 26, the adjustment member 951 may include at least one disc gear 9510. The at least one disc gear 9510 may be disposed on a circumferential surface of the adjustment column 941. In some embodiments, the extension arm 920 may be rotatably connected with the at least one disc gear 9510, and a rotation center of the extension arm 920 may be colinear with an axis of the at least one disc gear 9510.

In some embodiments, the extension arm 920 may be rotatably connected with the at least one disc gear 9510 in various ways. For example, the extension arm 920 may be rotatably connected with the at least one disc gear 9510 through an extension arm shaft. The extension arm shaft may simultaneously penetrate through at least a portion of the extension arm 920 and the at least one disc gear 9510. In some embodiments, the extension arm shaft may be fixed to the extension arm 920 and may be rotatably connected with the disc gear 9510. Alternatively, the extension arm shaft may be rotatably connected with the extension arm 920 and may be fixed to the at least one disc gear 9510.

The at least one disc gear 9510 refers to a disc structure with a toothed structure. In some embodiments, at least a portion of an outer surface of the at least one disc gear 9510 may include a second cylindrical surface 9511. The second cylindrical surface 9511 may be disposed in a circumferential direction of the at least one disc gear 9510. In some embodiments, the axis of the second cylindrical surface 9511 may be perpendicular to the axis of the adjustment column 941.

In some embodiments, a plurality of adjustment tooth grooves 9512 may be disposed on the second cylindrical surface 9511. The plurality of adjustment tooth grooves 9512 may be disposed along a circumferential direction of the second cylindrical surface 9511.

The plurality of adjustment tooth groove 9512 may be configured to form a connection relationship with the connecting rod 952.

In some embodiments, the connecting rod 952 may be detachably engaged with the plurality of adjustment tooth grooves 9512. When the connecting rod 952 is engaged with one of the plurality of adjustment tooth grooves 9512, a relative position of the extension arm 920 to the at least one disc gear 9510 may remain fixed. When the connecting rod 952 is separated from one of the plurality of adjustment tooth grooves 9512, the extension arm 920 may rotate relative to the at least one disc gear 9510. By engaging the connecting rod 952 with the plurality of adjustment tooth grooves 9512, the extension arm 920 and the second assembly 950 may be in different third relative positions.

More descriptions regarding the connecting rod 952 may be found in the related descriptions below.

In some embodiments, the at least one disc gear 9510 may include two disc gear 9510. In some embodiments, the two disc gears 9510 may be parallel to each other. In some embodiments, the two disc gears 9510 may be coaxial. In some embodiments, the plurality of adjustment tooth grooves 9512 on the two disc gears 9510 may be aligned with each other. The connecting rod 952 may be connected with the two disc gears 9510 simultaneously.

By using the two disc gears, the extension arm and the connecting rod can be supported from two directions, which can improve the stability of the extension arm and the connecting rod, and enhance the bearing capacity of the adjustment member.

In some embodiments, the extension arm 920 may be rotatably connected with the two disc gears 9510, respectively.

In some embodiments, an accommodation space may be provided at one end of the extension arm 920 close to the disc gear 9510. The accommodation space may be a groove structure. The two disc gears 9510 may be located in the accommodation space. Each of two opposite side walls of the accommodation space may be rotatably connected with one of the two disc gears 9510.

In some embodiments, the at least one disc gear 9510 and the adjustment column 941 may be connected in various ways, such as at least one of a clamping connection, a threaded connection, a welding connection, integral molding, etc.

By adopting the at least one disc gear, division degrees may be formed using the plurality of adjustment tooth grooves disposed on the at least one disc gear, so as to control different angles of the extension arm in the vertical plane, thereby improving the control accuracy of the extension arm during rotation in the vertical plane.

The connecting rod 952 refers to a rod structure for connecting with the adjustment member 951. In some embodiments, the connecting rod 952 may be parallel to the extension arm 920. In some embodiments, the extension arm 920 may be a hollow structure. The connecting rod 952 may be disposed inside the extension arm 920.

More descriptions regarding the connecting rod 952 may be found in the present disclosure above.

The operating member 953 refers to a structure with an operating function. For example, the operating member 953 may move back and forth under the action of an external force. In some embodiments, the operating member 953 may drive the connecting rod 952 to move synchronously. In some embodiments, the operating member 953 may move back and forth along a length direction of the extension arm 920, thereby driving the connecting rod 952 to move back and forth along the length direction of the extension arm 920. When the operating member 953 drives the connecting rod 952 to move to a first position in a direction away from the adjustment member 951, the connecting rod 952 may be separated from the adjustment member 951, such that the rotational freedom of the extension arm 920 rotating around the extension arm shaft may be released, and the extension arm 920 may rotate relative to the adjustment member 951. When the operating member 953 drives the connecting rod 952 to move to a second position in a direction close to the adjustment member 951, the connecting rod 952 may be engaged with the adjustment member 951, such that the rotational freedom of the extension arm 920 rotating around the extension arm shaft may be locked, and the extension arm 920 may be fixed relative to the adjustment member 951, thereby locking the extension arm 920. A distance between the first position and the adjustment member 951 may be greater than a distance between the second position and the adjustment member 951.

In some embodiments, the operating member 953 may include a fourth groove 9531 (also referred to as an operating slide groove), an operating block 9532, and a connecting sleeve 9533. The fourth groove 9531 may be disposed on the extension arm 920. The operating block 9532 may be slidably connected with the fourth groove 9531. A direction in which the operating block 9532 slides relative to the fourth groove 9531 may be parallel to the length direction of the extension arm 920. The connecting sleeve 9533 may be disposed on the operating block 9532. The connecting sleeve 9533 may be connected with the connecting rod 952.

The fourth groove 9531 may serve as a mounting base for mounting the operating block 9532. In some embodiments, the fourth groove 9531 may be connected with the extension arm 920 in various ways, such as at least one of the clamping connection, the welding connection, integral molding, etc.

The operating block 9532 refers to a slider capable of sliding in the fourth groove 9531. In some embodiments, the operating block 9532 may be slidably engaged with the fourth groove 9531 to prevent the operating block 9532 from being separated from the fourth groove 9531. In some embodiments, a gap may be formed between the fourth groove 9531 and the extension arm 920. The operating block 9532 may be engaged in the gap to further prevent the operating block 9532 from being separated from the fourth groove 9531.

The connecting sleeve 9533 may be connected with the connecting rod 952, so as to transmit a pulling force or a pushing force to the connecting rod 952 to drive the connecting rod 952 to move. In some embodiments, the connecting sleeve 9533 and the connecting rod 952 may be connected in various ways, such as at least one of the clamping connection, the threaded connection, etc.

In some embodiments, two connecting sleeves 9533 may be provided, and two connecting rods 952 may be provided. Each of the two connecting sleeves 9533 may be connected with one of the two connecting rods 952. In this way, the stability of the extension arm 920 can be improved, and the pressure transmitted from the extension arm 920 to the connection rod 952 can be reduced, ensuring the use safety of the connecting rod 952.

In some embodiments, one end of the connecting rod 952 close to the adjustment member 951 may be connected with an adjustment pin 954.

The adjustment pin 954 may be detachably connected with one of the plurality of adjustment tooth grooves 9512. In some embodiments, at least one side of the adjustment pin 954 may be matched with an inner side of one of the plurality of adjustment tooth grooves 9512. For example, a side of the adjustment pin 954 contacting with one of the plurality of adjustment tooth grooves 9512 may be matched with the inner side of one of the plurality of adjustment tooth grooves 9512. In this way, the adjustment pin 954 can fully contact with the inner side of one of the plurality of adjustment tooth grooves 9512, avoiding the problem of shaking of the extension arm 920 caused by the gap.

In some embodiments, when two connecting rods 952 are provided, the two connecting rods 952 may be connected with the same disc pin 954.

The ends of the two connecting rods 952 may be connected with the same disk pin 954, such that the stability and strength of the ends of the two connecting rods 952 can be improved, and the two connecting rods 952 can be easily aligned with the plurality of adjustment tooth grooves 9512 simultaneously, thereby avoiding affecting the use caused by the misalignment of the ends of the two connecting rods 952.

In some embodiments, referring to FIG. 26, the disk pin 954 may include two pin plates 9541 and two pin screws 9542.

Each of the two connecting rods 952 may be disposed between the two pin plates 9541. A clamping force may be provided for the two pin plates 9541 using the pin screws 9542 such that the two pin plates 9541 may clamp the two connecting rods 952.

In some embodiments, referring to FIG. 27, a fixed pulley 955 may be provided on each of the two pin plates 9541. The fixed pulley 955 may be configured to change a movement direction of a rope body 1030.

More descriptions regarding the rope body 1030 may be found in the related descriptions below.

The disc pin provided in some embodiments of the present disclosure has the advantages of simple structure, convenient use, and reliable clamping.

In some embodiments, a reset structure may be provided on the extension arm 920.

The reset structure may apply a force to the operating member 953. When the operating member 953 is controlled to move using an external force, it is necessary to overcome the force applied to the operating member 953 by the reset structure. After the external force is removed, the force applied to the operating member 953 by the reset structure may enable the operating member 953 to reset. In some embodiments, the reset structure may be configured to cause the operating block 9532 to move from a first position to a second position. In this way, after the extension arm 920 is adjusted to a position, the force applied to the operating block 9532 may be removed, and the reset structure may cause the operating block 9532 to move from the first position to the second position, driving the connecting rod 952 to connect with the one of the plurality of adjustment tooth grooves 9512 to lock the extension arm 920, thereby making the adjustment more convenient.

In some embodiments, the reset structure may include a reset spring.

In some embodiments, one end of the reset spring may be connected with the extension arm 920, and the other end of the reset spring may be connected with the operating block 9532. When the operating member 9532 is in the first position, the reset spring may be in a first state (e.g., a first compressed state). When the operating member 9532 is in the second position, the reset spring may be in a second state (e.g., a second compressed state or a natural state). In some embodiments, a spring force in the second state may be less than a spring force in the first state.

The reset spring has the advantages of simple structure and easy mounting and use.

The second assembly provided in some embodiments of the present disclosure can drive the extension arm to rotate in the vertical plane as a whole, thereby adjusting the angle of the extension arm in the vertical plane, which can be used to assist different fitness movements. The first assembly can adjust the angle of the extension arm in the horizontal plane as a whole, such that the scope of applicable of the fitness equipment 600 can be further expanded. By using the operating member, the connection and separation of the adjustment member and the connecting rod can be remotely controlled, which has the advantages of being easy and quick to use.

The existing fitness equipment 600 may only be used to assist a single fitness movement. When the user carries out exercise using different fitness movements, the corresponding fitness equipment 600 needs to be replaced. Different fitness equipment 600 also has different connection ends (e.g., handles, etc.) with the user, resulting in more redundant accessories and higher cost of using the fitness equipment 600.

To this end, some embodiments of the present disclosure provide a detachable accessory. By providing a first connecting member and a second connecting member which are detachably connected, the first connecting member may be provided on various fitness devices, and the second connecting member may be provided on a connection end of the fitness equipment 600. The user may use a unified connection end to connect with various fitness equipment 600, thereby reducing redundant accessories. In public places such as a gym, the user may use the connection end of the user to connect with different fitness equipment 600, which can reduce indirect contact with strangers.

Figure 28:
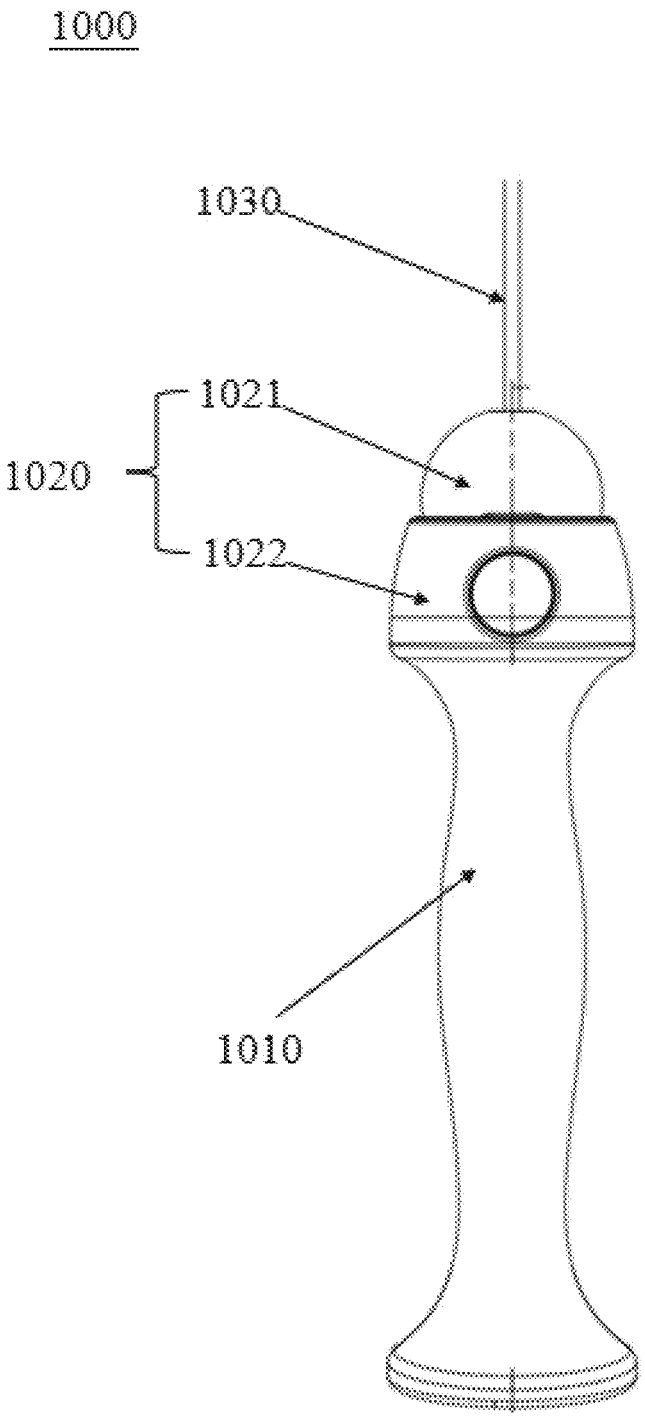
FIG. 28 is a schematic structural diagram illustrating an exemplary detachable accessory according to some embodiments of the present disclosure.
Figure 29:
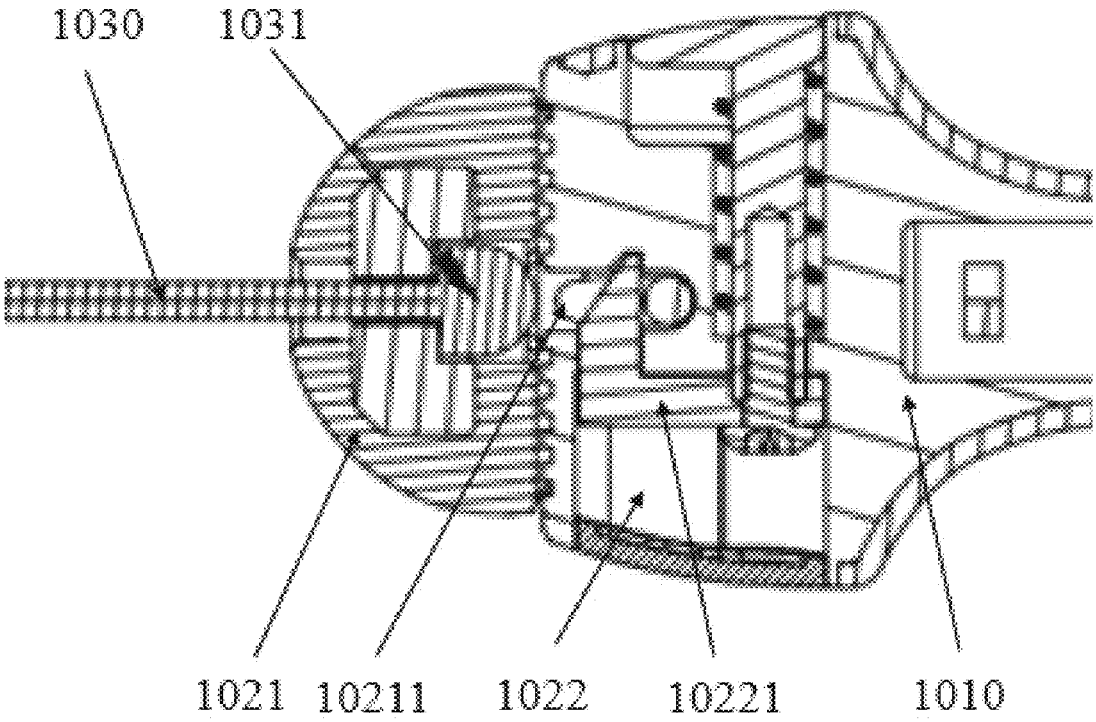
FIG. 29 is a schematic diagram illustrating a partial cross section of an exemplary detachable accessory according to some embodiments of the present disclosure.
Figure 30:
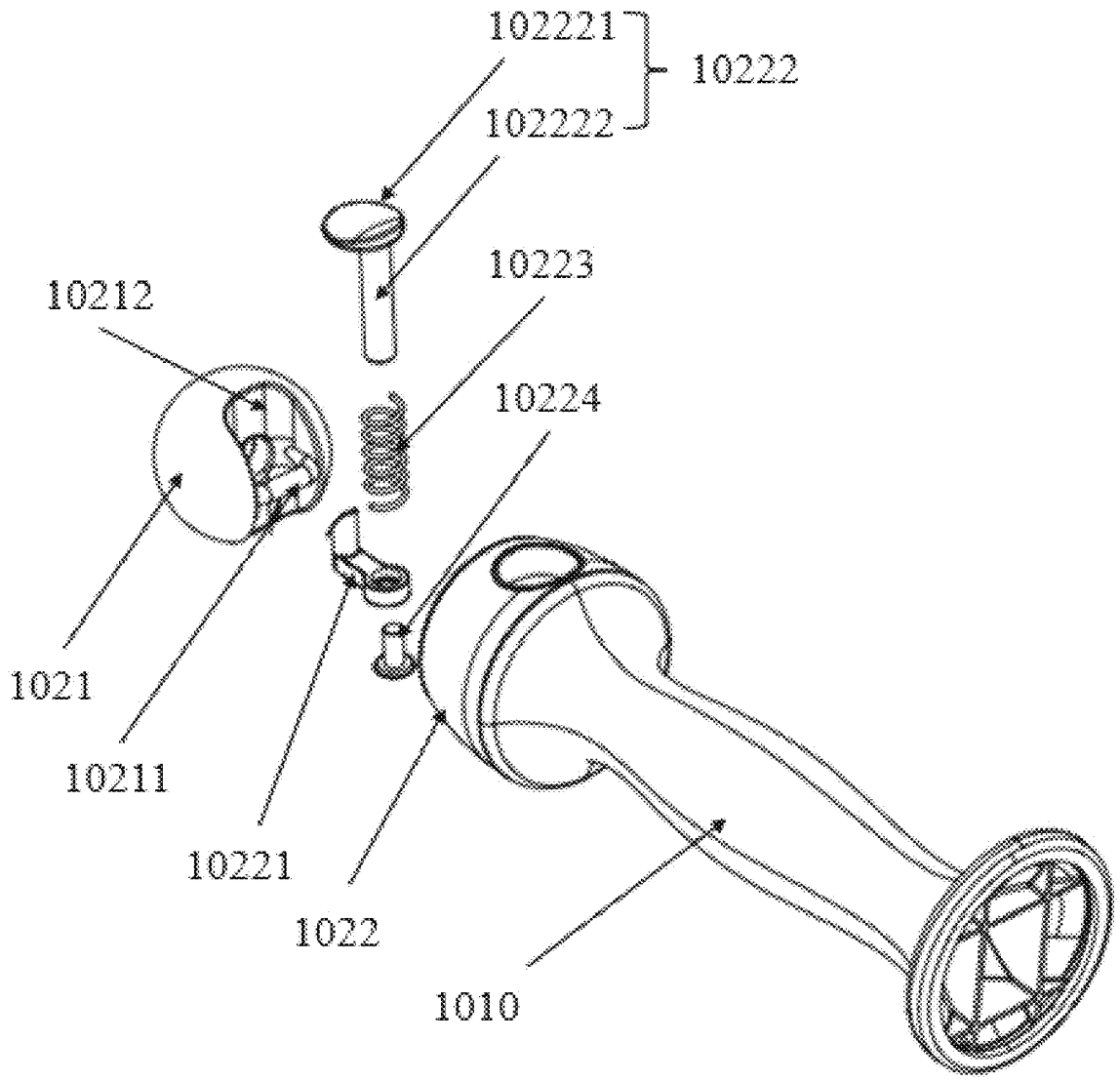
FIG. 30 is an explosion schematic diagram illustrating an exemplary detachable accessory according to some embodiments of the present disclosure.

FIG. 28 is a schematic structural diagram illustrating an exemplary detachable accessory according to some embodiments of the present disclosure. FIG. 29 is a schematic diagram illustrating a partial cross section of an exemplary detachable accessory according to some embodiments of the present disclosure. FIG. 30 is an explosion schematic diagram illustrating an exemplary detachable accessory according to some embodiments of the present disclosure.

Referring to FIGS. 28-29, the detachable accessory 1000 for the fitness equipment 600 may include a handle 1010 and a connection assembly 1020.

The handle 1010 refers to a part that a user holds during use. In some embodiments, at least a portion of the handle 1010 may include a revolving body structure, such as one end connected with the connection assembly 1020, thereby avoiding forming a sharp protrusion, and avoiding potential safety hazards. In some embodiments, the diameter of at least one end of the handle 1010 may be greater than the diameter of a middle part of the handle. For example, the diameter of one end of the handle 1010 away from the connection component 1020 may be greater than the diameter of the middle part of the handle, thereby preventing the handle 1010 from detaching from the user during use. In some embodiments, an outer side of the handle 1010 may be provided with an anti-slip structure, such as an anti-slip pattern, etc., thereby preventing problems such as slipping and the handle detaching from the user during use.

The connection assembly 1020 refers to a structure used to connect with other structures. For example, the connection assembly 1020 may be configured to connect the rope body 1030 with the handle 1010 such that a force may be transmitted to the rope body 1030 when the user pulls the handle 1010.

In some embodiments, the connection assembly 1020 may include a first connection member 1021 and a second connection member 1022. The first connection member 1021 may be detachably connected with the rope body 1030 of the fitness equipment 600. At least a portion of the rope body 1030 may penetrate through the first connection member 1021.

The rope body 1030 may be configured to connect with a weight. For example, the rope body 1030 may be configured to connect with an iron plate, a spring, etc. The user may pull the rope body 1030 to resist a gravity or an elastic force of the weight, thereby achieving the exercise effect. In some embodiments, referring to FIG. 27, one end of the rope body 1030 may penetrate through the extension arm 920 to be connected with the fixed pulley 955, and then change a movement direction through the fixed pulley 955 to be connect with the weight.

In some embodiments, at least a portion of the rope body 1030 may penetrate through the extension arm 920 and the stand column 910. When the extension arm 920 rotates, the at least a portion of the rope body 1030 may be driven to rotate synchronously, thereby changing an angle of the rope body 1030.

In some embodiments, the second connection member 1022 may be disposed in the handle 1010. The first connection member 1021 and the second connection member 1022 may be detachably connected. In some embodiments, when the first connection member 1021 and the second connection member 1022 are connected, the rope body 1030 and the handle 1010 may form a connection. When the first connection member 1021 and the second connection member 1022 are separated, the rope body 1030 and the handle 1010 may be disconnected.

In some embodiments, the first connection member 1021 may include a spherical structure.

In some embodiments, the first connection member 1021 may adopt the spherical structure, which can avoid forming a sharp protrusion structure, thereby avoiding safety hazards. In some embodiments, an accommodation space may be provided in the first connection member 1021 for accommodating the at least a portion of the rope body 1030. The first connection member 1021 may be provided with a hole through which the rope body 1030 penetrates. The hole may be communicated with the accommodation space.

In some embodiments, the rope body 1030 may be engaged with the first connection member 1021 through a rope knot 1031.

The rope knot 1031 may be formed by tying the rope body 1030, which has the advantages of being simple and convenient to operate. A size of the rope knot 1031 in a radial direction may be greater than a size of the rope body 1030, such that the rope knot 1031 may not penetrate through the hole through which the rope body 1030 can pass. When the rope body 1030 needs to be separated from the first connection member 1021, the rope body 1030 may be separated from the first connection member 1021 by untying the rope knot 1031 without additional redundant structures, thereby simplifying the structure.

The detachable accessory provided in some embodiments of the present disclosure can detachably connect the handle with the rope body, such that various different fitness equipment 600 can be connected using a unified handle, thereby improving the versatility of the various fitness equipment 600. The detachable accessory provided in some embodiments of present disclosure have the advantages of simple structure and convenient use, and are suitable for large-scale promotion and use.

In some embodiments, the first connection member 1021 may include a clamp ring 10211, and the second connection member 1022 may include a buckle mechanism. The buckle mechanism may be engaged with the clamp ring 10211.

The clamp ring 10211 refers to an annular structure provided on the first connection member 1021. At least a portion of the buckle mechanism may extend into the clamp ring 10211 to form a connection with the clamp ring 10211, such that the first connection member 1021 and the second connection member 1022 may be engaged with each other.

The buckle mechanism may be connected with the clamp ring 10211, which has the advantages of simple structure and easy use.

In some embodiments, the first connection member 1021 may include a spherical structure, referring to FIG. 30, and a fifth groove 10212 (also referred to as a ball head groove) may be provided on the spherical structure.

The fifth groove 10212 refers to a groove structure provided on the spherical structure. In some embodiments, the fifth groove 10212 may penetrate the spherical structure along a radial direction of the spherical structure.

In some embodiments, the clamp ring 10211 may be disposed in the fifth groove 10212. By disposing the clamp ring 10211 in the fifth groove 10212, the risk of collision damage caused by a protrusion of the clamp ring formed on an outer surface of the spherical structure can be avoided.

In some embodiments, the clamp ring 10211 may be disposed in the fifth groove 10212 in various ways, such as at least one of a clamping connection, a threaded connection, integral molding, etc.

In some embodiments, at least a portion of the spherical structure may extend into the second connection member 1022. For example, the fifth groove 10212 may extend into the second connection member 1022. The second connecting member 1022 may be used to shield the fifth groove 10212, such that impurities, sweat, etc. can be prevented from entering the fifth groove 10212 and causing wear and corrosion, thereby ensuring the service life of the spherical structure.

In some embodiments, the rope knot 1031 may penetrate through the fifth groove 10212 to extend out of the first connection member 1021, thereby untying the rope knot 1031.

In some embodiments, the rope body 1030 may include the pull rope 440 and/or the elastic rope 450. The user may directly pull the pull rope 440 and/or the elastic rope 450 by pulling the handle 1010 to drive the pull wheel assembly 460 to rotate.

In some embodiments, the rope body 1030 may be connected with the pull rope 440 and/or the elastic rope 450. The user may pull the pull rope 440 and/or the elastic rope 450 by pulling the handle 1010 through the rope body 1030 to drive the pull wheel assembly 460 to rotate.

The pull wheel assembly 460 may rotate to drive the central gear assembly 210 to rotate, and the resistance module 500 may provide resistance (i.e., a force in an opposite direction to a force applied by the user) to the central gear assembly 210 through the transmission shaft 470.

More descriptions regarding the pull rope 440, the elastic rope 450, the pull wheel assembly 460, the resistance module 500, and the central gear assembly 210 may be found in the related description above.

In some embodiments, the buckle mechanism may include a buckle 10221.

The buckle 10221 may be detachably connected with the clamp ring 10211, such as hooking, etc. When the buckle 10221 is hooked with the clamp ring 10211, the first connection member 1021 may be connected with the second connection member 1022. When the buckle 10221 is separated from the clamp ring 10211, the first connection member 1021 may be disconnected from the second connection member 1022.

In some embodiments, the buckle 10221 may be L-shaped. In some embodiments, at least a portion of a side of the buckle 10221 facing the first connection member may be an inclined surface. An inclination angle of the inclined surface may be within a range of 30°-80°. The inclination angle of the inclined surface may be within a range of 30°-60°. The inclination angle of the inclined surface may be within a range of 40°-55°. The inclination angle of the inclined surface may be within a range of 45°-50°. The inclination angle refers to an angle between the inclined surface and an axis of the handle 1010. The axis refers to a central line along an extension direction of the handle 1010. When the first connection member 1021 moves in a direction close to the second connection member 1022, the clamp ring 10211 may abut against the inclined surface of the buckle 10221. During the continuous movement of the first connection member 1021, the clamp ring 10211 may apply a thrust to the inclined surface of the buckle 10221, such that the buckle 10221 may move in a direction away from the clamp ring 10211, a movement direction of the buckle 10221 being perpendicular to a movement direction of the clamp ring 10211, until the clamp ring 10211 is separated from the inclined surface of the buckle 10221, the force applied to the inclined surface of the buckle 10221 by the clamp ring 10211 may disappear. The buckle 10221 may reset, and the buckle 10221 may be connected with the clamp ring 10211.

In the movement process of the clamp ring 10211, the clamp ring 10211 may be engaged with the buckle 10221, thereby simplifying the connection between the first connection member and the second connection member, and achieving the advantages of being easy and quick to use.

In some embodiments, the second connection member 1022 may further include a snap fastener 10222 and a pressing spring 10223.

The snap fastener 10222 refers to a button that can be pressed. In some embodiments, the snap fastener 10222 may be disposed on the second connection member 1022 in a pressable manner. In some embodiments, the snap fastener 10222 may be in transmission connection with the buckle mechanism. For example, the snap fastener 10222 may be in transmission connection with the buckle 10221. In some embodiments, a pressable direction of the snap fastener 10222 may be parallel to a radial direction of the second connection member 1022. In some embodiments, at least a portion of the snap fastener 10222 may protrude from an outer surface of the second connection member 1022, so as to facilitate pressing the snap fastener 10222.

In some embodiments, the snap fastener 10222 may include a cap body and a stand column body 102222. The cap body 102221 may be connected with one end of the stand column body 102222. The other end of the stand column body 102222 may be connected with the buckle 10221. In some embodiments, the cap body 102221 may be a disc structure. A diameter of the cap body 102221 may be greater than a diameter of the stand column body 102222. In some embodiments, at least a portion of the cap body 102221 may protrude from an outer surface of the second connection member 1022. A movement space in which the cap body 102221 can move may be set in the second connection member 1022. By pressing the cap body 102221, the cap body 102221 may drive the buckle 10221 to move through the stand column body 102222, such that the buckle 10221 may avoid a movement path of the clamp ring 10211, and the clamp ring 10211 may enter or leave the second connection member 1022. When the first connection member 1021 needs to be connected with the second connection member 1022, the first connection member 1021 and the second connection member 1022 may be directly connected without pressing the snap fastener 10222, causing the clamp ring 10211 to push the buckle 10221.

In some embodiments, the cap body 102221 and the stand column body 102222 may be connected in various ways, such as at least one of the clamping connection, the threaded connection, integral molding, etc.

In some embodiments, the pressing spring 10223 may sleeve the stand column 102222. The pressing spring 10223 may abut against the cap body 102221 and the second connection member 1022, respectively.

The cap body 102221 may provide support for the pressing spring 10223. When the user presses the cap body

102221, the pressing spring 10223 may be compressed by the cap body 102221 to be in a compressed state. When the user releases the force applied to the cap body 102221, the cap body 102221 may reset under the force of the pressing spring 10223, and the clamp button 10222 may be driven to reset.

By using the snap fastener, the user can apply force from the outside of the second connection member to the buckle inside the second connection member, thereby conveniently connecting or disconnecting the first connection member with/from the second connection member. The snap fastener can automatically reset by using the spring, and when the first connection member is connected with the second connection member, a locking force can be provided to make the buckle lock the clamp ring, thereby ensuring safety in use.

In some embodiments, a stepped hole may be provided in the buckle 10221. In some embodiments, a large hole portion of the stepped hole may be connected with the stand column body 102222 by the clamping connection, etc.

In some embodiments, internal threads may be provided at one end of the stand column body 102222 close to the buckle 10221. The second connection member 1022 may further include a snap fastener screw 2224. The snap fastener screw 2224 may penetrate through a small hole portion of the stepped hole to be threadedly connected with the internal threads of the stand column body 102222. In this way, a connection strength between the buckle 10221 and the stand column body 102222 can be improved, and the problem of failure of the snap fastener 10222 caused by loosening of the buckle 10221 and the stand column body 102222 can be avoided

Having thus described the basic concepts, it may be rather apparent to those skilled in the art after reading this detailed disclosure that the foregoing detailed disclosure is intended to be presented by way of example only and is not limiting. Although not explicitly stated here, those skilled in the art may make various modifications, improvements and amendments to the present disclosure. These alterations, improvements, and modifications are intended to be suggested by this disclosure, and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure or characteristic described in connection with the embodiment is included in at least one embodiment of the present disclosure. Therefore, it is emphasized and should be appreciated that two or more references to "an embodiment" or "one embodiment" or "an alternative embodiment" in various parts of this specification are not necessarily all referring to the same embodiment. In addition, some features, structures, or features in the present disclosure of one or more embodiments may be appropriately combined.

In closing, it is to be understood that the embodiments of the present disclosure disclosed herein are illustrative of the principles of the embodiments of the present disclosure. Other modifications that may be employed may be within the scope of the present disclosure. Thus, by way of example, but not of limitation, alternative configurations of the embodiments of the present disclosure may be utilized in accordance with the teachings herein. Accordingly, embodiments of the present disclosure are not limited to that precisely as shown and described.

What is claimed is:

1. A fitness device, comprising an adjustable accessory; wherein the adjustable accessory includes a stand column, an extension arm, a sliding assembly, a first assembly, and a second assembly;

the sliding assembly is slidably disposed on the stand column;

the first assembly is rotatably disposed on the sliding assembly; and the second assembly is connected with the first assembly; the extension arm is rotatably connected with the second assembly; wherein the first assembly includes an adjustment column and an adjustment base;

the adjustment base is disposed on the sliding assembly;

the adjustment column is rotatably disposed on the adjustment base;

the second assembly includes an adjustment member, a connecting rod, and an operating member;

the adjustment member is disposed on the adjustment column;

the extension arm is rotatably connected with the adjustment member;

one end of the connecting rod is detachably connected with the adjustment member, and an other end of the connecting rod is in a transmission connection with the operating member; and the operating member is disposed on the extension arm.

2. The fitness device of claim 1, wherein the sliding assembly includes a slider and a slider pin;

the slider is slidably connected with the stand column;

at least one slider limiting hole is provided in the stand column; and the slider pin is inserted into the slider and is capable of being matched with the at least one slider limiting hole.

3. The fitness device of claim 2, wherein a first groove is provided in each of at least one side of the stand column, and a guide rail is provided in the first groove; and the slider is provided with a second groove matched with the guide rail in the first groove.

4. The fitness device of claim 3, wherein at least one side of the guide rail is provided with a third groove; and the slider is provided with a slider protrusion matched with the third groove.

5. The fitness device of claim 2, wherein the slider is provided with a plurality of rollers, and the plurality of rollers are connected with the stand column in a rolling manner.

6. The fitness device of claim 1, wherein the operating member includes a fourth groove, an operating block, and a connecting sleeve;

the fourth groove is disposed in the extension arm;

the operating block is slidably connected with the fourth groove, and a relative sliding direction of the operating block to the fourth groove is parallel to a length direction of the extension arm; and the connecting sleeve is disposed on the operating block, and the connecting sleeve is connected with the connecting rod.

7. The fitness device of claim 6, wherein a reset structure is disposed on the extension arm, and the reset structure is configured to cause the operating block to move from a first position to a second position.

8. The fitness device of claim 7, wherein the reset structure includes a reset spring;

an end of the reset spring is connected with the extension arm, and an other end of the reset spring is connected with the operating block;

when the operating member is in the first position, the reset spring is in a first state;

when the operating member is in the second position, the reset spring is in a second state; and a spring force in the second state is less than the spring force in the first state.

9. The fitness device of claim 1, wherein the adjustment member includes at least one disc gear; the extension arm is rotatably connected with the at least one disc gear, and a rotation center of the extension arm is colinear with an axis of the at least one disc gear;

the at least one disc gear is disposed on a circumferential surface of the adjustment column;

an axis of each of the at least one disc gear is perpendicular to an axis of the adjustment column;

one of the at least one disc gear includes a second cylindrical surface, a plurality of adjustment tooth grooves are disposed in the second cylindrical surface, and the plurality of adjustment tooth grooves are disposed along a circumferential direction of the second cylindrical surface, and the connecting rod is detachably engaged with one of the plurality of adjustment tooth grooves.

10. The fitness device of claim 9, wherein the at least one disc gear includes two disc gears.

11. The fitness device of claim 9, wherein the connecting rod is connected with an adjustment pin, and the adjustment pin is detachably connected with one of the plurality of adjustment tooth grooves.

12. The fitness device of claim 1, wherein the first assembly includes a disc pin;

at least a portion of a side of the adjustment base includes a first cylindrical surface;

an axis of the adjustment column is collinear with an axis of the first cylindrical surface, and the first cylindrical surface is provided with a plurality of adjustment limiting holes;

the adjustment column is provided with an adjustment lock block, the adjustment lock block is provided with a disc lock hole, the disc lock hole is capable of being aligned with one of the plurality of adjustment limiting holes, and the disc pin detachably passes through the disc lock hole and the one of the plurality of adjustment limiting holes.

* * * * *